US012446660B2

(12) United States Patent
Ryabinin et al.

(10) Patent No.: US 12,446,660 B2
(45) Date of Patent: Oct. 21, 2025

(54) FLUID DISTRIBUTORS AND FOOT SUPPORT SYSTEMS INCLUDING FLUID MOVEMENT CONTROLLERS AND ADJUSTABLE FOOT SUPPORT PRESSURE

(71) Applicant: NIKE, Inc., Beaverton, OR (US)

(72) Inventors: Stepan Ryabinin, Vancouver, WA (US); Narissa Y. Chang, Portland, OR (US); Rémy Pieron, Portland, OR (US); Adam Vollmer, Portland, OR (US); Michael Allison, Ridgefield, WA (US); Michael Fairchild, Vancouver, WA (US); John Geile, Vancouver, WA (US); Ethan Vella, Lake Oswego, OR (US); Daniel Weeks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 118 days.

(21) Appl. No.: 17/969,515

(22) Filed: Oct. 19, 2022

(65) Prior Publication Data

US 2023/0138485 A1 May 4, 2023

Related U.S. Application Data

(60) Provisional application No. 63/273,640, filed on Oct. 29, 2021.

(51) Int. Cl.
*A43B 13/20* (2006.01)
*A43B 23/02* (2006.01)

(52) U.S. Cl.
CPC ..... *A43B 13/203* (2013.01); *A43B 13/20* (2013.01); *A43B 23/028* (2013.01)

(58) Field of Classification Search
CPC ... A43B 13/203; A61H 9/0078; F16K 27/003; F15B 13/081
See application file for complete search history.

(56) References Cited

U.S. PATENT DOCUMENTS 5,179,792 A 1/1993 Brantingham
5,816,290 A 10/1998 Altshuler
(Continued)

FOREIGN PATENT DOCUMENTS

JP 2005-506862 A 3/2005
JP 5-508783 B2 6/2014
(Continued)

OTHER PUBLICATIONS

Sep. 28, 2021—(WO) ISR & WO—App. No. PCT/US21/034737.
Jan. 16, 2013 (WO)—International Search Report and Written Opinion, App PCT/US2022/078345, 11 pages.

*Primary Examiner* — Khoa D Huynh
*Assistant Examiner* — Grady Alexander Nunnery
(74) *Attorney, Agent, or Firm* — Banner & Witcoff, Ltd.

(57) ABSTRACT

Foot support systems include a first foot support bladder, a fluid tank, and a fluid distributor. The fluid distributor's body may have: (a) first and second solenoid mounts, (b) a main fluid distribution channel in fluid communication with the first and second solenoid mounts, (c) a tank channel in fluid communication with the first solenoid mount, (d) a first foot support bladder channel in fluid communication with the second solenoid mount, (e) a first foot support connector connecting the first foot support bladder with the first foot support bladder channel, and (f) a tank connector connecting the fluid tank with the tank channel. First and second solenoids are engaged with the fluid distributor at the first and second solenoid mounts, respectively. In some examples, the fluid distributor may include a third solenoid mount and a second foot support connector for use with a second foot support bladder.

20 Claims, 32 Drawing Sheets

(56) References Cited

U.S. PATENT DOCUMENTS

| | | | | |
|---|---|---|---|---|
| 7,107,706 | B1 | 9/2006 | Bailey, Sr. et al. | |
| 7,395,614 | B1 | 7/2008 | Bailey, Sr. et al. | |
| 7,396,574 | B2 | 7/2008 | Rudy | |
| 9,510,646 | B2 | 12/2016 | Holt | |
| 11,583,030 | B2 | 2/2023 | Campos, II et al. | |
| 11,666,117 | B2 | 6/2023 | Campos, II et al. | |
| 2009/0095358 | A1 | 4/2009 | Christensen et al. | |
| 2011/0131839 | A1 | 6/2011 | Ballin et al. | |
| 2013/0031806 | A1* | 2/2013 | Slingluff ..... | A43B 5/0441 36/117.1 |
| 2013/0326912 | A1 | 12/2013 | Lindsay et al. | |
| 2014/0165427 | A1 | 6/2014 | Molyneux et al. | |
| 2015/0257482 | A1 | 9/2015 | Molyneux et al. | |
| 2017/0265563 | A1* | 9/2017 | Ma ..... | A61H 9/0078 |
| 2018/0008005 | A1 | 1/2018 | Compton et al. | |
| 2019/0053572 | A1 | 2/2019 | Patton | |
| 2019/0365041 | A1 | 12/2019 | Weast et al. | |
| 2019/0365042 | A1 | 12/2019 | Weast et al. | |
| 2020/0046071 | A1 | 2/2020 | Henrichot et al. | |
| 2020/0170343 | A1 | 6/2020 | Bailly et al. | |
| 2020/0367606 | A1 | 11/2020 | Bailly et al. | |
| 2020/0375310 | A1 | 12/2020 | Weast et al. | |

FOREIGN PATENT DOCUMENTS

| | | | | |
|---|---|---|---|---|
| TW | M323543 | U | 12/2007 | |
| TW | 201927186 | A | 7/2019 | |
| TW | 202128045 | A | 8/2021 | |
| WO | 9119430 | A1 | 12/1991 | |
| WO | WO-2008051164 | A1 * | 5/2008 | ..... A43B 13/203 |

* cited by examiner

FLUID DISTRIBUTORS AND FOOT SUPPORT SYSTEMS INCLUDING FLUID MOVEMENT CONTROLLERS AND ADJUSTABLE FOOT SUPPORT PRESSURE

RELATED APPLICATION DATA

This application is a U.S. Non-Provisional application and claims priority benefits based on U.S. Provisional Patent Appln. No. 63/273,640 filed Oct. 29, 2021 and entitled "Fluid Distributors and Foot Support Systems Including Fluid Movement Controllers and Adjustable Foot Support Pressure." U.S. Provisional Patent Appln. No. 63/273,640 is entirely incorporated herein by reference.

Aspects and features of this technology may be used in conjunction with the systems and methods described in any one or more of:

(a) U.S. Provisional Patent Appln. No. 63/031,395 filed May 28, 2020;
(b) U.S. Provisional Patent Appln. No. 63/031,413 filed May 28, 2020;
(c) U.S. Provisional Patent Appln. No. 63/031,433 filed May 28, 2020;
(d) U.S. Provisional Patent Appln. No. 63/031,444 filed May 28, 2020;
(e) U.S. Provisional Patent Appln. No. 63/031,455 filed May 28, 2020;
(f) U.S. Provisional Patent Appln. No. 63/031,468 filed May 28, 2020;
(g) U.S. Provisional Patent Appln. No. 63/031,482 filed May 28, 2020;
(h) U.S. Provisional Patent Appln. No. 63/031,423 filed May 28, 2020;
(i) U.S. Provisional Patent Appln. No. 63/031,429 filed May 28, 2020;
(j) U.S. Provisional Patent Appln. No. 63/031,441 filed May 28, 2020;
(k) U.S. Provisional Patent Appln. No. 63/031,451 filed May 28, 2020;
(l) U.S. Provisional Patent Appln. No. 63/031,460 filed May 28, 2020;
(m) U.S. Provisional Patent Appln. No. 63/031,471 filed May 28, 2020;
(n) U.S. patent application Ser. No. 17/333,309 filed May 28, 2021;
(o) U.S. patent application Ser. No. 17/333,333 filed May 28, 2021;
(p) U.S. patent application Ser. No. 17/333,493 filed May 28, 2021;
(q) U.S. patent application Ser. No. 17/333,555 filed May 28, 2021;
(r) U.S. patent application Ser. No. 17/333,630 filed May 28, 2021;
(s) U.S. patent application Ser. No. 17/333,683 filed May 28, 2021;
(t) U.S. patent application Ser. No. 17/333,735 filed May 28, 2021;
(u) U.S. patent application Ser. No. 17/333,785 filed May 28, 2021;
(v) U.S. patent application Ser. No. 17/333,867 filed May 28, 2021;
(w) U.S. patent application Ser. No. 17/333,919 filed May 28, 2021;
(x) U.S. patent application Ser. No. 17/333,974 filed May 28, 2021;
(y) U.S. patent application Ser. No. 17/334,015 filed May 28, 2021; and (z) U.S. patent application Ser. No. 17/334,049 filed May 28, 2021.

Each of U.S. Provisional Patent Appln. Nos. 63/031,395, 63/031,413, 63/031,433, 63/031,444, 63/031,455, 63/031,468, 63/031,482, 63/031,423, 63/031,429, 63/031,441, 63/031,451, 63/031,460, and 63/031,471 and each of U.S. patent application Ser. Nos. 17/333,309, 17/333,333, 17/333,493, 17/333,555, 17/333,630, 17/333,683, 17/333,735, 17/333,785, 17/333,867, 17/333,919, 17/333,974, 17/334,015, and 17/334,049 is entirely incorporated herein by reference.

FIELD OF THE INVENTION

The present invention relates to fluid distribution systems and/or foot support systems in the field of footwear or other foot-receiving devices. At least some aspects of the present invention pertain to fluid distributors, fluid transfer systems, sole structures, fluid flow control systems, foot support systems, articles of footwear, and/or other foot-receiving devices that include components (e.g., a manifold, a connector, a fluid transfer system, an electronic controller, etc.) for selectively moving fluid within, into, and/or out of a sole structure (or other foot-supporting member) and/or article of footwear (or other foot-receiving device). Using such systems, fluid pressure (e.g., foot support pressure, fluid container pressure) in one or more fluid-filled bladders (e.g., foot support bladder(s)) and/or in one or more fluid reservoirs and/or containers included in the overall system may be changed and controlled.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces). The upper also may include a heel counter to limit or control movement of the heel.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, etc.), and the like. "Foot-receiving device,"

as that term is used herein, means any device into which a user places at least some portion of his or her foot. In addition to all types of "footwear," foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include: (a) one or more "foot-covering members" (e.g., akin to footwear upper components) that help position the foot with respect to other components or structures, and (b) one or more "foot-supporting members" (e.g., akin to footwear sole structure components) that support at least some portion(s) of a plantar surface of a user's foot. "Foot-supporting members" may include components for and/or functioning as midsoles and/or outsoles for articles of footwear (or components providing corresponding functions in non-footwear type foot-receiving devices).

This application and/or claims use the adjectives, e.g., "first," "second," "third," and the like, to identify certain components and/or features relating to this technology. These adjectives are used merely for convenience, e.g., to assist in maintaining a distinction between components and/or features of a specific structure. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "third" in the specification may correspond to any numerical adjective used for that component or feature in the claims).

A "manifold" as used herein means a component having a surface or housing that defines or supports one or more ports that allow a fluid (e.g., gas or liquid) to enter and/or exit the component. A "port" as used herein means an opening through a component that allows fluid (e.g., gas or liquid) to pass through from one side of the opening to the other. Optionally, a "port" may include a connector structure, e.g., for engaging another object, such as a fluid line, tubing, another connector, or the like. When including a connector structure, a "port" may form, for example, a male connector structure, a female connector structure, or an abutting surface connecting structure. Object(s) connected to a "port" may be fixedly connected or releasably connected. Additionally or alternatively, object(s) connected to a port may be fixed to or releasably connected to interior surfaces of the opening through the wall of the component through which the opening is defined.

BRIEF DESCRIPTION OF THE DRAWINGS

The following Detailed Description will be better understood when considered in conjunction with the accompanying drawings in which like reference numerals refer to the same or similar elements in all of the various views in which that reference number appears.

DETAILED DESCRIPTION

Figure 1A:
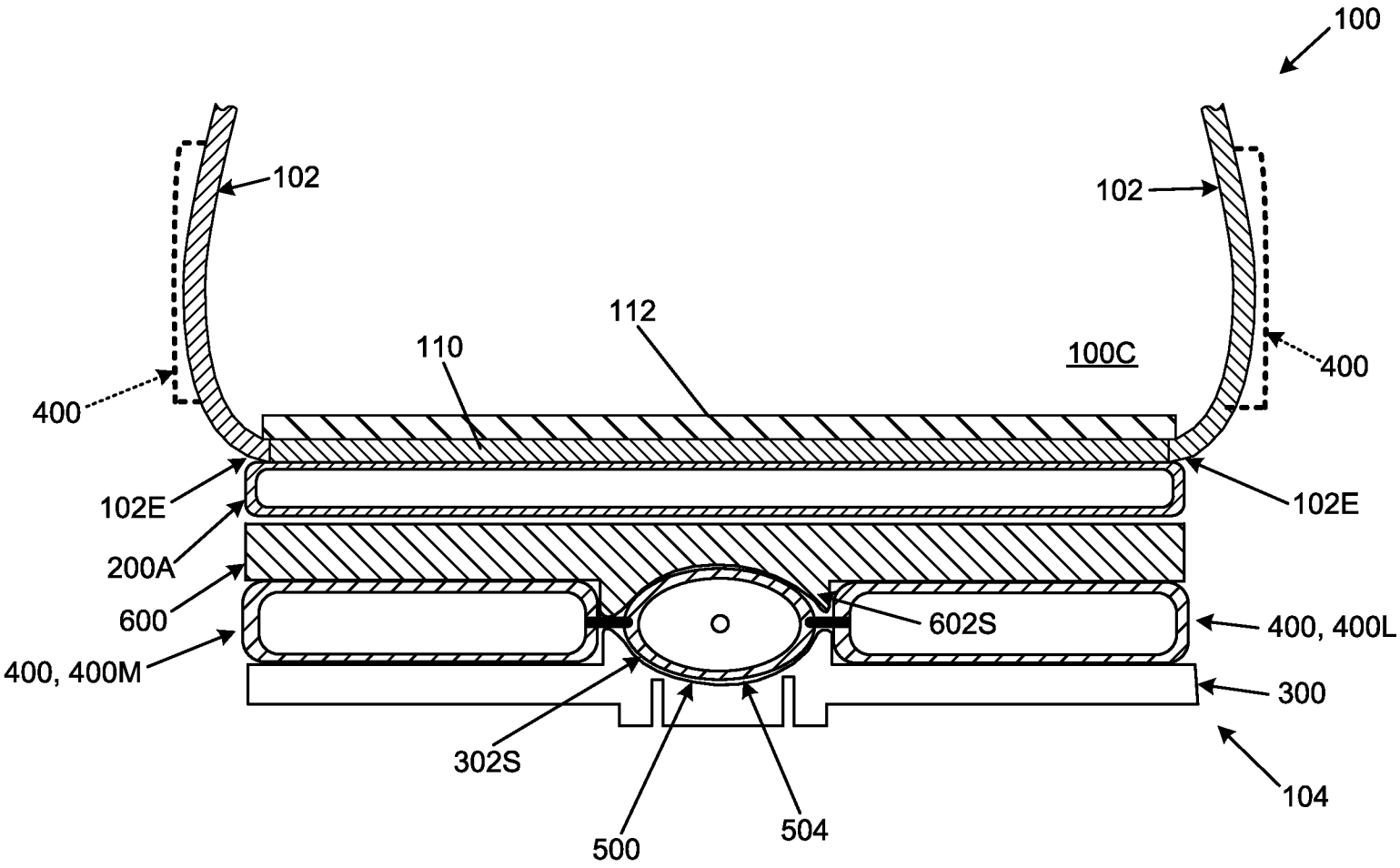
FIGS. 1A and 1B provide various views of foot support systems, sole structures, and articles of footwear (or portions thereof) in accordance with some examples of this technology.

In the following description of various examples of fluid distributors, fluid transfer systems, fluid flow control systems, sole structures, footwear structures, and components thereof according to the present technology, reference is made to the accompanying drawings, which form a part hereof, and in which are shown by way of illustration various example structures and environments in which aspects of this technology may be practiced. It is to be understood that other structures and environments may be utilized and that structural and functional modifications may be made to the specifically described structures, functions, and methods without departing from the scope of the present technology.

I. General Description of Aspects of this Technology

Aspects of this technology relate to fluid distributors, fluid flow control systems, foot support systems, sole structures, articles of footwear, and/or other foot-receiving devices, e.g., of the types described and/or claimed below and/or of the types illustrated in the appended drawings. Such fluid distributors, fluid flow control systems, foot support systems, sole structures, articles of footwear, and/or other foot-receiving devices may include any one or more structures, parts, features, properties, operational states, and/or combination(s) of structures, parts, features, properties, and/or operational states of the examples described and/or claimed below and/or of the examples illustrated in the appended drawings.

Various types of solenoids and/or combinations of solenoids may be used in fluid distributors, fluid flow control systems, foot support systems, sole structures, and/or articles of footwear in accordance with some aspects of this technology. Some solenoids that may be used in accordance with this technology are "latching solenoids." Latching solenoids may include two stable states—an open state and a closed state. Such solenoids can maintain either of these stable states when no power is applied. In the open state, fluid may flow through the solenoid body, e.g., between one port and the other port (in either direction). In the closed state, a spring or other biasing means may close off (e.g., seal) either or both of ports (e.g., by moving a plunger to close the port(s)). In that state, fluid does not flow through the solenoid body.

For latching solenoids, power is required to change the solenoid from one state to the other state (e.g., open to closed or vice versa). The power (e.g., electrical power, battery power, etc.) may initiate movement of the solenoid's plunger and change the solenoid from one state to another state. Typically, a short power pulse is applied to move the plunger of the solenoid from one position to another position. Latching solenoids also typically have a "normal state." The "normal state" is the state the plunger will default to (e.g., due to biasing force on the plunger) when no "latches" are activated to hold the plunger in one of the states.

For two-way latching solenoids (e.g., 2/2 solenoids), the solenoid may be "normally open" (or "NO") in which fluid can flow through the solenoid or "normally closed (or "NC") in which fluid cannot flow through the solenoid. Power may be applied to a normally open solenoid in a relatively short pulse to: (a) move the plunger from the open configuration to the closed configuration and (b) activate the latching mechanism to hold the solenoid in the closed position without continuous use of power. To return this solenoid back to its open configuration, power is applied to release the latch or "unlatch" the plunger in a relatively short pulse and a biasing system (e.g., spring) then returns the plunger to its open configuration. A "normally closed" solenoid works in somewhat the opposite manner. Power may be applied to a normally closed solenoid in a relatively short pulse to: (a) move the plunger from the closed configuration to the open configuration and (b) activate the latching mechanism to hold the solenoid in the open position without continuous use of power. To return this solenoid back to its closed configuration, power is applied to release the latch or "unlatch" the plunger in a relatively short pulse and a biasing system (e.g., spring) then returns the plunger to its closed configuration. In this manner, relatively low amounts of power are consumed to move the latching solenoid between its different configurations and continuous application of power for long periods of time is not needed.

Like latching solenoids, non-latching solenoids also may have one "normal" position (e.g., NO or NC) and one (or more) non-normal positions. Unlike latching solenoids, non-latching solenoids require continued application of power to maintain the valve in one of the two (or more) states. For example, a normally open ("NO") non-latching solenoid valve requires continuous application of power to move and maintain the solenoid in a closed state, but it returns back to the open state when the power is shut down (e.g., under biasing force applied to the plunger). Similarly, a normally closed ("NC") non-latching solenoid valve requires continuous application of power to move and maintain the solenoid in the open state, but it returns back to the closed state when the power is shut down (e.g., under biasing force applied to the plunger). Thus, in use, it can be advantageous from a power consumption and/or battery life point of view to select a normally open non-latching solenoid for applications where the valve only needs to be closed for relatively short time periods and/or to select a normally closed non-latching solenoid for applications where the valve only needs to be open for relatively short time periods.

A. Footwear Component and Article of Footwear Features According to Some Examples of this Technology Some aspects of this technology relate to fluid distributors for foot support systems (e.g., including sole structures, articles of footwear, etc.), comprising:

a first body portion that includes:

(a) a first side having a first solenoid mount and a second solenoid mount, and (b) a second side including a first surface having: (i) a first open channel that defines at least a portion of a main fluid distribution channel of the fluid distributor in the first surface, wherein the first open channel includes a first opening in fluid communication with the first solenoid mount and a second opening in fluid communication with the second solenoid mount, (ii) a second open channel that defines at least a portion of a tank channel of the fluid distributor in the first surface, wherein the second open channel includes a third opening in fluid communication with the first solenoid mount, and (iii) a third open channel that defines at least a portion of a first foot support bladder channel of the fluid distributor in the first surface, wherein the third open channel includes a fourth opening in fluid communication with the second solenoid mount; and a second body portion engaged with the first surface, the second body portion closing the first open channel, the second open channel, and the third open channel at the first surface. Additional open channels may be provided in the first surface, e.g., for one or more additional foot support bladders, for one or more additional tanks, and/or for one or more fluid release channels, etc.

Additional aspects of this technology relate to fluid distributors for foot support systems (e.g., including sole structures, articles of footwear, etc.), comprising:

a first body portion that includes:

(a) a first side having a first solenoid mount and a second solenoid mount, and (b) a second side including a first surface having: (i) a first open channel that defines at least a portion of a main fluid distribution channel of the fluid distributor in the first surface, wherein the first open channel includes a first opening in fluid communication with the first solenoid mount and a second opening in fluid communication with the second solenoid mount, (ii) a second open channel that defines at least a portion of a tank channel of the fluid distributor in the first surface, wherein the second open channel includes a third opening in fluid communication with the first solenoid mount, (iii) a third open channel that defines at least a portion of a first foot support bladder channel of the fluid distributor in the first surface, wherein the third open channel includes a fourth opening in fluid communication with the second solenoid mount, and (iv) a fourth open channel that defines at least a portion of a fluid release channel of the fluid distributor in the first surface, wherein the fourth open channel includes a fifth opening in fluid communication with the first solenoid mount; and a second body portion engaged with the first surface, the second body portion closing the first open channel, the second open channel, the third open channel, and the fourth open channel at the first surface. Additional open channels may be provided in the first surface, e.g., for one or more additional foot support bladders, for one or more additional tanks, and/or for one or more fluid release channels, etc.

Still additional aspects of this technology relate to foot support systems including fluid distributors of the types described above. Such foot support systems may include: (a) a first foot support bladder; (b) a fluid tank (which also may include a fluid-filled bladder); and (c) a fluid distributor, e.g., of the types described above, wherein the first foot support bladder is in fluid communication with the second solenoid mount and the fluid tank is in fluid communication with the first solenoid mount. Still further aspects of this technology relate to articles of footwear including such foot support systems engaged with one or both of the sole structure and/or upper of the article of footwear.

Additional aspects of this technology relate to fluid distributors for foot support systems (e.g., including sole structures, articles of footwear, etc.), comprising:

a first body portion that includes:

(a) a first side having a first solenoid mount and a second solenoid mount, and (b) a second side including a first surface having: (i) a first open channel that defines at least a portion of a main fluid distribution channel of the fluid distributor in the first surface, wherein the first open channel includes a first opening in fluid communication with the first solenoid mount and a second opening in fluid communication with the second solenoid mount, (ii) a second open channel that defines at least a portion of a first foot support bladder channel of the fluid distributor in the first surface, wherein the second open channel includes a third opening in fluid communication with the second solenoid mount, and (iv) a third open channel that defines at least a portion of a fluid release channel of the fluid distributor in the first surface, wherein the third open channel includes a fourth opening in fluid communication with the first solenoid mount; and a second body portion engaged with the first surface, the second body portion closing the first open channel, the second open channel, and the third open channel at the first surface. Additional open channels may be provided in the first surface, e.g., for one or more additional foot support bladders, for one or more additional tanks, and/or for one or more fluid release channels, etc. Fluid distributors of these types further may be included as part of a foot support system that includes: (a) a first foot support bladder; and (b) a fluid distributor as described above, wherein the first foot support bladder is in fluid communication with the second solenoid mount. Still further aspects of this technology relate to articles of footwear including such foot support systems engaged with one or both of the sole structure and/or upper of the article of footwear.

Foot support systems in accordance with still additional aspects of this technology comprise:

a first foot support bladder;

a fluid tank;

a fluid distributor that includes a distributor body having: (a) a first solenoid mount, (b) a second solenoid mount, (c) a main fluid distribution channel in fluid communication with the first solenoid mount and in fluid communication with the second solenoid mount, (d) a tank channel in fluid communication with the first solenoid mount, (e) a first foot support bladder channel in fluid communication with the second solenoid mount, (f) a first foot support connector connecting the first foot support bladder with the first foot support bladder channel, and (g) a tank connector connecting the fluid tank with the tank channel;

a first solenoid engaged with the fluid distributor at the first solenoid mount; and a second solenoid engaged with the fluid distributor at the second solenoid mount.

Yet additional aspects of this technology relate to foot support systems that include:

a first foot support bladder;

a fluid tank;

a fluid distributor that includes: a distributor body having: (a) a first solenoid mount, (b) a second solenoid mount, (c) a main fluid distribution channel in fluid communication with the first solenoid mount and in fluid communication with the second solenoid mount, (d) a tank channel in fluid communication with the first solenoid mount, (e) a first foot support bladder channel in fluid communication with the second solenoid mount, (f) a first foot support connector connecting the first foot support bladder with the first foot support bladder channel, (g) a tank connector connecting the fluid tank with the tank channel, and (h) a fluid source connector that receives fluid from a fluid source and supplies the fluid to the main fluid distribution channel;

a first solenoid engaged with the fluid distributor at the first solenoid mount; and a second solenoid engaged with the fluid distributor at the second solenoid mount.

The foot support systems described above also may be incorporated into an article of footwear in accordance with at least some aspects of this technology. Such articles of footwear may include: (a) an upper; (b) a sole structure; and (c) a foot support system according to any of the aspects described above engaged with one or both of the upper or the sole structure.

Fluid distributors, foot support systems, and/or articles of footwear of the types described above also may include additional features, such as: one or more fluid supply inlets (e.g., including one or more filters to filter incoming fluid);

one or more pumps (e.g., one or more foot-activated pumps), compressors, or other fluid sources; one or more additional solenoid mounts; one or more additional solenoids; one or more additional foot support bladders; one or more additional connectors; one or more additional fluid channels in the fluid distributor in fluid communication with the pump(s), solenoid(s), bladder(s), connector(s), etc.; etc. The fluid distributors and/or the channels provided therein may be made from two or more parts (e.g., two or more fluid distributor body parts) in accordance with at least some examples of this technology. Still additional aspects of this technology relate to one or more of the operational states, methods of moving fluid, and/or the fluid flow pathways (or portions thereof) for the systems described above and/or those described in more detail below.

Given the general description of features, examples, aspects, structures, processes, and arrangements according to examples of this technology and this invention provided above, a more detailed description of specific example fluid transfer systems, fluid flow control systems, foot support systems, sole structures, articles of footwear, and methods in accordance with this technology follows.

II. Detailed Description of Example Articles of Footwear, Foot Support Systems, and Other Components and/or Features According to this Technology Referring to the figures and following discussion, various examples of foot support systems, fluid flow control systems, sole structures, and articles of footwear in accordance with aspects of this technology are described. Aspects of this technology may be used, for example, in conjunction with foot support systems, articles of footwear (or other foot-receiving devices), and/or methods described in the U.S. patent applications noted above.

Foot support systems and footwear structures that include one or more foot support bladders are described, for example, in one or more of: (a) U.S. Provisional Patent Appln. No. 62/463,859 filed Feb. 27, 2017; (b) U.S. Provisional Patent Appln. No. 62/463,892 filed Feb. 27, 2017; (c) U.S. Provisional Patent Appln. No. 62/547,941 filed Aug. 21, 2017; (d) U.S. Provisional Patent Appln. No. 62/678,635 filed May 31, 2018; (e) U.S. Provisional Patent Appln. No. 62/678,662 filed May 31, 2018; (f) U.S. Provisional Patent Appln. No. 62/772,786 filed Nov. 29, 2018; (g) U.S. Provisional Patent Appln. No. 62/850,140 filed May 20, 2019; (h) U.S. patent application Ser. No. 16/488,623 filed Aug. 26, 2019; (i) U.S. patent application Ser. No. 16/488,626 filed Aug. 26, 2019; (j) U.S. patent application Ser. No. 16/105,170 filed Aug. 20, 2018; (k) U.S. patent application Ser. No. 16/425,331 filed May 29, 2019; (l) U.S. patent application Ser. No. 16/425,356 filed May 29, 2018; (m) U.S. patent application Ser. No. 16/698,138 filed Nov. 27, 2019; and (n) U.S. patent application Ser. No. 16/878,342 filed May 19, 2020, as well as in the patent applications identified in the "Related Application Data" section above. Many of these patent applications further describe foot support systems and footwear structures that include fluid reservoirs (also called "fluid tanks" and/or "fluid containers" herein), e.g., that supply fluid to and/or accept fluid from one or more foot support bladders to enable pressure changes in the foot support bladder(s). Each of U.S. Provisional Patent Appln. Nos. 62/463,859, 62/463,892, 62/547,941, 62/678,635, 62/678,662, 62/772,786, 62/850,140, U.S patent application Ser. Nos. 16/488,623, 16/488,626, 16/105,170, 16/425,331, 16/425,356, 16/698,138, and 16/878,342 is entirely incorporated herein by reference.

FIG. 1A provides a cross sectional view of an example article of footwear 100 in accordance with some examples of this technology to show example parts and potential arrangement of parts. As shown in FIG. 1A, the article of footwear 100 includes an upper 102 and a sole structure 104 engaged with the upper 102. The bottom ends 102E of the upper 102 are engaged with (e.g., sewn to) a strobel member 110, which closes off the bottom of the upper 102 (the strobel 110 may be considered part of the upper 102 in at least some examples of this technology). The upper 102 and/or strobel member 110 may be attached to the sole structure 104 in any desired manner, e.g., including in conventional manners as are known and used in the art, such as by adhesives, by mechanical connectors, by stitching, etc.

The upper 102 and strobel 110 (if present) and/or sole structure define an interior chamber 100C for receiving a wearer's foot. In this illustrated example, a sock liner 112 (or insole member) is included within the interior chamber 100C to support at least a portion of a plantar surface of a wearer's foot. The footwear 100 (e.g., the upper 102) also may include a closure system (e.g., laces, straps, buckles, etc.), e.g., of any type generally known and used in the footwear arts.

The example footwear 100 structure shown in FIG. 1A includes: (a) at least one foot support bladder 200A (one shown in FIG. 1A) for supporting at least a portion of a wearer's foot and (b) at least one fluid reservoir or fluid tank 400, which also may constitute a fluid-filled bladder. In the example of FIG. 1A, the fluid tank 400 comprises two fluid chambers 400M and 400L—one on the medial side (400M) and one on the lateral side (400L). These fluid chambers 400M and 400L may be maintained in fluid communication with one another (e.g., at the same pressure) or they may be isolated (or capable of being isolated) from one another (e.g., and capable of being at different pressures). Additionally or alternatively, if desired, at least a portion of a fluid tank 400 may be engaged with the upper 102 (e.g., as shown in broken lines in FIG. 1A).

FIG. 1A further shows that the sole structure 104 of this example includes a midsole component 600 and an outsole component 300. A foot-activated pump 500 (e.g., a bulb pump) is provided in a space defined between the midsole component 600 and the outsole component 300 (e.g., a compressible bulb 504 of the pump 500 may be located between bottom surface 602S of the midsole component 600 and top surface 302S of outsole component 300. While not a requirement, in the illustrated example of FIG. 1A, at least some portions of the fluid tank 400 also are located between the midsole component 600 and the outsole component 300 (and on opposite sides of pump 500). In use, compression of the compressible bulb 504 of the pump 500 (e.g., when a wearer lands a step or jump) moves the fluid from inside the bulb 504 to the foot support bladder 200A and/or the fluid tank 400. The manner in which fluid may move and the fluid paths followed in examples of this technology are described in more detail below.

Figure 1B:
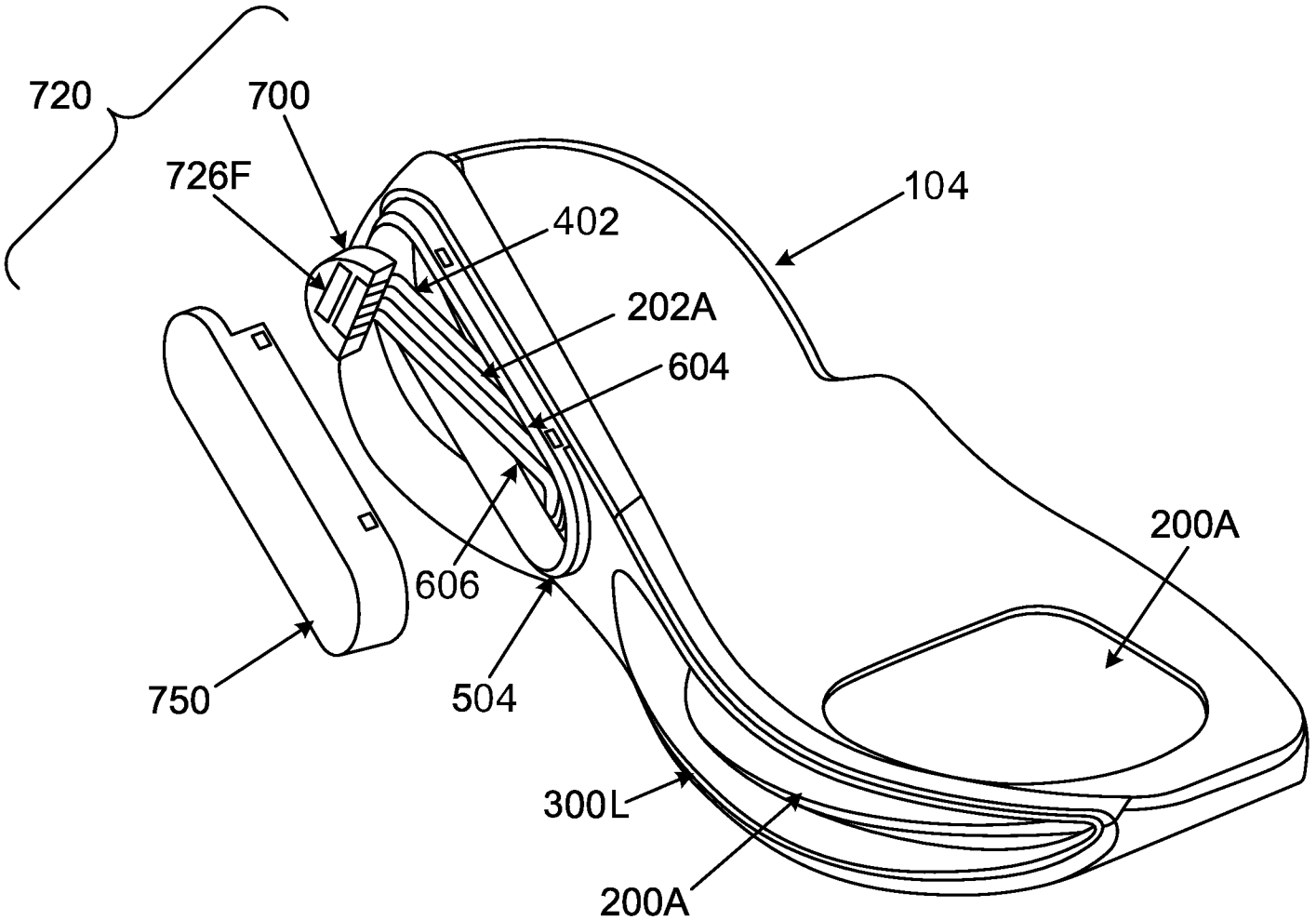

FIG. 1B shows a footwear sole structure 104 that includes a multi-part fluid distributor 720 (e.g., note part 700 (e.g., which may contain a fluid distributing manifold) and part 750 (which may contain one or more solenoids that control the fluid paths in the manifold (part 700) that receive fluid) in accordance with at least some examples of this technology. Fluid distributor part 700 of this illustrated example includes four connectors that connect to fluid lines 202A, 402, 604, and 606. Fluid line 202A connects between the foot support bladder 200A and the fluid distributor 720. Fluid line 402 connects between the fluid tank 400 (not shown in FIG. 1B, but may be located at least in the heel region of the sole member 104 and/or engaged with the upper 102) and the fluid distributor 720. Fluid line 604 moves fluid from a fluid supply inlet (e.g., from the ambient environment), which may be included in the fluid distributor 720 (see fluid filter 726F in FIG. 1B), to the pump(s) 500 (not shown in FIG. 1B, but may be located in the toe region and/or heel region of the sole structure 104)). Fluid line 606 moves fluid from the pump(s) 500 back to the fluid distributor 720, e.g., for selective distribution to other footwear parts (e.g., to one or more of a foot support bladder 200A, a fluid tank 400, back to the ambient environment, etc.). Another fluid line and connector may be provided, e.g., to accommodate movement of fluid into and out of a second foot support bladder or a second fluid tank. See FIGS. 3A-3E, described in more detail below. The fluid lines 202A, 402, 604, and 606 may constitute flexible plastic tubes that engage with connectors provided as part of the connector part 700, as also will described in more detail below. While other arrangements are possible, in this example, the fluid lines 202A, 402, 604, and 606 bring the fluid through the footwear structure to a housing 504 located on a lateral side 300L area at the heel region of the sole structure 104. The housing 504 engages the fluid distributor 720 parts 700, 750, to connect the fluid distributor 720 to the article of footwear 100 and/or sole structure 104.

Some examples of this technology will include one or more solenoids as part of the fluid distributor 720 (e.g., included in fluid distributor part 750 in FIG. 1B). Some examples of such solenoid based systems are described in the applications listed in the Related Application Data section noted above. FIGS. 2A-2F schematically illustrate movement of fluid in various operational states or modes of foot support systems and articles of footwear that include: (a) two independent foot support bladders 200A, 200B (e.g., a heel support bladder and a forefoot support bladder; a medial side bladder and a lateral side bladder; etc.), (b) a pump 500 (e.g., one or more foot-activated pumps), and (c) a fluid tank 400 (or reservoir) (e.g., one or more fluid-filled bladders included with the footwear upper 102 and/or sole structure 104). Information relating to these operational states will assist in understanding the component parts of the fluid distributor 720, foot support systems, and articles of footwear according to this technology, as described in more detail below.

The example foot support system 1000 of FIGS. 2A-2F includes three solenoids: (a) a first solenoid 4900A including a first port 4910A, a second port 4910B, and a third port 4910C; (b) a second solenoid 4900B including a first port 4912A and a second port 4912B; and (c) a third solenoid 4900C including a first port 4914A and a second port 4914B. The first ports 4910A, 4912A, 4914A of solenoids 4900A, 4900B, 4900C respectively, are in fluid communication with a main fluid distribution channel 4920. Thus, main fluid distribution channel 4920 also places the first ports 4910A, 4912A, 4914A of the solenoids 4900A, 4900B, 4900C in fluid communication with one another (at least under some conditions). Additionally, the main fluid distribution channel 4920 also is in fluid communication with fluid line 606 from the fluid source (e.g., pump 500, a compressor, the external environment 150, through a filtered fluid supply inlet 732, etc.). In this example, the first solenoid 4900A is a latching three port, two state solenoid (a 3/2 solenoid) and the second and third solenoids 4900B and 4900C are normally closed non-latching solenoids (a 2/2 solenoid), although other specific types of solenoids (e.g., latching 2/2 solenoids) may be used, if desired.

In this illustrated example (and as will be described in more detail below), the first solenoid 4900A is independently switchable to: (a) a first configuration in which fluid flows through the first solenoid 4900A between the first port 4910A and the second port 4910B and (b) a second configuration in which fluid flows through the first solenoid 4900A between the first port 4910A and the third port 4910C (in either direction). Thus, in this example, first port 4910A and first solenoid 4900A always remain open and the plunger 4910P moves between: (a) one position in which second port 4910B is open and third port 4910C is closed and (b) another position in which second port 4910B is closed and third port 4910C is open. The first solenoid 4900A in the illustrated example is biased to "normally" be in the first configuration (with the biasing system (e.g., a spring applying force to plunger 4910P) closing third port 4910C). The second solenoid 4900B of this example is independently switchable between an open configuration (in which fluid flows through solenoid 4900B between the first port 4912A and the second port 4912B in either direction) and a closed configuration (in which fluid does not flow through solenoid 4900B). Similarly, the third solenoid 4900C of this example is independently switchable between an open configuration (in which fluid flows through solenoid 4900C between the first port 4914A and the second port 4914B in either direction) and a closed configuration (in which fluid does not flow through solenoid 4900C). In this foot support system 1000, simultaneous selective placement of: (a) the first solenoid 4900A in one of the first configuration or the second configuration, (b) the second solenoid 4900B in one of the open configuration or the closed configuration, and (c) the third solenoid 4900C in one of the open configuration or the closed configuration selectively places this foot support system 1000 in a plurality of (e.g., two or more) operational states. Examples of these operational states are described in more detail below.

Figure 2A:
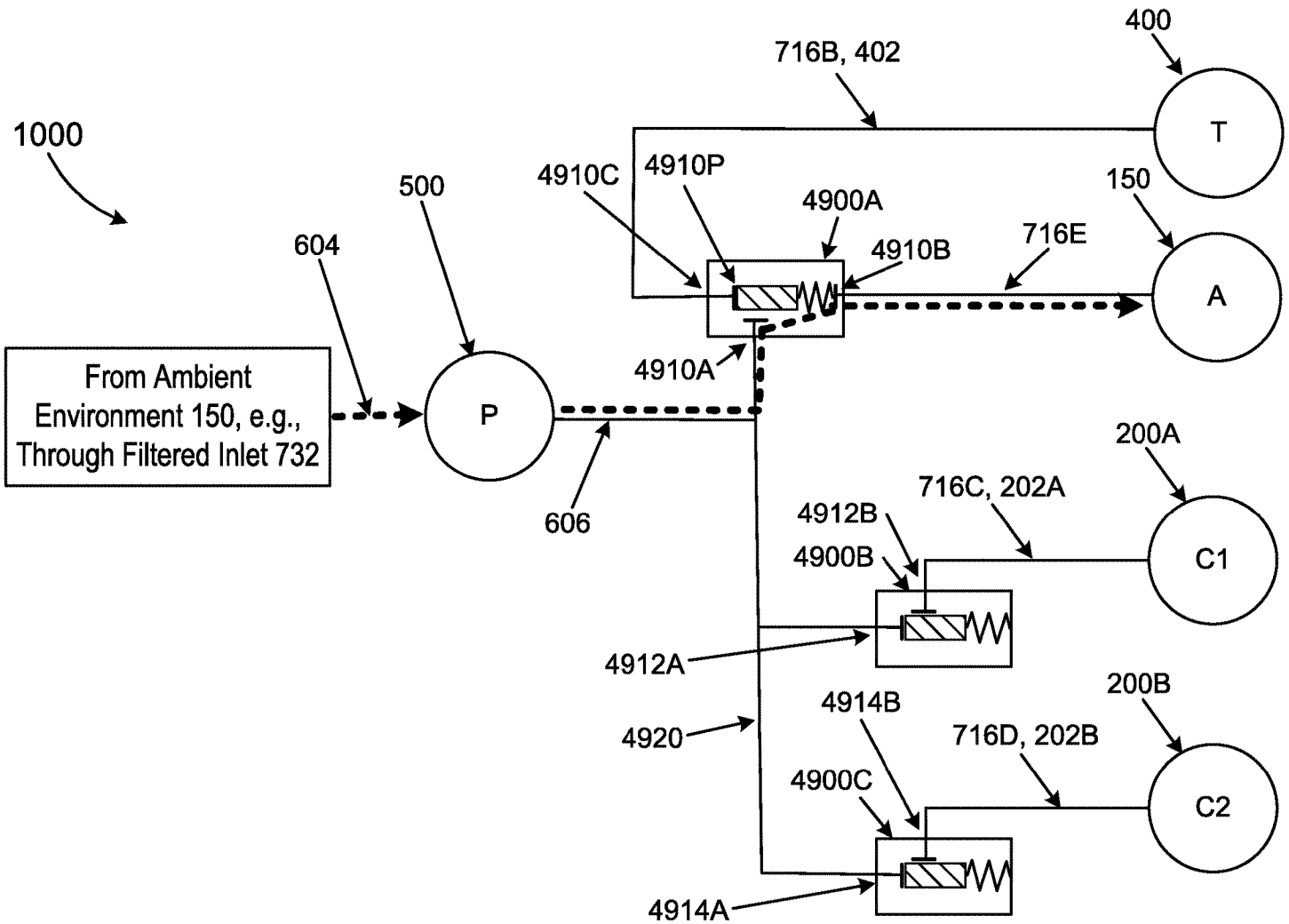
FIGS. 2A-2F provide schematic views of different operational states for fluid distributors, fluid transfer systems, sole structures, fluid flow control systems, foot support systems, and/or articles of footwear in accordance with some aspects of this technology.

FIGS. 2A-2F provide schematic views of the solenoid based foot support system 1000 placed in six operational states. FIG. 2A shows an operational state in which fluid moves from the external environment 150 (e.g., through filtered fluid inlet 732) and is discharged back to the external environment 150. The fluid flow in this operational state (as well as the fluid flow in the operational states of FIGS. 2B-2F) is shown by the thick, arrowed, broken lines in FIG. 2A. This operational state may be used as a "standby" or "steady state" operational state to keep the pumped fluid (e.g., moved by a foot-activated pump 500) moving through the foot support system 1000 and the fluid distributor 720 even when no pressure changes are needed to the foot support bladders 200A, 200B and/or the fluid container 400. In this operational state, incoming fluid from the external environment 150 (e.g., air) moves from the fluid supply inlet 732 of the fluid distributor 720, through fluid line 604 (and thus out of the fluid distributor 720), through pump 500, through fluid line 606, back into the fluid distributor 720, through main fluid distribution channel 4920, through the first port 4910A of the first solenoid 4900A, through the first solenoid 4900A, through second port 4910B of the first solenoid 4900A, into the fluid release fluid channel 716E, and to its ultimate destination (the external environment 150 in this example). Additional details of fluid flow in this operational state are described below in conjunction with FIGS. 4-5F.

Alternatively, in some examples of this technology, in this operational state, rather than continuously moving fluid through the fluid distributor 720 with each step when it is simply going to be discharged back into the external environment 150, a fluid path could be provided from the pump 500 directly to the external environment 150. As another option, pump 500 could be deactivated to accomplish this operational state.

Figure 2B:
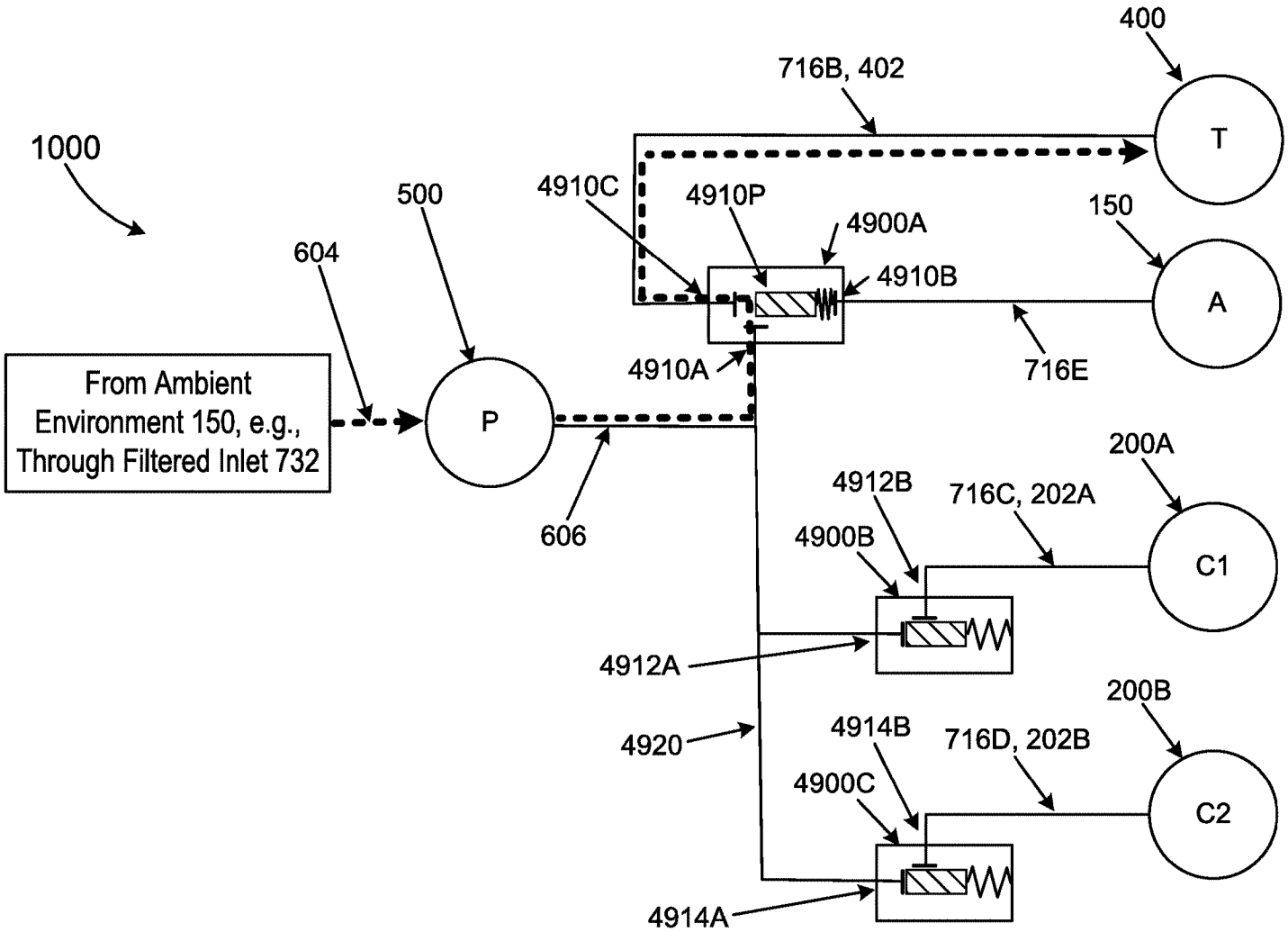

FIG. 2B shows an example operational state for adding fluid to the fluid container 400 (e.g., to increase fluid volume and/or pressure in the fluid container 400). In this second operational state, the first solenoid 4900A is in the second configuration and the second solenoid 4900B and the third solenoid 4900C are in the closed configuration. Thus, fluid flows from the air inlet 732 of the fluid distributor 720, through fluid line 604 (and thus out of the fluid distributor 720), through pump 500, through fluid line 606, back into the fluid distributor 720, through main fluid distribution channel 4920, through the first port 4910A of the first solenoid 4900A, through the first solenoid 4900A, through third port 4910C of the first solenoid 4900A, through tank channel 716B, through fluid line 402, and to its ultimate destination (the fluid container 400 in this example). Additional details of fluid flow in this operational state are described below in conjunction with FIGS. 4, 5A, and 6A-6C.

Figure 2C:
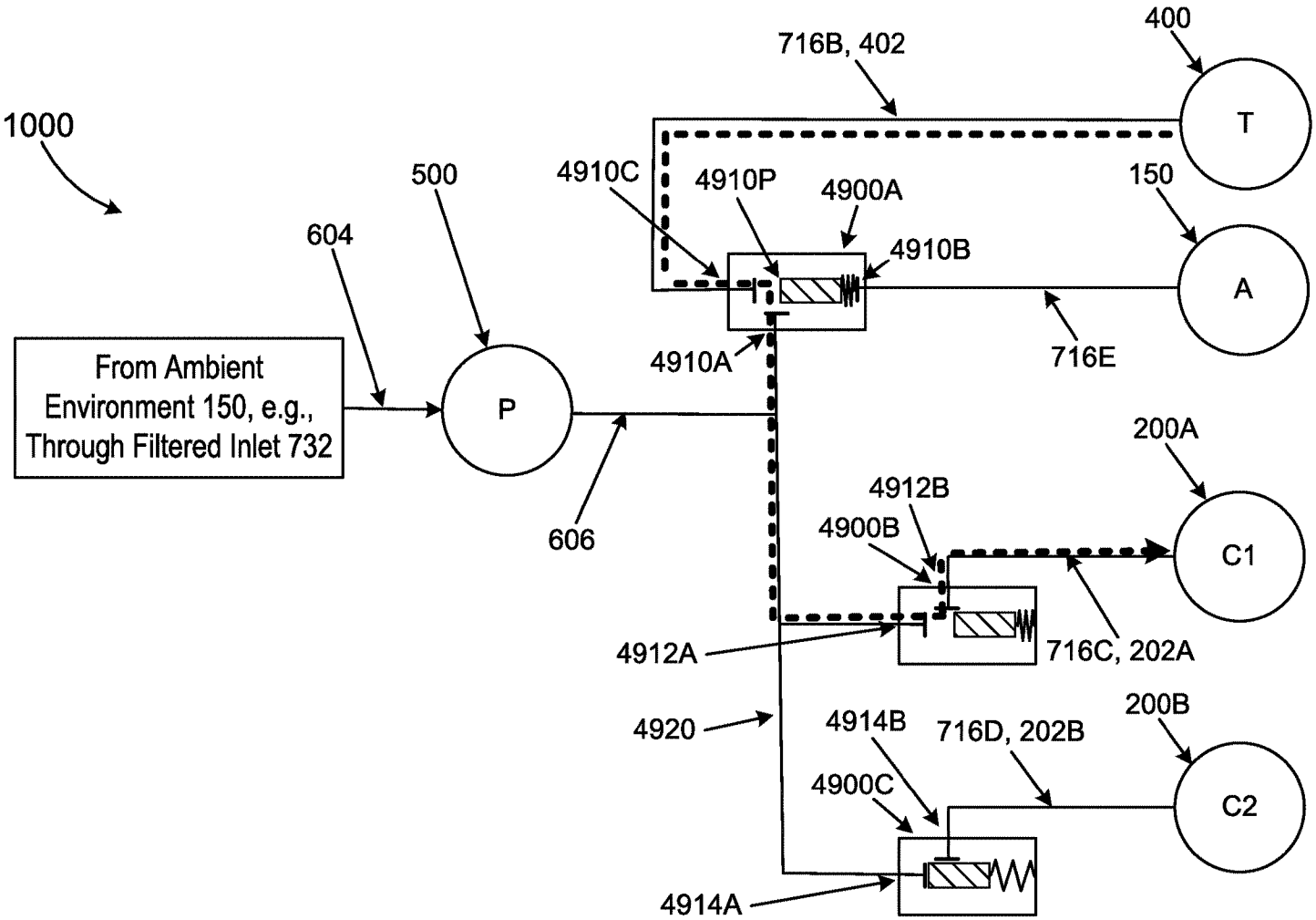

In this example foot support system 1000, the fluid container 400 is used to adjust (and in this example, increase) fluid pressure in the foot support bladders 200A and 200B. An example of an operational state for increasing pressure in first foot support bladder 200A is shown in FIG. 2C. In this third operational state, first solenoid 4900A is in the second configuration, the second solenoid 4900B is in the open configuration, and the third solenoid 4900C is in the closed configuration. Thus, when the fluid container 400 pressure is higher than the foot support bladder 200A pressure, fluid flows from the fluid container 400, through fluid line 402 and tank channel 716B, through the third port 4910C of the first solenoid 4900A, through the first solenoid 4900A, through the first port 4910A of the first solenoid 4900A, through the main fluid distribution channel 4920, through the first port 4912A of the second solenoid 4900B, through the second solenoid 4900B, through second port 4912B of the second solenoid 4900B, through first foot support bladder channel 716C and fluid line 202A, and to its ultimate destination (the foot support bladder 200A in this example). A check valve (or other appropriate valve or switching mechanism) may be provided in fluid line 606, pump 500, and/or fluid line 604, e.g., to prevent fluid flow into these lines and to allow fluid to flow to second solenoid 4900B. Additional details of fluid flow in this operational state are described below in conjunction with FIGS. 7A-7F.

Figure 2D:
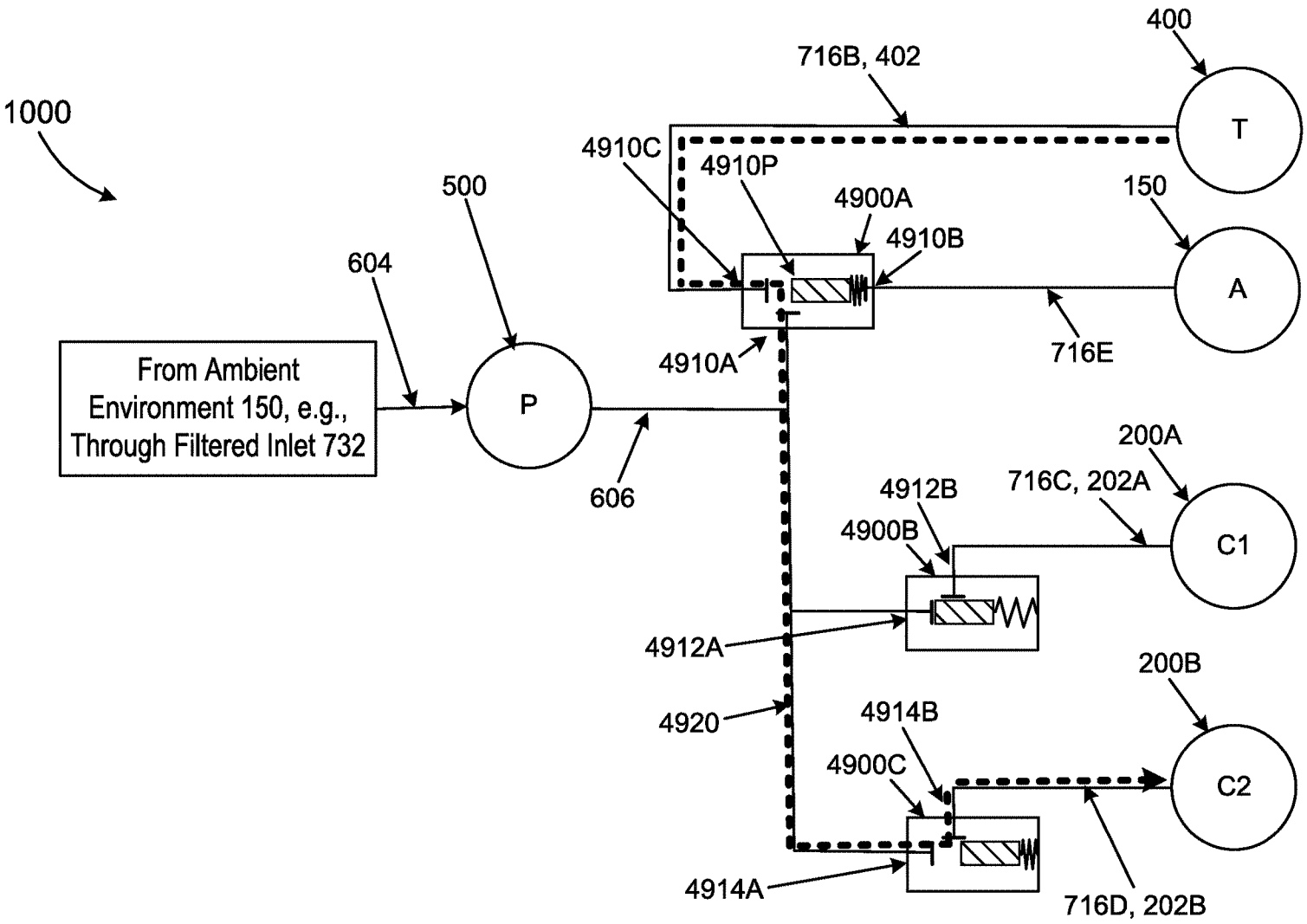

Additionally, in this example foot support system 1000, the fluid container 400 is used to adjust (and in this example, increase) fluid pressure in the foot support bladder 200B. An example of an operational state for increasing pressure in second foot support bladder 200B is shown in FIG. 2D. In this fourth operational state, first solenoid 4900A is in the second configuration, the second solenoid 4900B is in the closed configuration, and the third solenoid 4900C is in the open configuration. Thus, when the fluid container 400 pressure is higher than the foot support bladder 200A pressure, fluid flows from the fluid container 400, through the fluid line 402 and tank channel 716B, through the third port 4910C of the first solenoid 4900A, through the first solenoid 4900A, through the first port 4910A of the first solenoid 4900A, through the main fluid distribution channel 4920, through the first port 4914A of the third solenoid 4900C, through the third solenoid 4900C, through second port 4914B of the third solenoid 4900C, through second foot support bladder channel 716D and fluid line 202B, and to its ultimate destination (the foot support bladder 200B in this example). A check valve (or other appropriate valve or switching mechanism) may be provided in fluid line 606, pump 500, and/or fluid line 604, e.g., to prevent fluid flow into these lines and to allow fluid to flow to third solenoid 4900C. Additional details of fluid flow in this operational state are described below in conjunction with FIGS. 8A-8F.

Figure 2E:
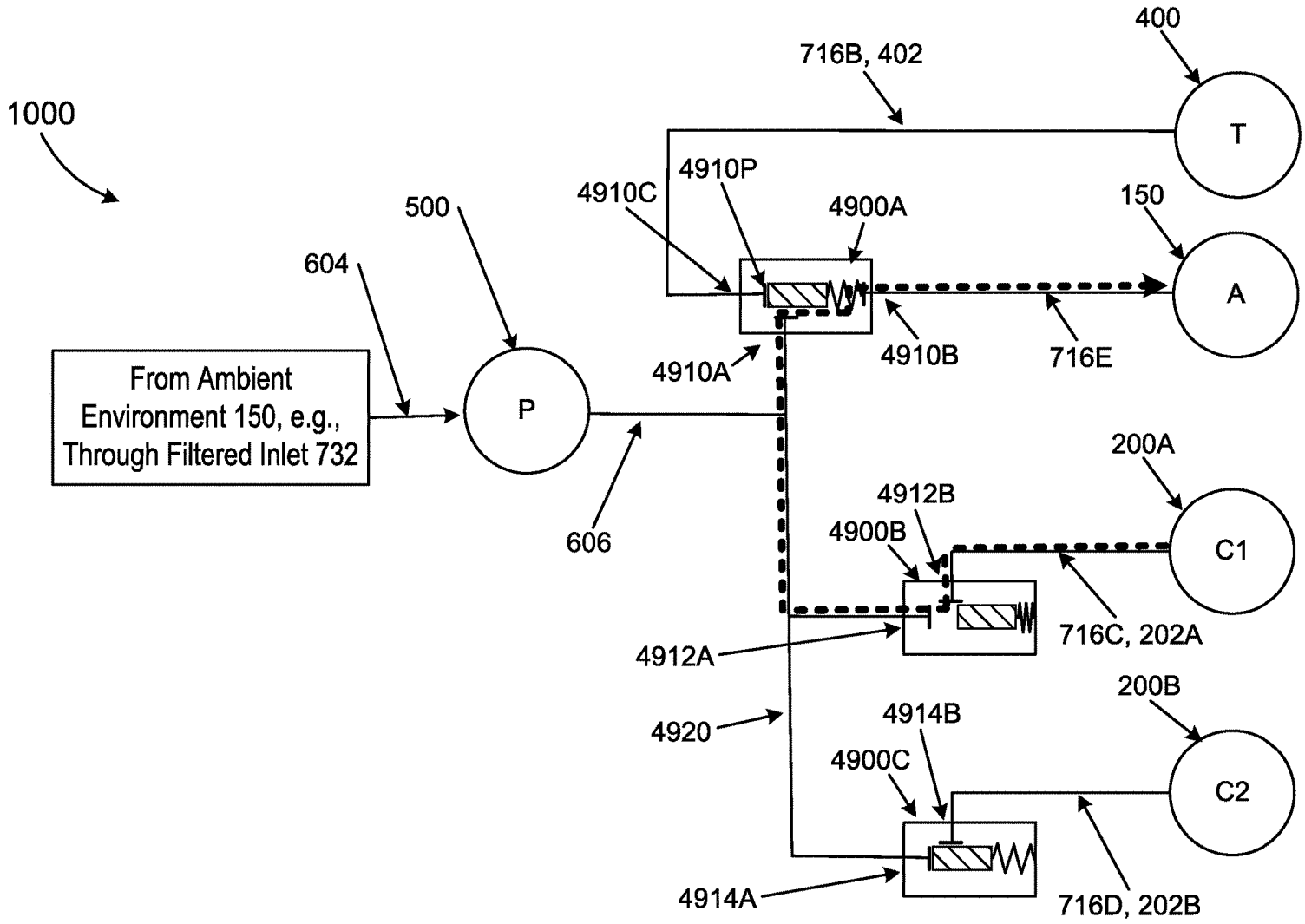

In some instances, it may be desired to remove fluid from the foot support bladder 200A in order to decrease pressure in the foot support bladder 200A (e.g., to provide a softer feel or for less intense activities, such as walking or casual wear). FIG. 2E shows an example of this operational state. In this fifth operational state, the first solenoid 4900A is in the first configuration, the second solenoid 4900B is in the open configuration, and the third solenoid 4900C is in the closed configuration. Thus, fluid flows from the foot support bladder 200A, through fluid line 202A and first foot support bladder channel 716C, through the second port 4912B of the second solenoid 4900B, through the second solenoid 4900B, through the first port 4912A of the second solenoid 4900B, through the main fluid distribution channel 4920, through the first port 4910A of the first solenoid 4900A, through the first solenoid 4900A, through the second port 4910B of the first solenoid 4900A, through fluid release channel 716E, and to its ultimate destination (the external environment 150 in this example). A check valve (or other appropriate valve or switching mechanism) may be provided in fluid line 606, pump 500, and/or fluid line 604, e.g., to prevent fluid flow into these lines and to allow fluid to flow to first solenoid 4900A. Additional details of fluid flow in this operational state are described below in conjunction with FIGS. 9A-9H.

Figure 2F:
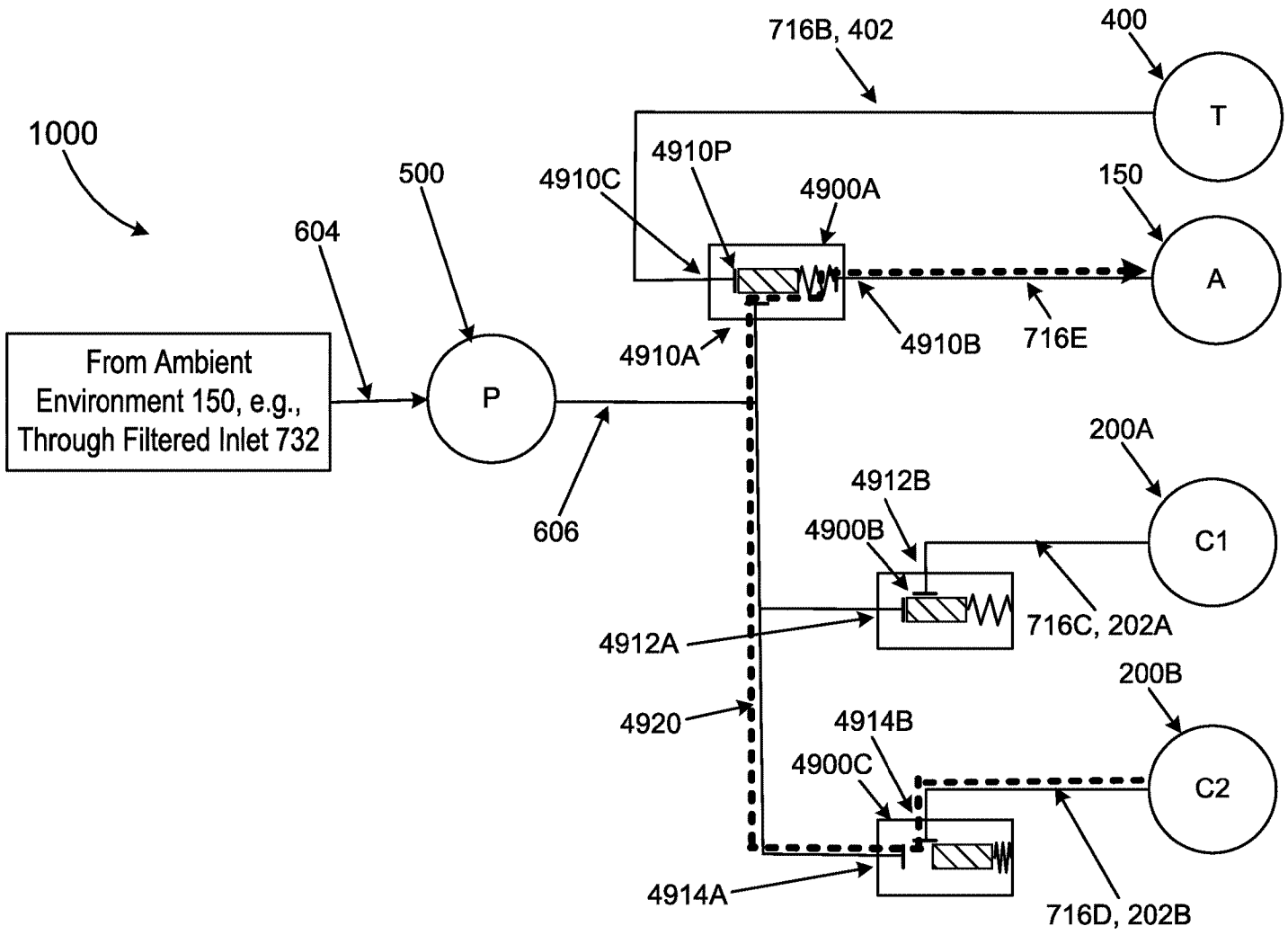

Also, in some instances, it may be desired to remove fluid from the foot support bladder 200B in order to decrease pressure in the foot support bladder 200B (e.g., to provide a softer feel or for less intense activities, such as walking or casual wear). FIG. 2F shows an example of this operational state. In this sixth operational state, the first solenoid 4900A is in the first configuration, the second solenoid 4900B is in the closed configuration, and the third solenoid 4900C is in the open configuration. Thus, fluid flows from the foot support bladder 200B, through fluid line 202B and second foot support bladder channel 716D, through the second port 4914B of the third solenoid 4900C, through the third solenoid 4900C, through the first port 4914A of the third solenoid 4900C, through the main fluid distribution channel 4920, through the first port 4910A of the first solenoid 4900A, through the first solenoid 4900A, through the second port 4910B of the first solenoid 4900A, through fluid release channel 716E, and to its ultimate destination (the external environment 150 in this example). A check valve (or other appropriate valve or switching mechanism) may be provided in fluid line 606, pump 500, and/or fluid line 604, e.g., to prevent fluid flow into these lines and to allow fluid to flow to first solenoid 4900A. Additional details of fluid flow in this operational state are described below in conjunction with FIGS. 10A-10H.

This example foot support system 1000 of FIGS. 2A-2F does not have an operational state in which fluid moves into the fluid distributor 720 from the external environment 150 and is transferred directly into a foot support bladder 200A, 200B. Rather, in the foot support system 1000 of FIGS. 2A-2F, fluid pressure is increased in the foot support bladders 200A, 200B only by fluid transfer from the fluid container 400 to the foot support bladder 200A, 200B (as shown by the operational state of FIGS. 2C and 2D). Further, this example foot support system 1000 of FIGS. 2A-2F does not have an operational state in which fluid moves from the fluid container 400 directly to the external environment 150 (e.g., to deflate container 400). Rather, deflation of container 400 can be accomplished, for example, by moving fluid from the container to one of the foot support bladders 200A, 200B (FIGS. 2C and 2D) and then moving fluid from the bladder 200A, 200B to the external environment 150 (FIGS. 2E and 2F). If necessary or desired, fluid container 400 may include a check valve or a pressure relief valve ("PRV") that opens to the external environment 150 to prevent over-pressurization of the fluid container 400 (rather than having excess fluid from container 400 passing through fluid distributor 720 to reduce pressure in the fluid container 400). Additionally or alternatively, if fluid pressure from the fluid source (e.g., fluid pressure generated by one or more foot activated pumps 500) is insufficient or below the fluid pressure in open fluid pathways to the fluid container 400, fluid will not transfer from the source to the fluid container 400. Still additionally or alternatively, other pressure relief valves and/or fluid pathways may be provided at one or more locations in the overall fluid distributor 720, fluid flow control system, foot support system 1000, sole structure 104, and/or article of footwear 100 to prevent over-pressurization of any part of the systems (e.g., to relieve pressure from fluid discharged by pump(s) 500 if there is no other place for the fluid to go without causing damage).

An additional solenoid (e.g., 2/2 non-latching solenoid) and appropriate structures and operational states may be provided for any additional foot support bladders beyond bladders 200A and 200B shown in FIGS. 2A-2F and discussed above.

In view of this background information, FIGS. 3A-3E provide various views of components making up a fluid distributor 720 in accordance with some examples of this technology, and FIGS. 4-10H provide various views of fluid paths through these components to provide the various operational states described above in conjunction with FIGS. 2A-2F. The fluid paths are shown in FIGS. 4-10H as thick broken lines.

Figure 3A:
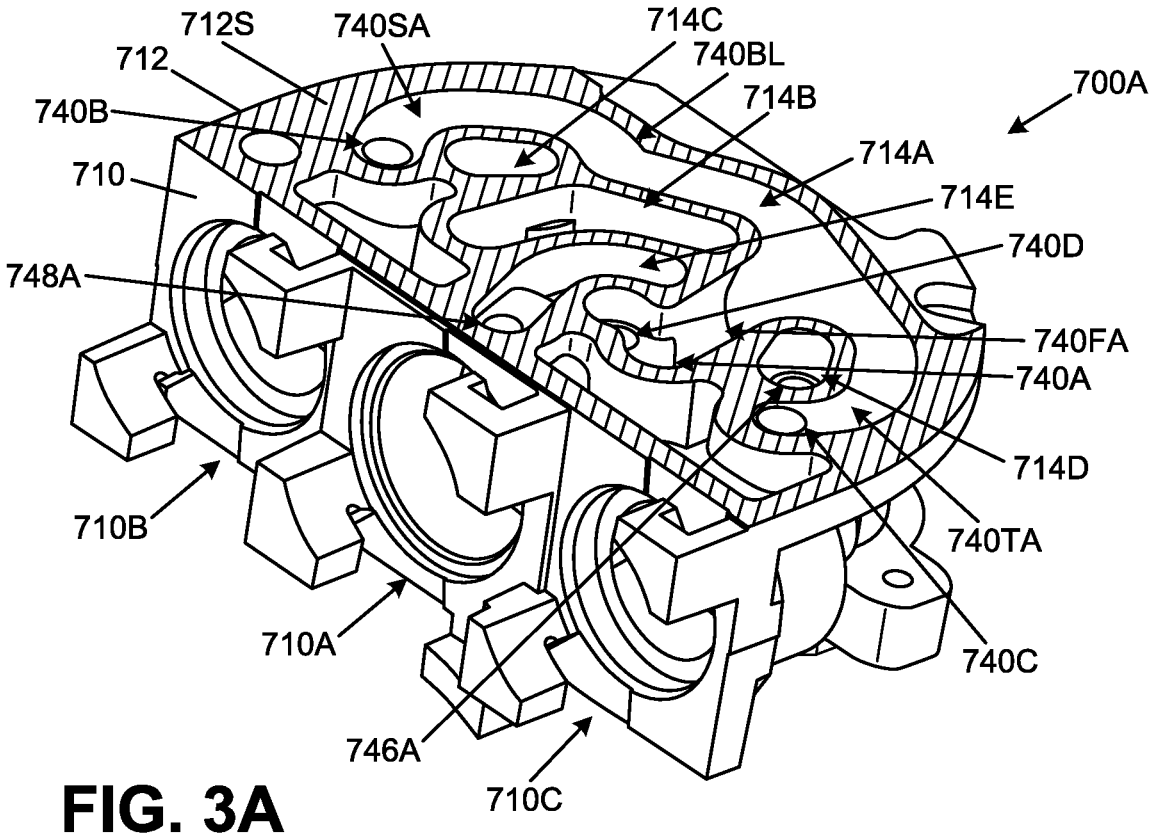
FIGS. 3A-3E illustrate various parts and their interconnections for fluid distributors, fluid transfer systems, sole structures, fluid flow control systems, foot support systems, and/or articles of footwear in accordance with some aspects of this technology.

FIG. 3A provides a perspective view of a first part 700A (also called a "first body portion" herein) of a fluid distributor 720 in accordance with some examples of this technology. Note also FIG. 1B. This first part 700A may be considered a manifold or at least a portion of a manifold. This example first part 700A includes a first side 710 having at least two solenoid mounts, and in this illustrated example, three solenoid mounts—a first solenoid mount 710A, a second solenoid mount 710B, and a third solenoid mount 710C. The solenoid mounts 710A, 710B, and 710C include connectors or other suitable structures for engaging and mounting solenoids 4900A, 4900B, 4900C, respectively, in an operational manner (e.g., sealed engagement).

A second side 712 of the first part 700A includes a first surface 712S that defines at least portions of two or more fluid transfer channels of the fluid distributor 720. In the example structure shown in FIG. 3A, surface 712S includes: (i) a first open channel 714A (channel 714A has an open top at surface 712S) that defines at least a portion of a main fluid distribution channel 4920 of the fluid distributor 720 in the first surface 712S, (ii) a second open channel 714B (channel 714B has an open top at surface 712S) that defines at least a portion of a tank channel 716B of the fluid distributor 720 in the first surface 712S, (iii) a third open channel 714C (channel 714C has an open top at surface 712S) that defines at least a portion of a first foot support bladder channel 716C of the fluid distributor 720 in the first surface 712S, (iv) a fourth open channel 714D (channel 714D has an open top at surface 712S) that defines at least a portion of a second foot support bladder channel 716D of the fluid distributor 720 in the first surface 712S, and (v) a fifth open channel 714E (channel 714E has an open top at surface 712S) that defines at least a portion of a fluid release channel 716E of the fluid distributor 720 in the first surface 712S. While other arrangements are possible, in the example of FIG. 3A, first side 710 of part 700A (with the solenoid mounts 710A-710C) is adjacent second side 712 (e.g., with sides 710, 712 extending at about 90 degrees with respect to one another).

Figure 3B:
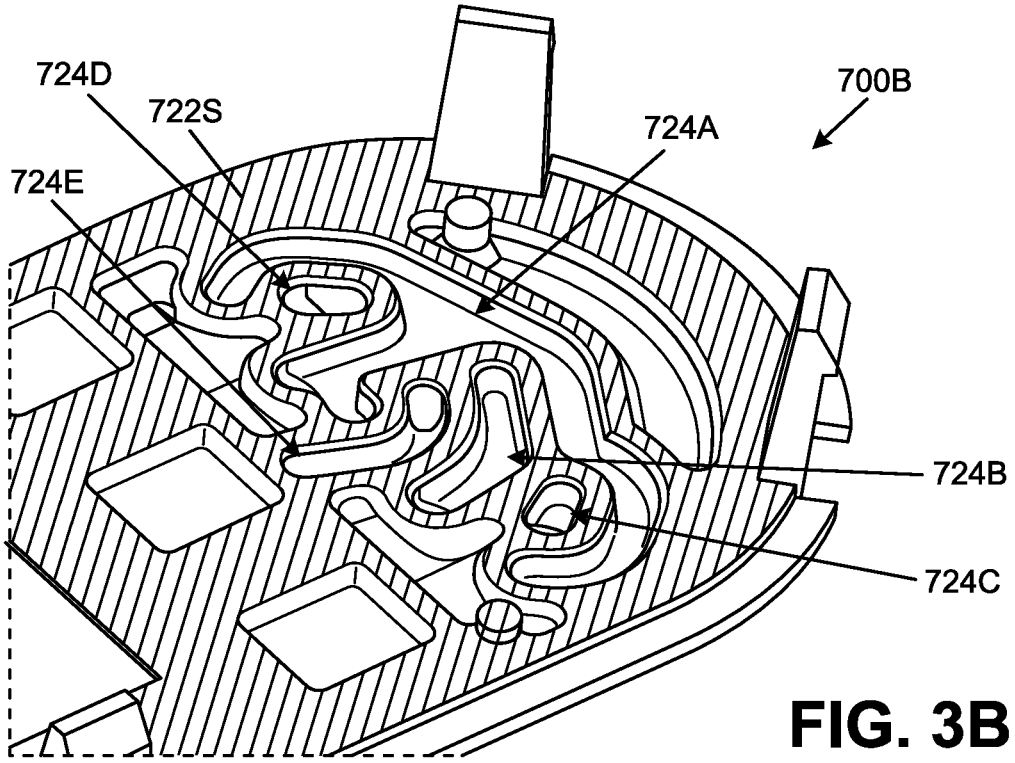

FIG. 3B provides a perspective view of a second part 700B (also called a "second body portion" herein) of the fluid distributor 720 that is intended to engage with at least the first surface 712S of the first part 700A. This second part 700B (second body portion) includes a main surface 722S that directly faces and engages surface 712S to close one or more (e.g., including all) of the open channels of the first part 700A. While not a requirement, in this illustrated example, main surface 722S of the second part 700B includes one or more grooves corresponding (e.g., in size and shape) to one or more of the open channels at the first surface 712S of the first part 700A. More specifically, in this example, main surface 722S of the second part 700B includes: (i) a first recess 724A (which also may constitute an open channel) sized and shaped to close off first open channel 714A to provide the main fluid distribution channel 4920 of the fluid distributor 720, (ii) a second recess 724B (which also may constitute an open channel) sized and shaped to close off second open channel 714B to provide the tank channel 716B of the fluid distributor 720, (iii) a third recess 724C (which also may constitute an open channel) sized and shaped to close off third open channel 714C to provide the first foot support bladder channel 716C of the fluid distributor 720, (iv) a fourth recess 724D (which also may constitute an open channel) sized and shaped to close off fourth open channel 714D to provide the second foot support bladder channel 716D of the fluid distributor 720, and (v) a fifth recess 724E (which also may constitute an open channel) sized and shaped to close off fifth open channel 714E to provide the fluid release channel 716E of the fluid distributor 720. The first part 700A and the second part 700B may be sealingly engaged together, e.g., to seal and form the main fluid distribution channel 4920, the tank channel 716B, the first foot support bladder channel 716C, the second foot support bladder channel 716D, and the fluid release channel 716E from their corresponding open channels 714A-714E and recesses 724A-724E. A gasket or seal ring may be provided to help assure a fluid tight seal, if needed. Additionally or alternatively, one or more of the recesses 724A-724E may be omitted, and the corresponding open channel(s) 714A-714E of the first part 700A could be closed and/or sealed with the main surface 722S of the second part 700B (e.g., by a flat main surface 722S).

Figure 3C:
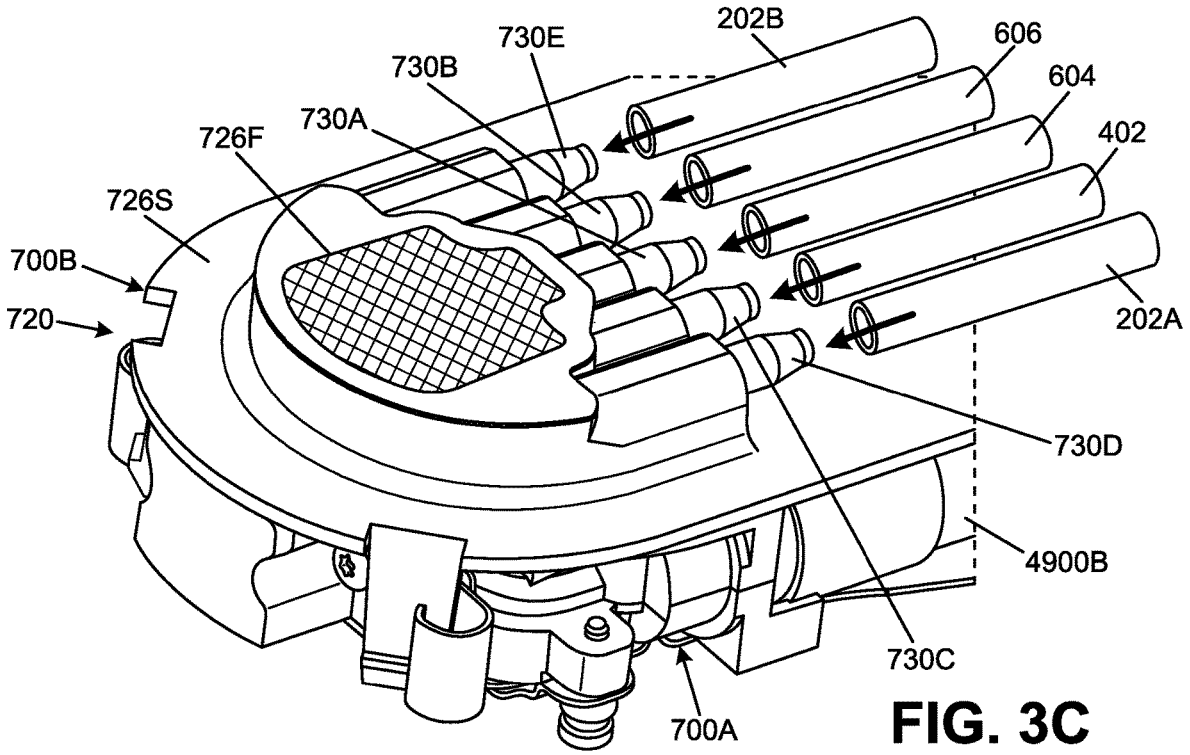
Figure 3D:
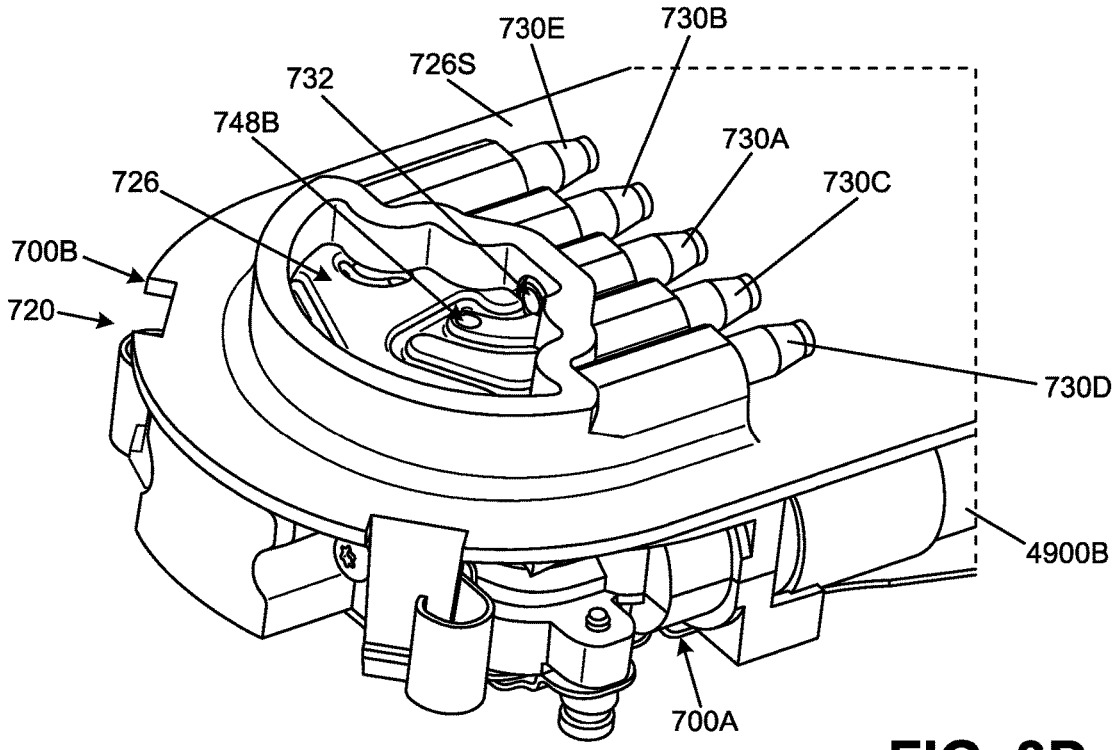

FIGS. 3C and 3D show the surface 726S of the second part 700B opposite surface 722S. As shown, surface 726S includes one or more tube connectors that bring fluid into the fluid distributor 720 and carry fluid away from the fluid distributor 720. The example of FIG. 3C includes five tube connectors 730A-730E (see also FIG. 4). A first tube connector 730A (also called a "fluid inlet connector" herein) receives incoming fluid from the external environment 150 (via fluid supply inlet 732) and moves the incoming fluid to an inlet 5001 of a pump 500 (e.g., a foot activated pump) via fluid line 604. A second tube connector 730B (also called a "fluid source connector" and a "pump connector" herein) receives fluid from the pump 500 via pump outlet 5000 and fluid line 606 (pressurized fluid) and moves this fluid into the fluid distributor 720. A third tube connector 730C connects to fluid line 402, which moves fluid in both directions between the fluid tank 400 and the fluid distributor 720. A fourth tube connector 730D connects to fluid line 202A, which moves fluid in both directions between the first foot support bladder 200A and the fluid distributor 720. A fifth tube connector 730E connects to fluid line 202B, which moves fluid in both directions between the second foot support bladder 200B and the fluid distributor 720. FIG. 3C illustrates the step of connecting external fluid lines 604, 606, 402, 202A, 202B (e.g., flexible plastic tubes) to their respective connectors 730A-730E. The fluid lines 604, 606, 402, 202A, 202B may be permanently fixed to their respective connectors 730A-730E (e.g., with adhesive) or releasably connected thereto (e.g., via friction fit, via clamps or other mechanical connectors, etc.).

FIG. 3D further shows that the surface 726S of the second part 700B is formed to include an interior chamber 726. Chamber 726 receives incoming fluid from the external environment 150 through filter 726F (see FIG. 3C). Filter 726F closes the chamber 726 and filters incoming fluid before it can be introduced into the fluid distributor 720 and/or the foot support system. Chamber 726 contains filtered fluid for introduction into the foot support system via the fluid supply inlet 732, which opens into the chamber 726 and into the first tube connector 730A. Port 748B shown in FIG. 3D opens into fluid release channel 716E.

Additional details follow regarding various fluid channels of the fluid distributor 720 of this example. The first open channel 714A (and the main fluid distribution channel 4920 formed in part by each of first open channel 714A and first recess 724A) includes: (a) a first opening or port 740A in fluid communication with the first solenoid mount 710A (and thus the first solenoid 4900A), (b) a second opening or port 740B in fluid communication with the second solenoid mount 710B (and thus the second solenoid 4900B), (c) a third opening or port 740C in fluid communication with the third solenoid mount 710C (and thus the third solenoid 4900C), and (d) a fourth opening or port 740D in fluid communication with the connector 730B that accepts incoming fluid from the pump 500 via fluid line 606. As shown in FIG. 3A, at the first surface 712S, the main fluid distribution channel 4920 and the first open channel 714A thereof include: (a) a base line 740BL, (b) a first arm 740FA extending from the base line 740BL toward the first solenoid mount 710A (the first arm 740FA including the first opening 740A and the fourth opening 740D), (c) a second arm 740SA extending from the base line 740BL toward the second solenoid mount 710B (the second arm 740SA including the second opening 740B), and (d) a third arm 740TA extending from the base line 740BL toward the third solenoid mount 710C (the third arm 740TA including the third opening 740C). The first recess 724A in the second part 700B forming another portion of the main fluid distribution channel 4920 may have a corresponding recess having a corresponding base line and multi-armed shape, as shown in FIG. 3B.

The second open channel 714B (and thus the tank channel 716B formed in part by each of the second open channel 714B and the second recess 724B) includes: (a) a first opening or port 742A in fluid communication with the first solenoid mount 710A (and thus the first solenoid 4900A) and (b) a second opening or port 742B in fluid communication with the connector 730C that transfers fluid to and from the fluid tank 400 via fluid line 402. The first and second openings or ports 742A, 742B are not shown in the view of FIG. 3A, but these components can be seen in other figures, e.g., see FIGS. 6B 6C, 7A, 7B, 8A, and 8B. As shown in FIG. 3A, at the first surface 712S, the tank channel 716B's second open channel 714B is located between the first arm 740FA and the second arm 740SA of the main fluid distribution channel 4920 and the first open channel 714A thereof. The second open channel 714B (and thus the tank channel 716B) is somewhat boomerang shaped at the first surface 712S, e.g., with two arms arranged at an angle within a range of 100 degrees to 170 degrees. The second recess 724B in the second part 700B forming another portion of the tank channel 716B may have a corresponding two armed and angular shape, as shown in FIG. 3B.

The third open channel 714C (and thus the first foot support channel 716C formed in part by each of the third open channel 714C and the third recess 724C) includes: (a) a first opening or port 744A in fluid communication with the second solenoid mount 710B (and thus the second solenoid 4900B) and (b) a second opening or port 744B in fluid communication with the connector 730D that transfers fluid to and from the first foot support bladder 200A via fluid line 202A. The first and second openings or ports 744A, 744B are not shown in the view of FIG. 3A, but these components can be seen in other figures, e.g., see FIGS. 7D-7F and 9A-9C. As shown in FIG. 3A, at the first surface 712S, the first foot support channel 716C's third open channel 714C is located between the first arm 740FA and the second arm 740SA of the main fluid distribution channel 4920 and the first open channel 714A thereof (and in fact, between the second open channel 714B and the second arm 740SA of the main fluid distribution channel 4920 and the first open channel 714A thereof). The third open channel 714C (and thus the first foot support channel 716C) is linear or oval shaped at the first surface 712S. The third recess 724C in the second part 700B forming another portion of the first foot support channel 716C may have a corresponding linear or oval shape, as shown in FIG. 3B.

The fourth open channel 714D (and thus the second foot support channel 716D formed in part by each of the fourth open channel 714D and the fourth recess 724D) includes: (a) a first opening or port 746A in fluid communication with the third solenoid mount 710C (and thus the third solenoid 4900C) and (b) a second opening or port 746B in fluid communication with the connector 730E that transfers fluid to and from the second foot support bladder 200B via fluid line 202B. The first and second openings or ports 746A, 746B are not shown in the view of FIG. 3A, but these components can be seen in other figures, e.g., see FIGS. 8E-8F and 10A-10C. As shown in FIG. 3A, at the first surface 712S, the second foot support channel 716D's fourth open channel 714D is located between the first arm 740FA and the third arm 740TA of the main fluid distribution channel 4920 and the first open channel 714A thereof. The fourth open channel 714D (and thus the second foot support channel 716D) is linear or oval shaped at the first surface 712S. The fourth recess 724D in the second part 700B forming another portion of the second foot support channel 716D may have a corresponding linear or oval shape, as shown in FIG. 3B.

The fifth open channel 714E (and thus the fluid release channel 716E formed in part by each of the fifth open channel 714E and the fifth recess 724E) includes: (a) a first opening or port 748A in fluid communication with the first solenoid mount 710A (and thus the first solenoid 4900A) and (b) a second opening or port 748B in fluid communication with the ambient environment 150, e.g., via internal chamber 726 shown in FIG. 3D. As shown in FIG. 3A, at the first surface 712S, the fluid release channel 716E's fifth open channel 714E is located between the first arm 740FA and the second arm 740SA of the main fluid distribution channel 4920 and the first open channel 714A thereof (and in fact, between the second open channel 714B and the first arm 740FA of the main fluid distribution channel 4920 and the first open channel 714A thereof). The fifth open channel 714E (and thus the fluid release channel 716E) has a curved shape (e.g., boomerang shaped) at the first surface 712S. The fifth recess 724E in second part 700B forming another portion of the fluid release channel 716E may have a corresponding curved shape, as shown in FIG. 3B.

Figure 3E:
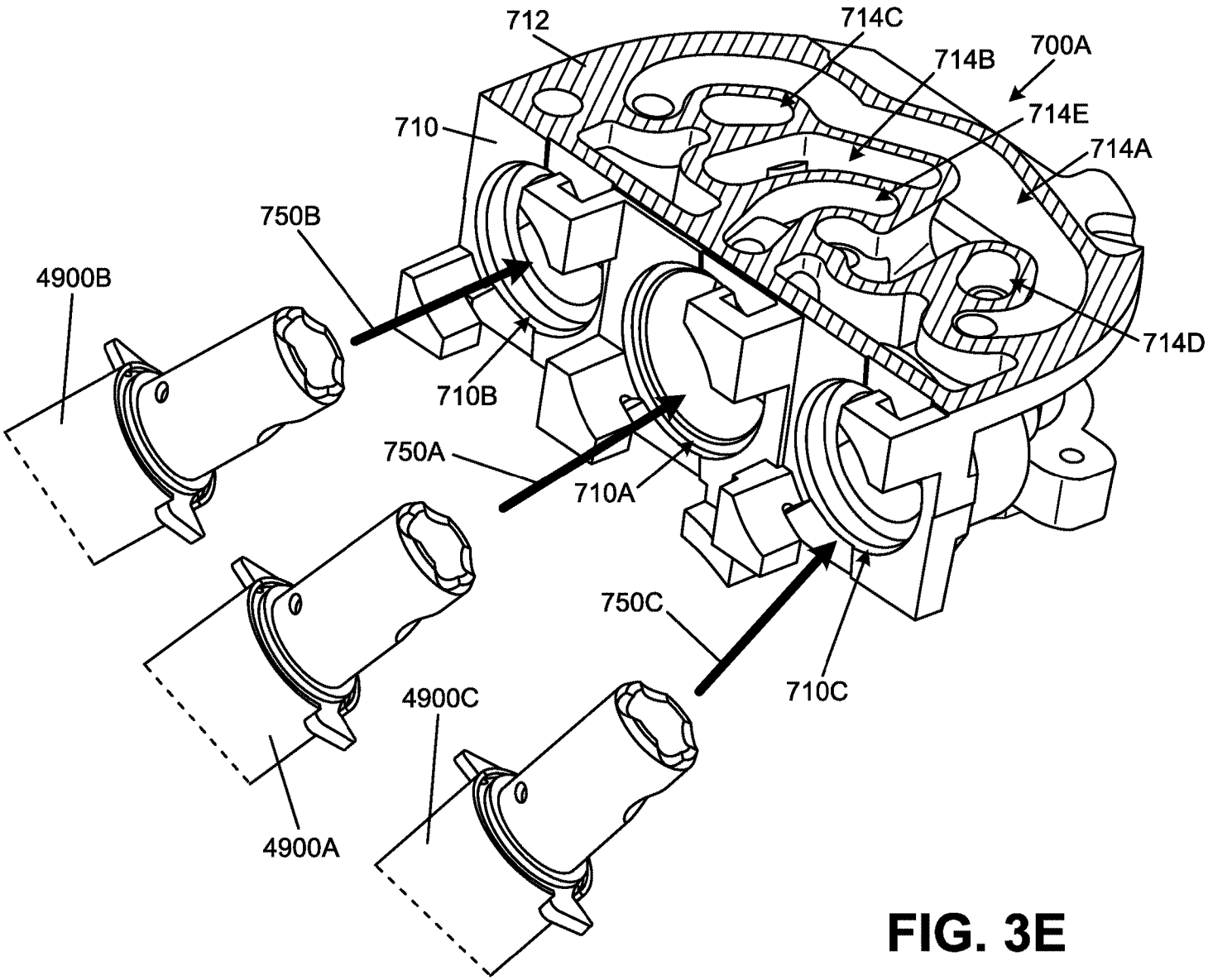

FIG. 3E further illustrates connection of the solenoids 4900A, 4900B, and 4900C to their corresponding solenoid mounts 710A, 710B, and 710C by connection arrows 750A, 750B, 750C. Any desired type of connection and connection structure for the solenoids 4900A, 4900B, and 4900C to their corresponding solenoid mounts 710A, 710B, and 710C may be provided (e.g., threaded connections, retaining rings, ¼ turn locking structure, etc.). The solenoids 4900A, 4900B, and 4900C may be mounted to their corresponding mount 710A, 710B, and 710C before or after the second body part 700B is engaged with the first body part 700A and/or before or after the fluid tubes 604, 606, 402, 202A, 202B are engaged with their respective connector 730A-730E. If desired, one or more of the solenoids 4900A, 4900B, and 4900C may be at least partially included in a housing, like fluid distributor 720 part 750 shown in FIG. 1B. While other arrangements are possible, solenoid 4900A may be a 3/2 latching solenoid and solenoids 4900B and 4900C may be normally closed ("NC") 2/2 non-latching solenoids.

Figure 4:
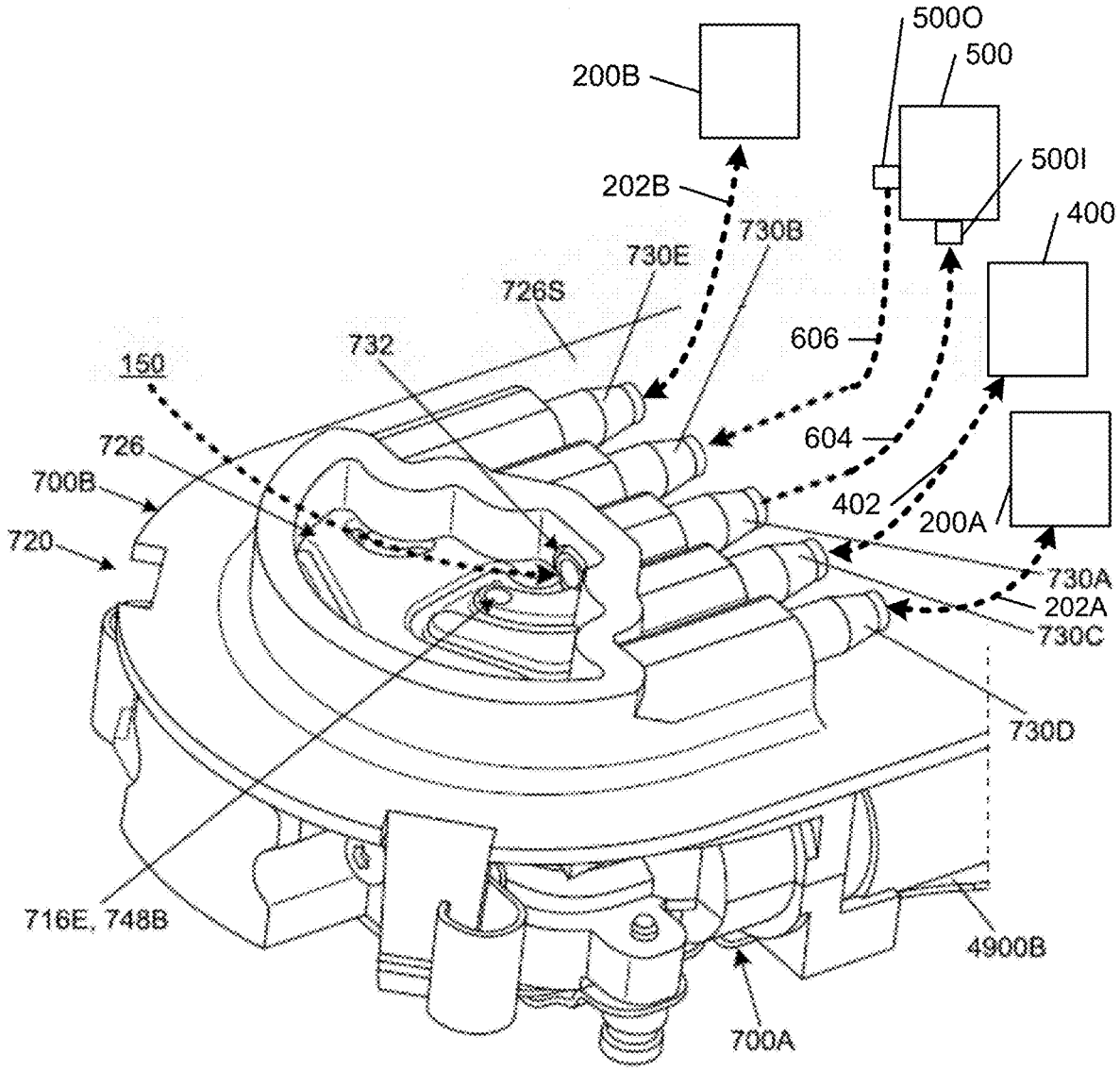
FIG. 4 illustrates movement of fluid from a fluid supply inlet of a fluid distributor to a pump and back to the fluid distributor for fluid distributors, fluid transfer systems, sole structures, fluid flow control systems, foot support systems, and/or articles of footwear in accordance with some aspects of this technology.

FIG. 4 illustrates a fluid path through the fluid distributor 720 from the external environment 150, into the fluid distributor 720, to the pump 500, and back to the fluid distributor 720 (for further distribution, e.g., described in more detail below). To enable visualization of the internal chamber 726, the filter 726F is not shown in FIG. 4 (but see FIG. 3C). Fluid (e.g., air) from the external environment 150 passes through the filter 726F and into the internal chamber 726. Internal chamber 726 includes a fluid supply inlet 732 in fluid communication with (and supplying fluid to) the first connector 730A. As shown in FIG. 3C, fluid transfer line 604 is connected to first connector 730A, and fluid transfer line 604 transfers fluid to the inlet of the pump 500 (e.g., a foot activated pump provided in the sole structure—see FIG. 1A). Once pumped, pressurized fluid (e.g., air) exits the pump 500's outlet, flows into fluid transfer line 606 (see FIG. 3C), and is returned to the fluid distributor 720 at second connector 730B via fluid transfer line 606. From connector 730B, fluid moves through the fluid distributor 720 to different potential destinations (e.g., note the operational states described in conjunction with FIGS. 2A-2F). Examples of those fluid flow paths through fluid distributor 720 are described in more detail below in conjunction with FIGS. 5A-10H.

FIGS. 5A-5F illustrate fluid flow through the fluid distributor 720 in the operational state shown in FIG. 2A. FIG. 2A shows an operational state in which fluid moves into the fluid distributor 720 from the external environment 150 and is discharged back to the external environment 150. This operational state may be used as a "standby" or "steady state" operational state to keep the pumped fluid (e.g., from a foot-activated pump 500) moving through the fluid distributor 720 even when no pressure changes are needed to the foot support bladders 200A, 200B and/or the fluid container 400.

Figure 5A:
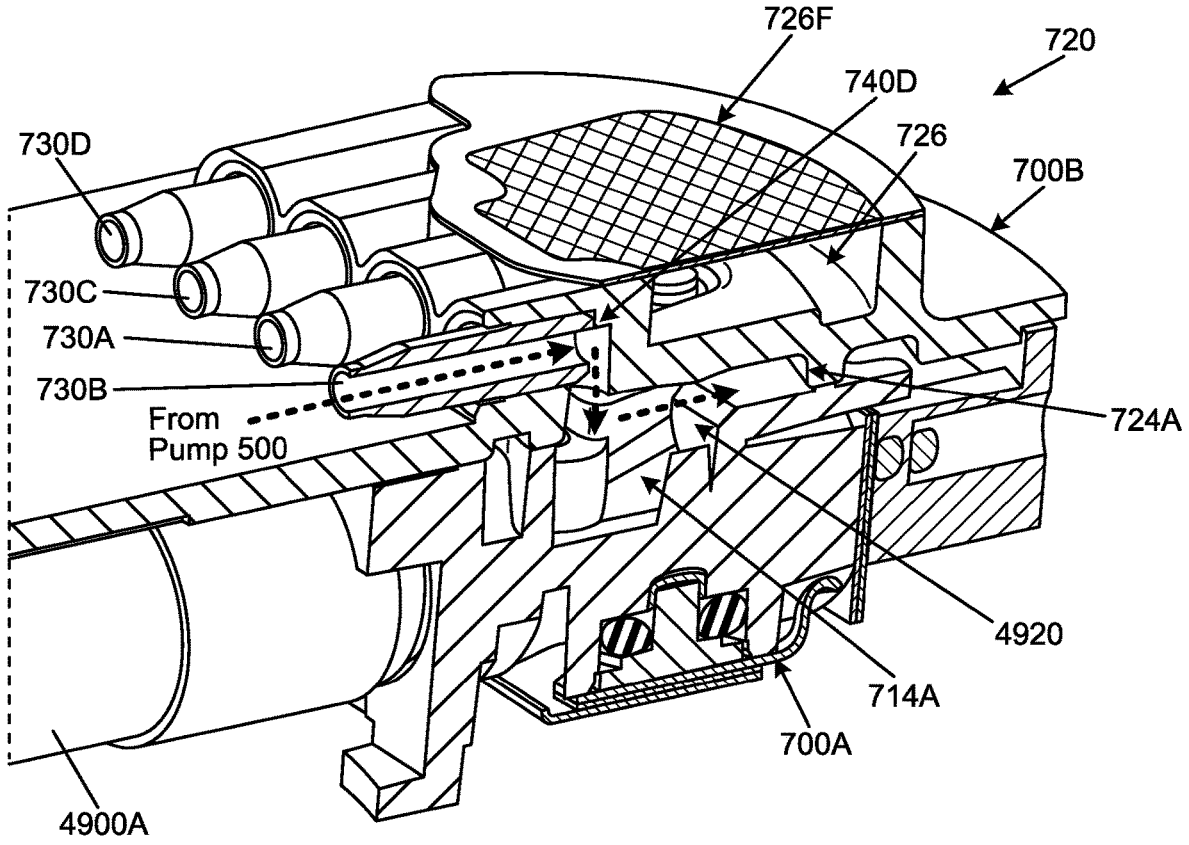
FIGS. 5A-5F illustrate movement of fluid from a pump to the ambient environment (e.g., in a "stand-by" mode as shown in FIG. 2A) for fluid distributors, fluid transfer systems, sole structures, fluid flow control systems, foot support systems, and/or articles of footwear in accordance with some aspects of this technology.

In this operational state, first fluid enters the fluid distributor through fluid supply inlet 732, first connector 730A, fluid line 604, pump 500, fluid line 606, and second connector 730B in the manner described above in conjunction with FIG. 4. FIG. 5A provides a partial section view of the fluid distributor 720 showing the fluid path through the second connector 730B and into the main fluid distribution channel 4920 (formed by the first open channel 714A of distributor first part 700A and the first recess 724A of the distributor second part 700B in this illustrated example). Fluid flow direction and pathways are shown by thick broken line arrows in FIG. 5A (and in FIGS. 5B-10H).

Figure 5B:
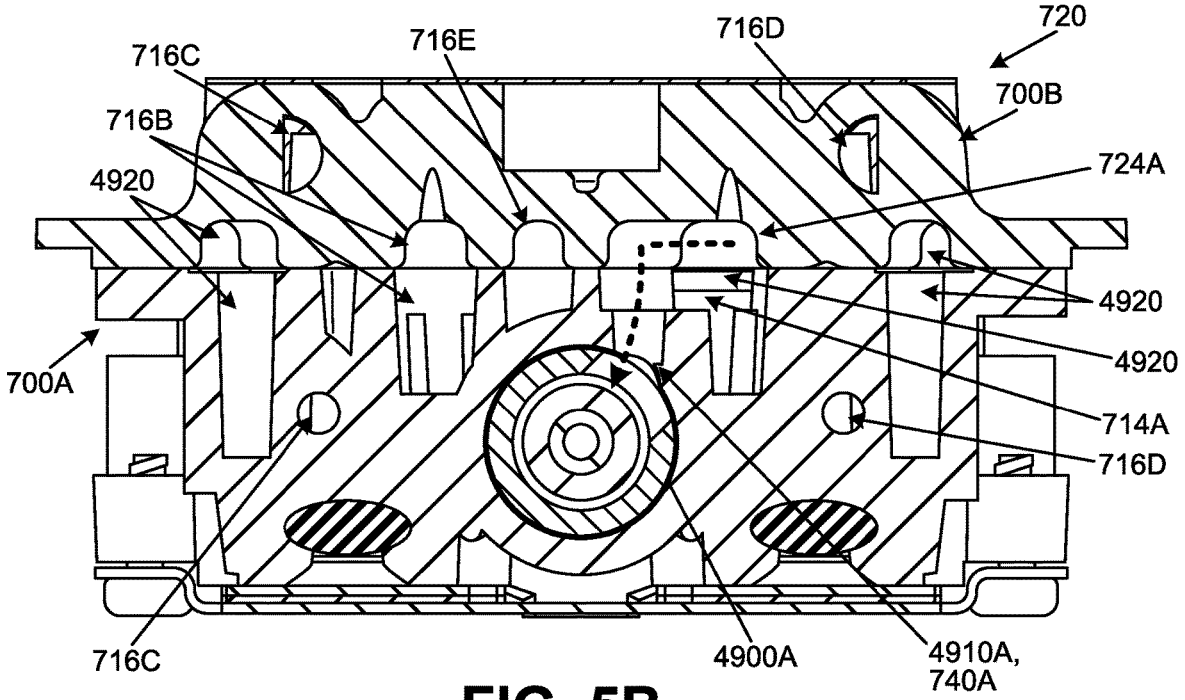
Figure 5C:
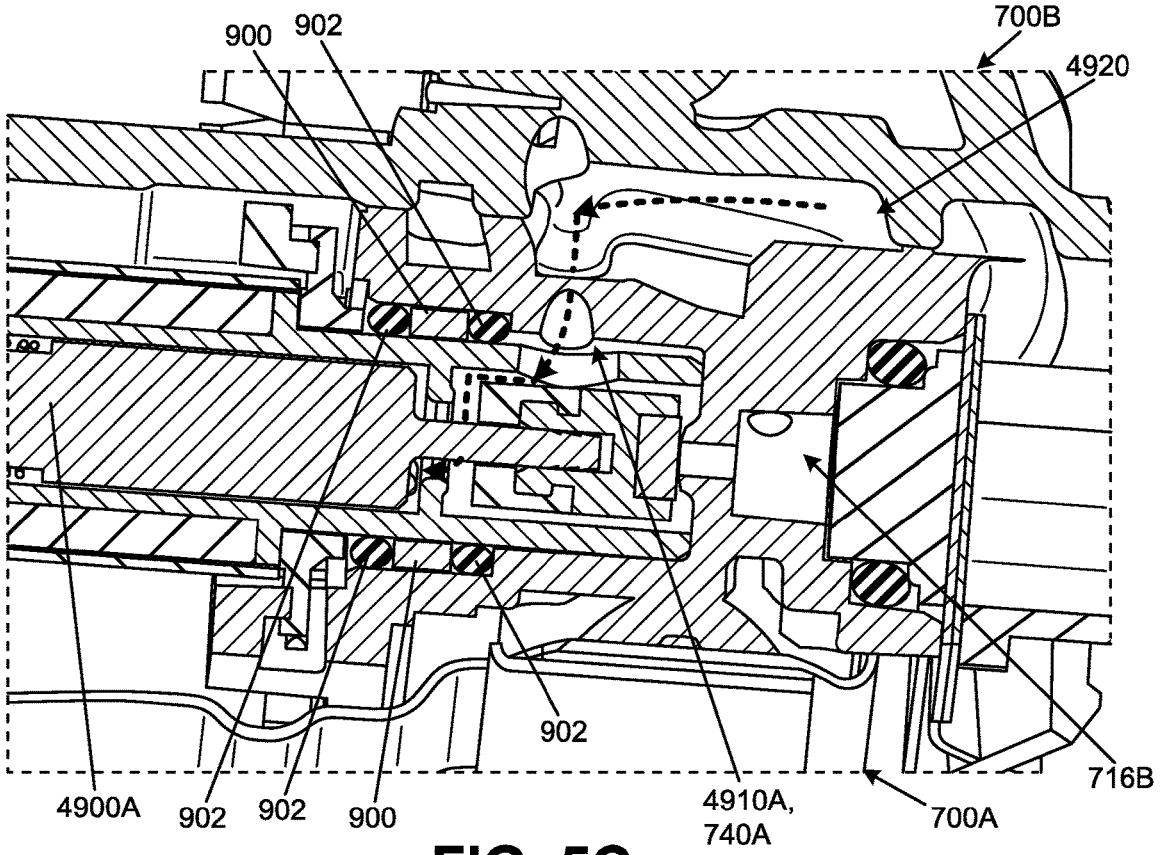
Figure 5D:
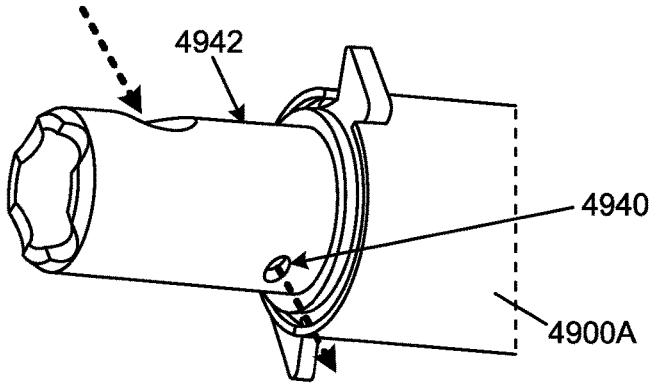
Figure 5E:
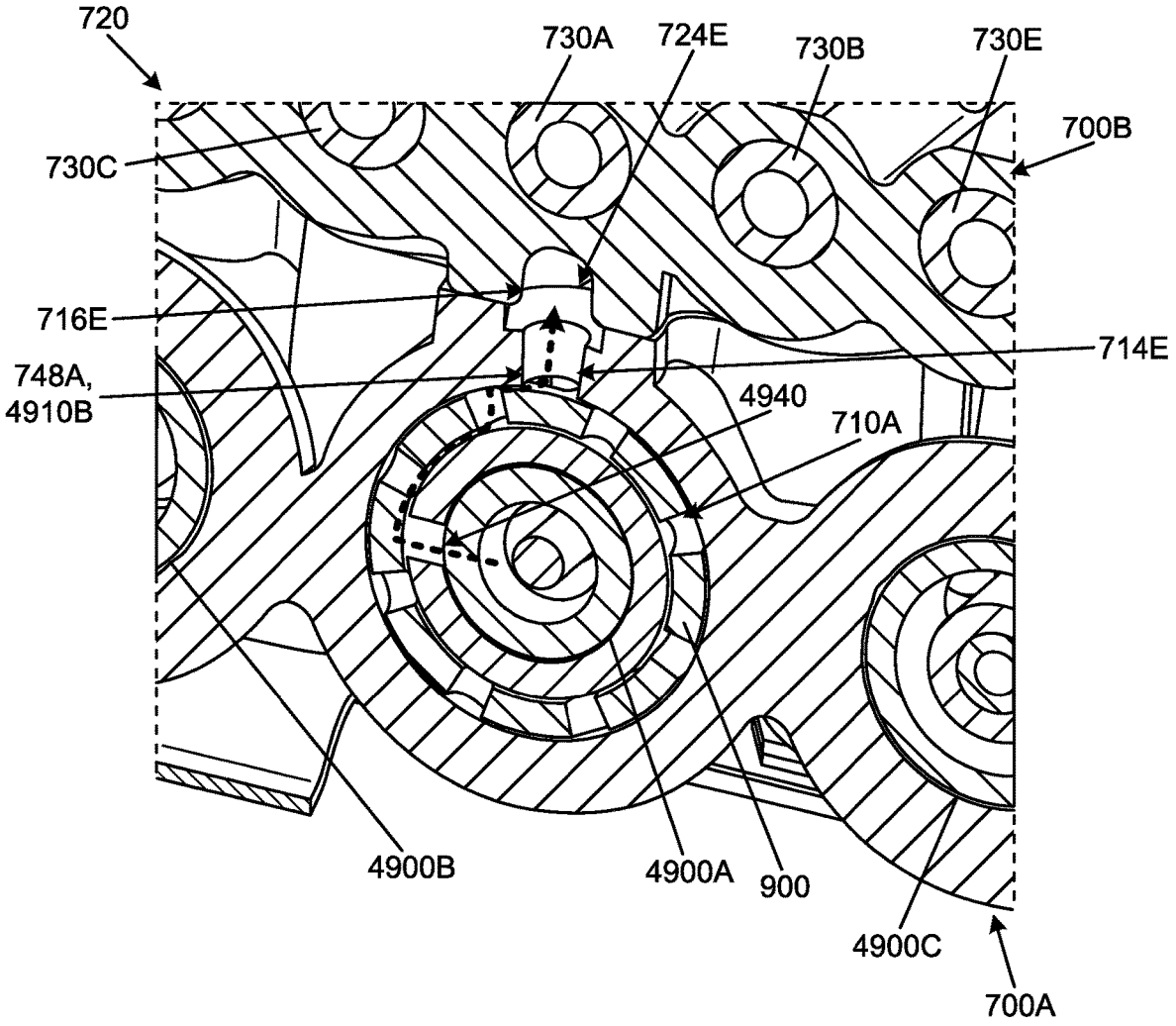
Figure 5F:
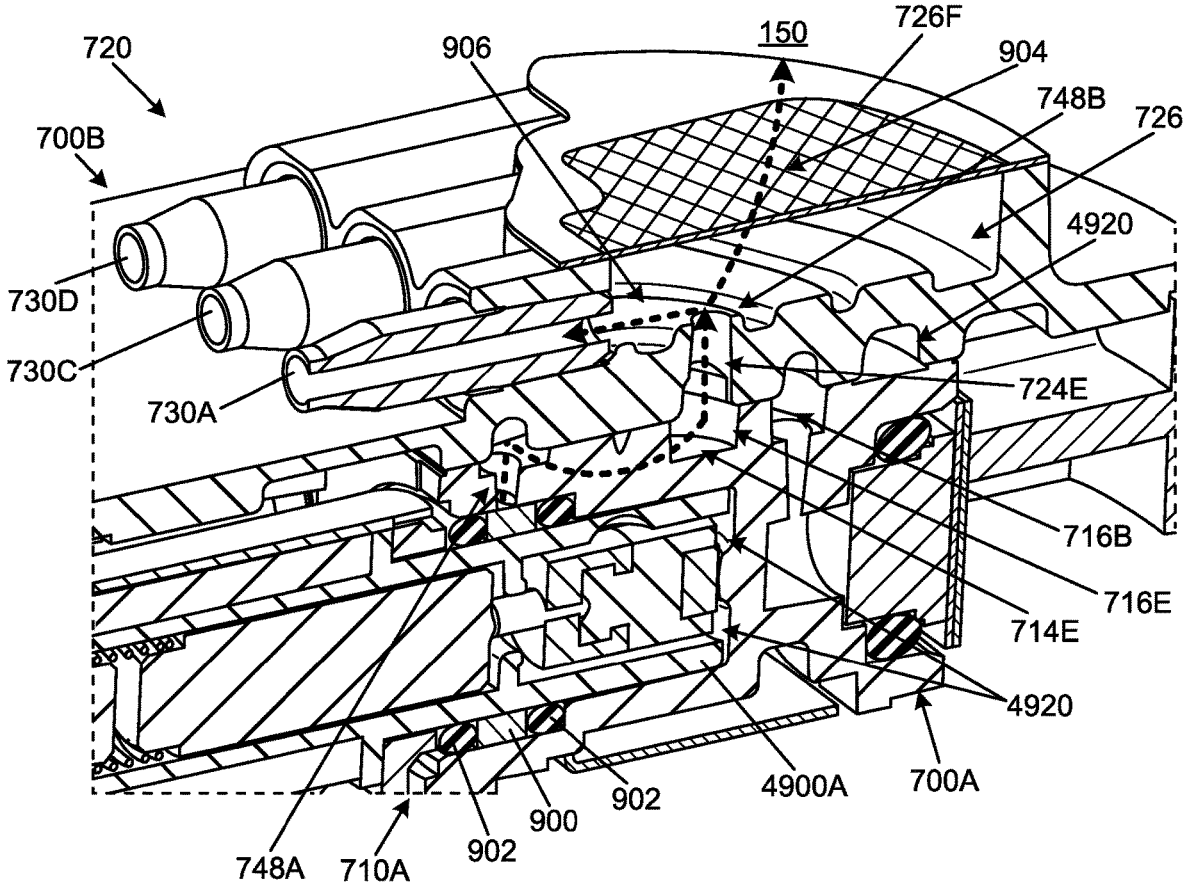

FIGS. 5B and 5C provide additional sectional views showing the continued fluid flow direction and path in this operational state. As shown in these figures, fluid flows from the main fluid distribution channel 4920 into the interior of the first solenoid 4900A through the opening 740A in main fluid distribution channel 4920 and the first port 4910A of the first solenoid 4900. In this configuration and operational state, the first solenoid 4900 is "unlatched." Fluid exits the interior of the first solenoid 4900A through a small hole 4940 in the valve bobbin 4942. See FIG. 5D. A perforated spacer 900 is mounted between O-rings 902 that seal the first solenoid 4900 in solenoid mount 710A. See FIGS. 5C and 5E. Fluid exiting the bobbin 4942's hole 4940 moves through (and/or around) the perforated spacer 900 and exits the first solenoid 4900A (via port 4910B) at the first solenoid mount 710A and is released into the fluid release channel 716E through opening 748A. As described above, fluid release channel 716E of this example is formed from the fifth open channel 714E of the distributor first part 700A and the fifth recess 724E of the distributor second part 700B.

Once in the fluid release channel 716E, fluid moves within the fluid release channel 716E back into the internal chamber 726 through opening 748B. See FIG. 5F. From there, the fluid can either be released to the exterior environment 150 (e.g., through the filter 726F) (see fluid flow line 904) or it can be pulled back into the first connector 730A, where it can be sent to the pump 500 and readmitted back into the fluid distributor 720 (see fluid flow line 906).

Figure 6A:
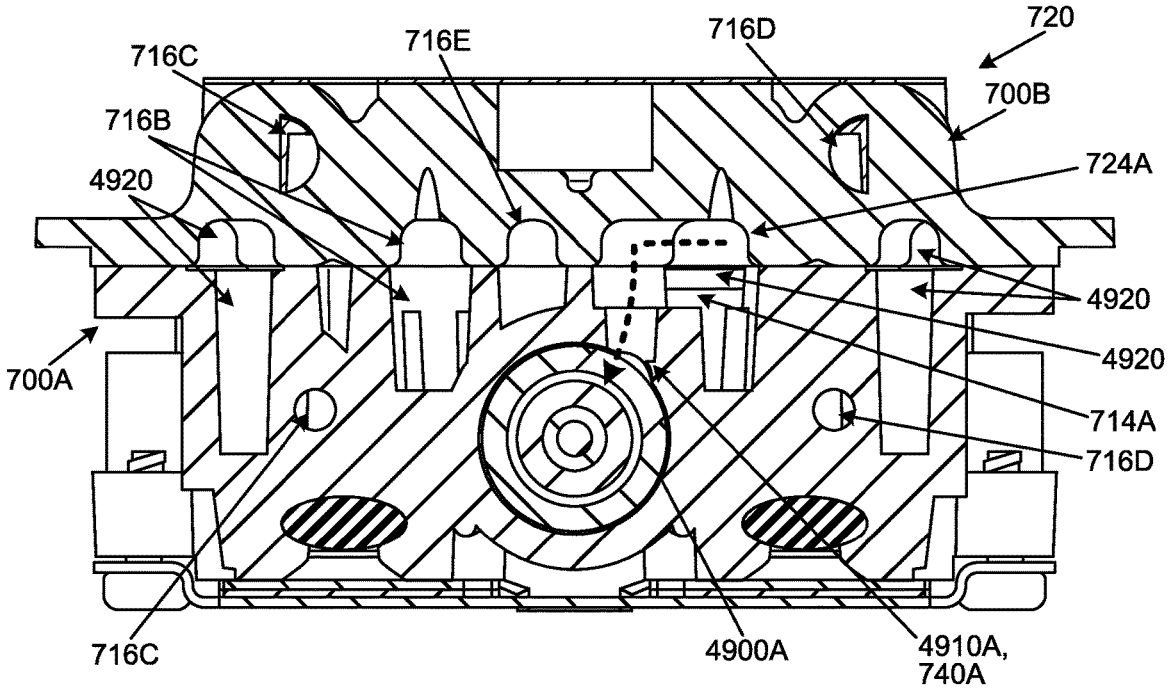
FIGS. 6A-6C illustrate movement of fluid from a pump to a fluid container or tank (e.g., a "tank inflate" mode as shown in FIG. 2B) for fluid distributors, fluid transfer systems, sole structures, fluid flow control systems, foot support systems, and/or articles of footwear in accordance with some aspects of this technology.
Figure 6B:
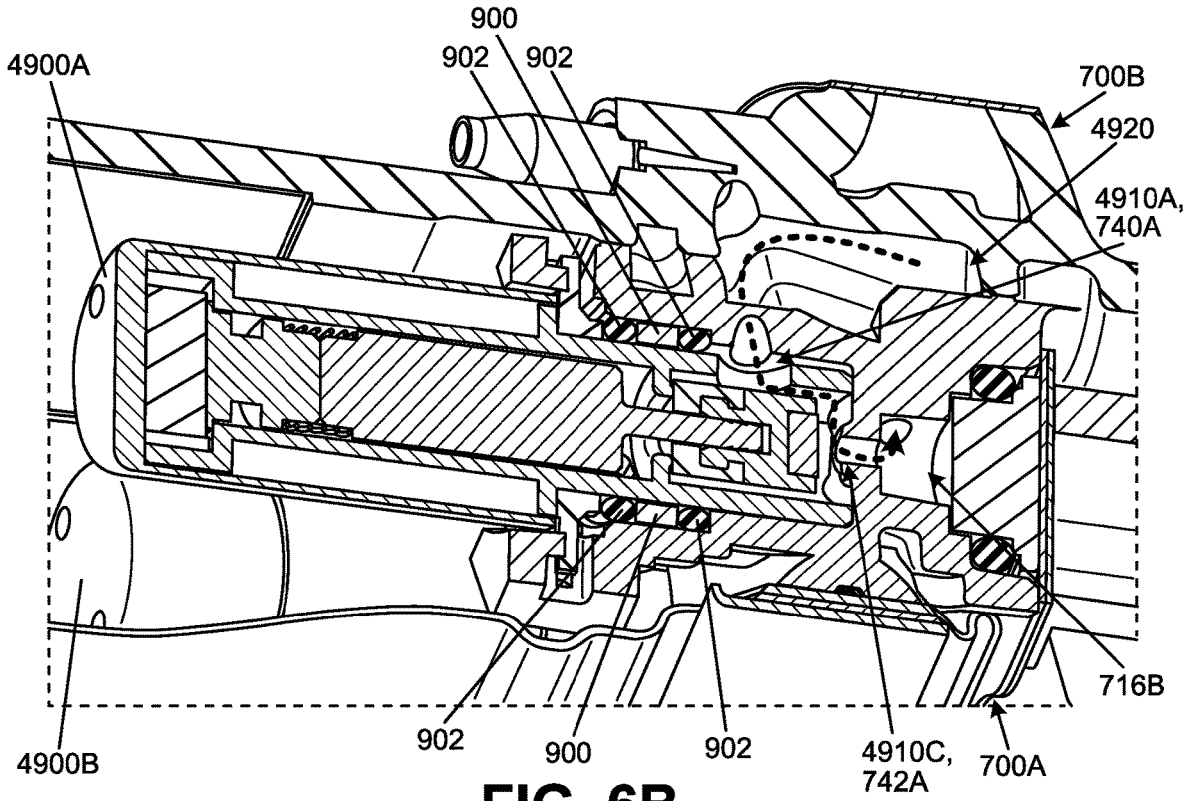
Figure 6C:
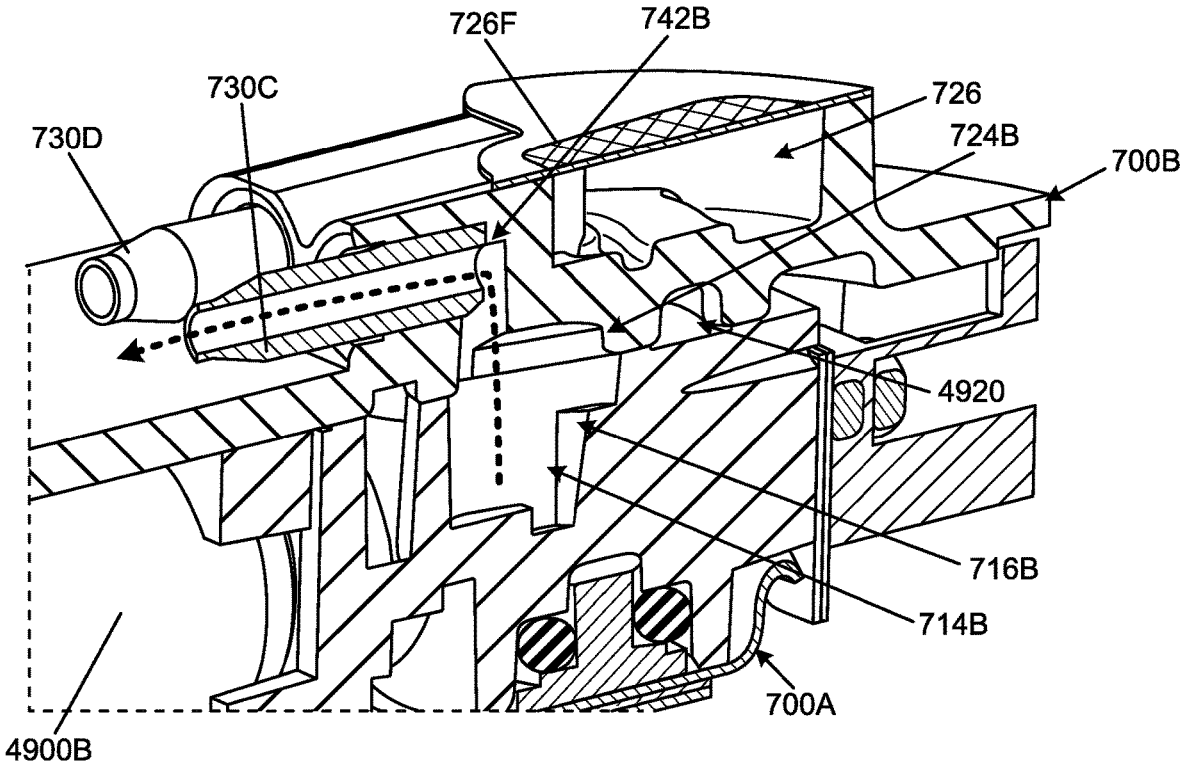

FIGS. 6A-6C illustrate portions of the fluid path through the fluid distributor 720 in the operational state of FIG. 2B above, i.e., when fluid is moved from the external environment to the fluid tank 400. As the initial steps in this operational state, fluid moves from the external environment 150, through the fluid distributor 720's fluid supply inlet 732, to the pump 500, and back to the fluid distributor 720 as described above in conjunction with FIG. 4. Next, as described above in conjunction with FIGS. 5A-5B, fluid moves from the second connector 730B (receiving pressurized fluid from the pump 500) to the first solenoid 4900A via main fluid distribution line 4920. That flow gets fluid to the point shown in FIG. 6A. In this operational state, the first solenoid 4900A is in a latched state, which allows fluid to flow from solenoid port 4910A to port 4910C. See FIG. 6B. Solenoid 4900A port 4910C opens into the tank channel 716B via opening 742A (tank channel 716B is formed by second open channel 714B in the first part 700A of the fluid distributor 720 and by second recess 724B in the second part 700B of the fluid distributor 720 in this example structure). Once in the tank channel 716B, as shown in FIGS. 6B and 6C, fluid moves to the third connector 730C via opening 742B, and from third connector 730C into fluid line 402 and then to tank 400 via fluid line 402.

Figure 7A:
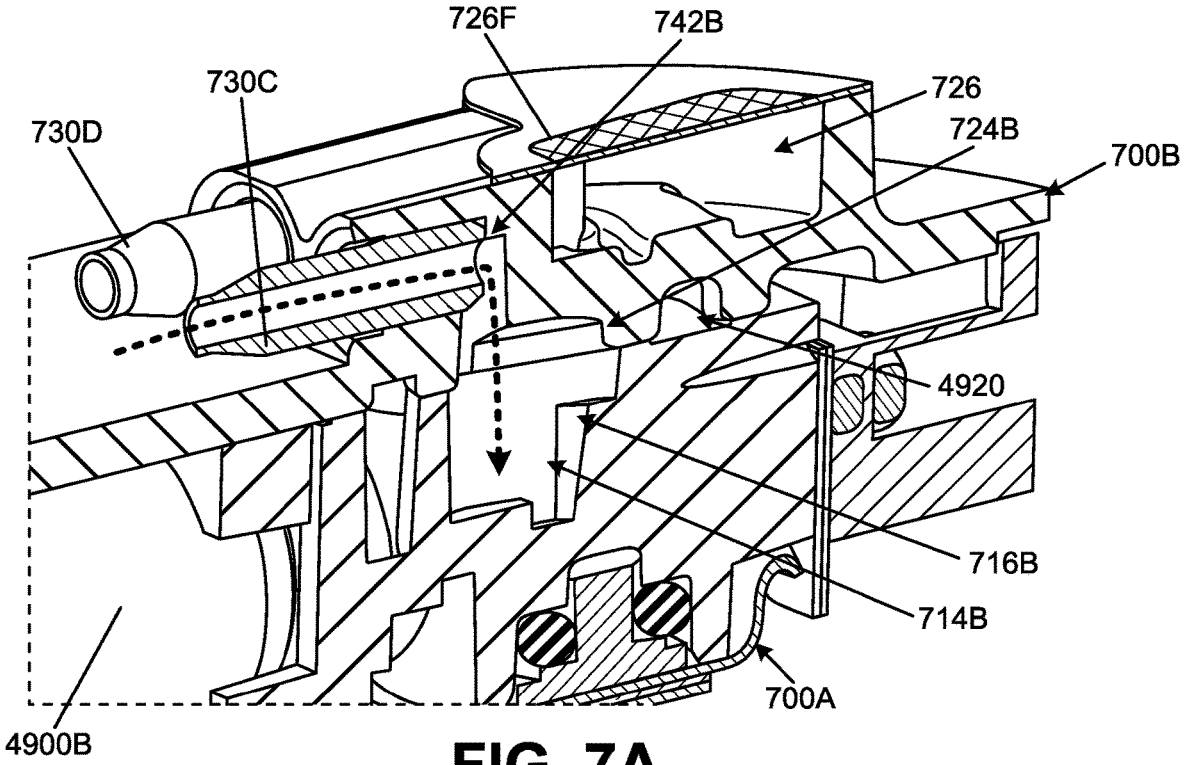
FIGS. 7A-7F illustrate movement of fluid from a fluid container or tank to a first foot support bladder (e.g., in a first bladder "inflate" mode as shown in FIG. 2C) for fluid distributors, fluid transfer systems, sole structures, fluid flow control systems, foot support systems, and/or articles of footwear in accordance with some aspects of this technology.
Figure 7B:
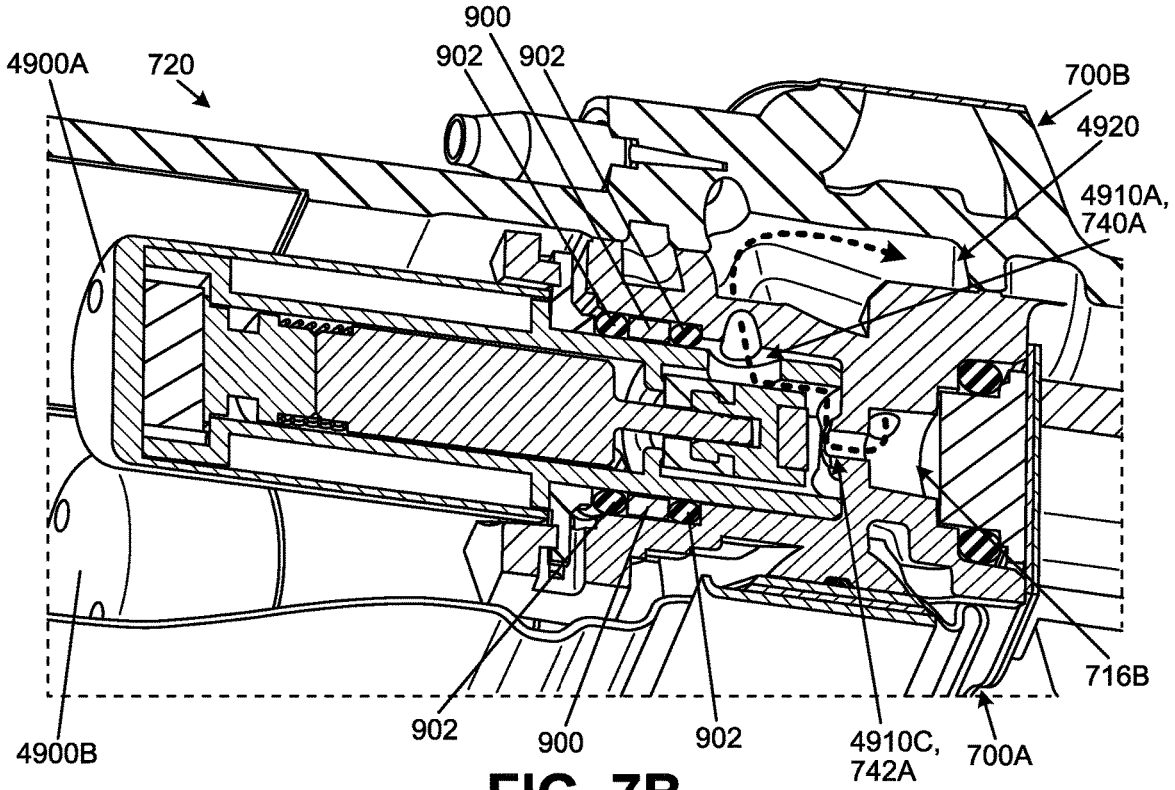
Figure 7C:
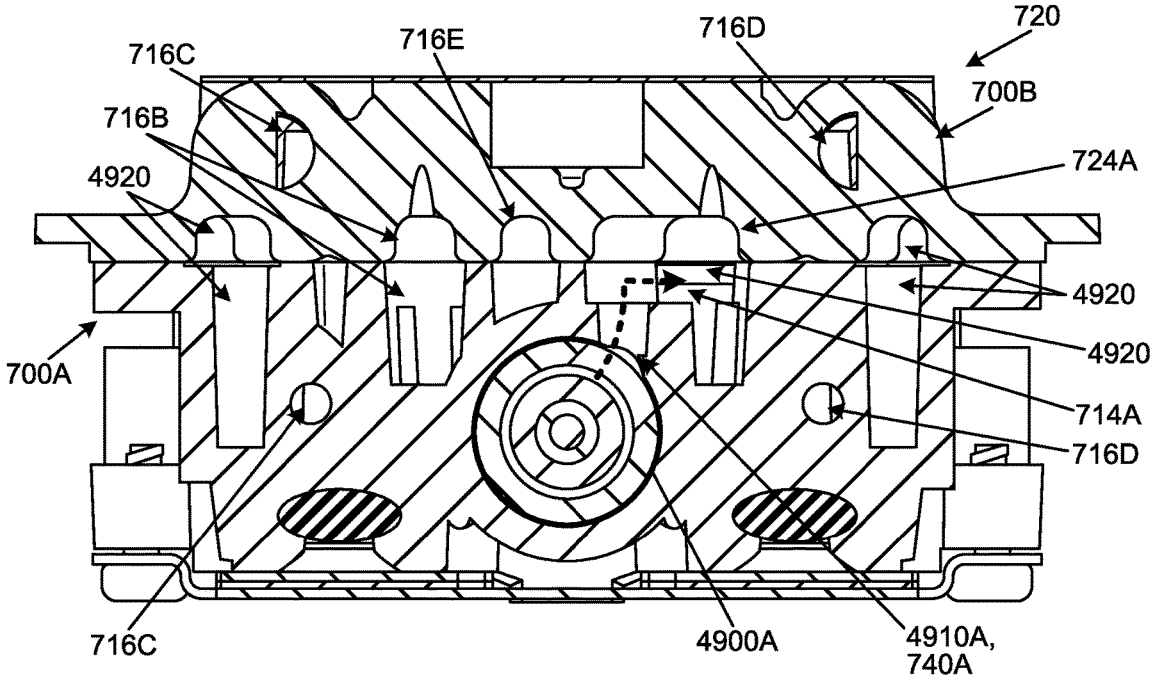
Figure 7D:
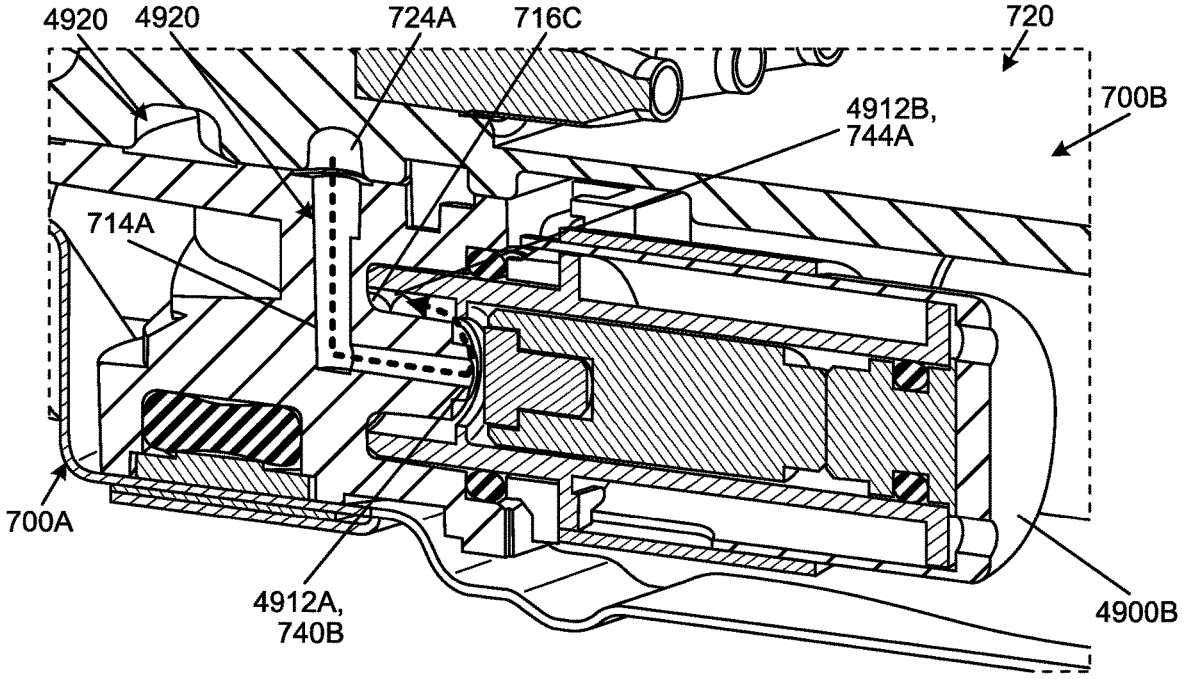
Figure 7E:
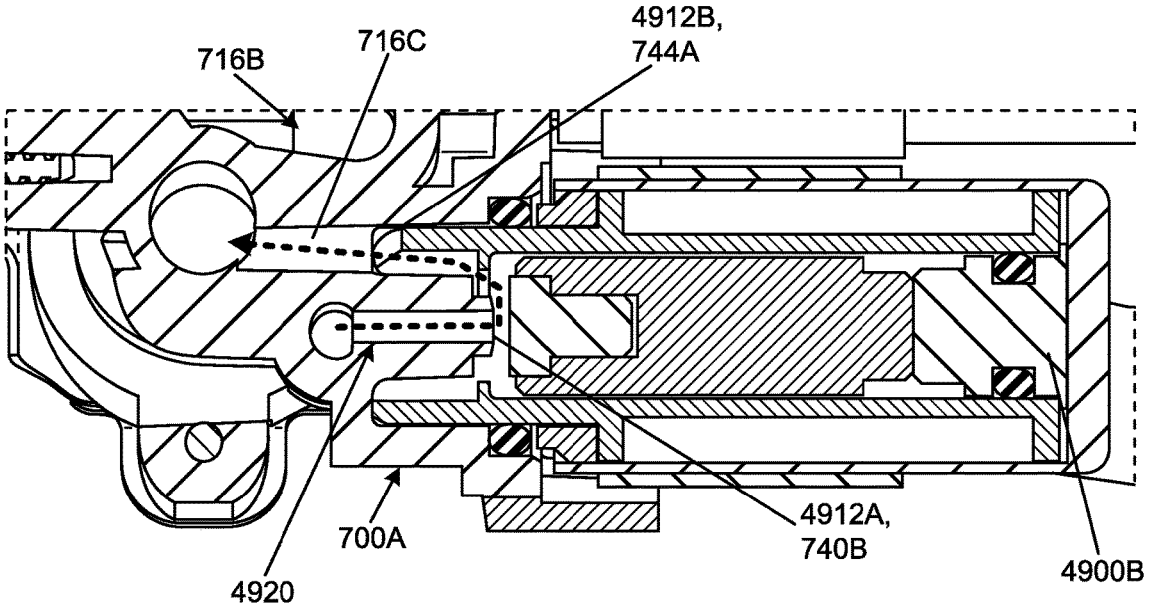
Figure 7F:
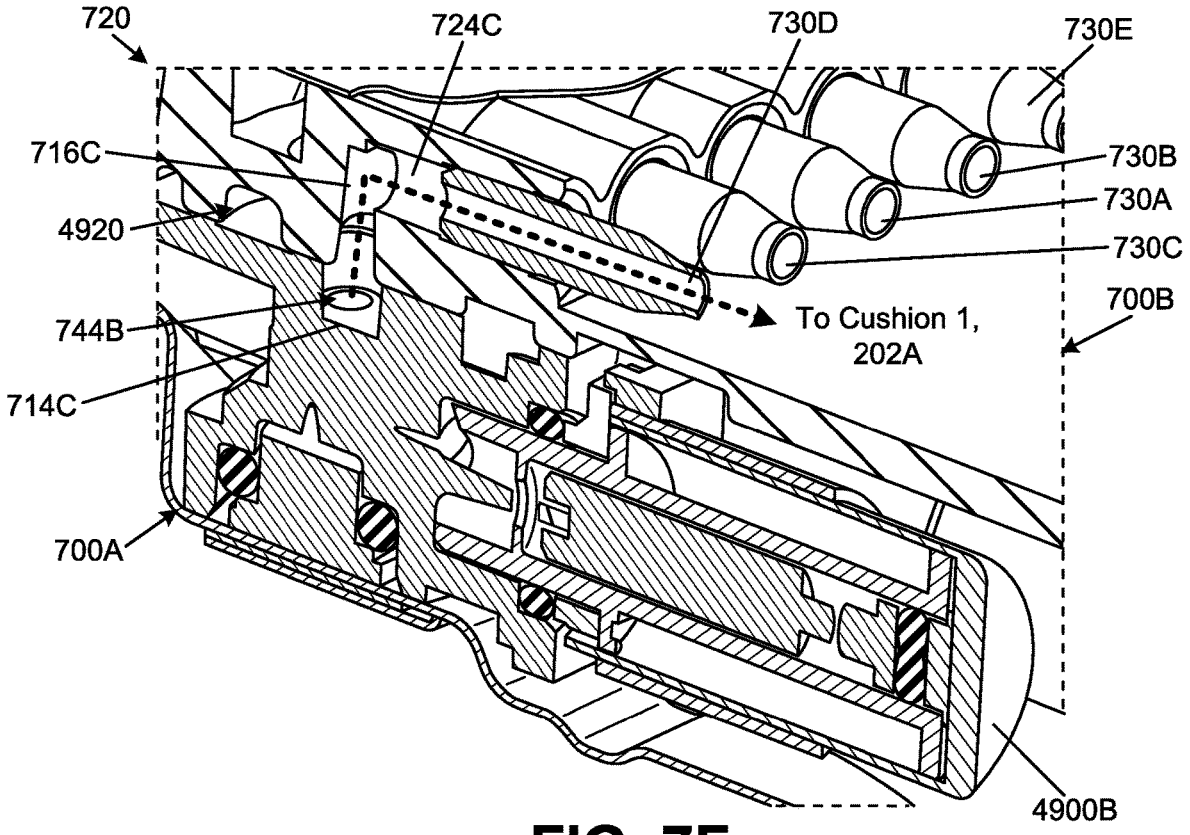

FIGS. 7A-7F illustrate fluid flow through the fluid distributor 720 for the operational state shown in FIG. 2C—from the tank 400 to the first foot support bladder 200A. The first steps, shown in FIGS. 7A and 7B, are somewhat the opposite from the fluid flow described above in conjunction with FIGS. 6B and 6C. In this operational state, the fluid begins in the tank 400, moves via fluid line 402 to the third connector 730C and into the tank channel 716B via opening 742B. See FIG. 7A. Once in the tank channel 716B, as shown in FIG. 7B, fluid enters the first solenoid 4900A (which is in a latched configuration) through opening 742A and port 4910C, through the first solenoid 4900A to port 4910A and into the main fluid distribution channel 4920 via opening 740A. FIG. 7C further shows fluid movement through the first solenoid 4900A to the port 4910A and into the main fluid distribution channel 4920. Once in the main fluid distribution channel 4920, the fluid moves through opening 740B and solenoid port 4912A and into the second solenoid 4900B, which is in the "open configuration" in this operational state (third solenoid 4900C is in the "closed configuration"). Because it is open, fluid passes through the second solenoid 4900B and into the first foot support bladder channel 716C (which is formed by third open channel 714C in the first part 700A of the fluid distributor 720 and by third recess 724C in the second part 700B of the fluid distributor 720 in this example) via solenoid port 4912B and opening 744A. See FIGS. 7D and 7E. Once in the first foot support bladder channel 716C, the fluid passes through opening 744B to fourth connector 730D, into first foot support fluid line 202A, and from there into the first foot support bladder 200A. See also FIG. 7F.

Figure 8A:
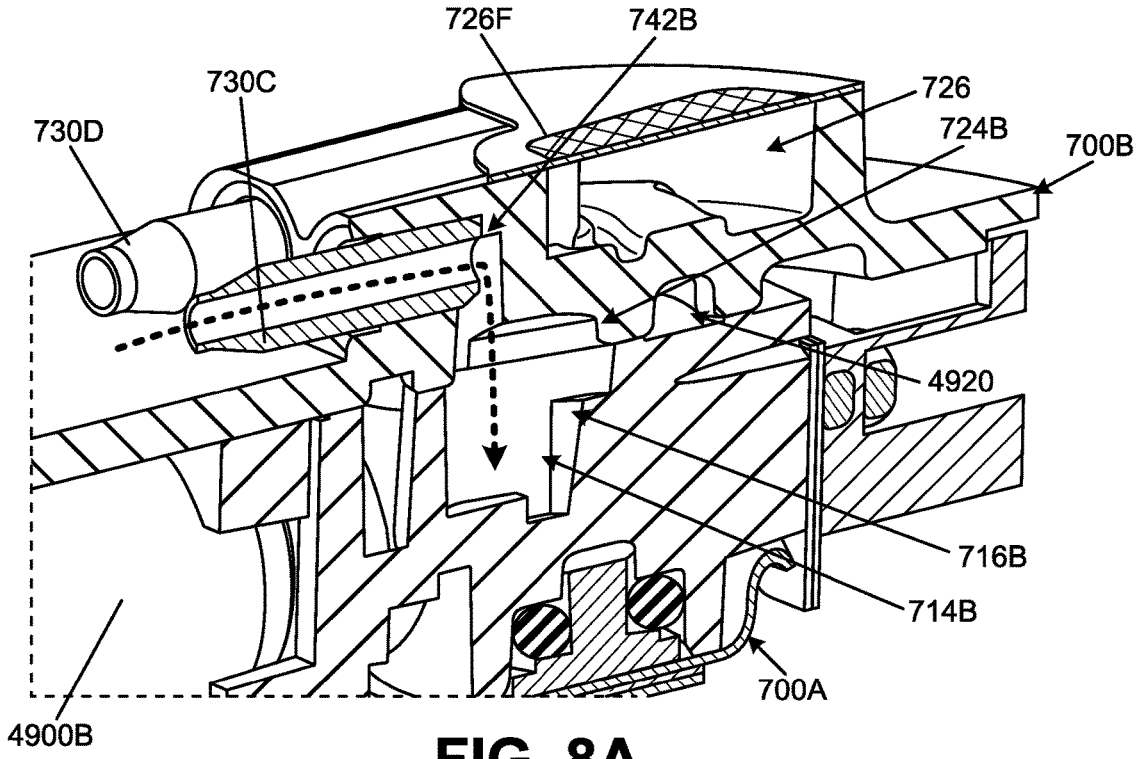
FIGS. 8A-8F illustrate movement of fluid from a fluid container or tank to a second foot support bladder (e.g., in a second bladder "inflate" mode as shown in FIG. 2D) for fluid distributors, fluid transfer systems, sole structures, fluid flow control systems, foot support systems, and/or articles of footwear in accordance with some aspects of this technology.
Figure 8B:
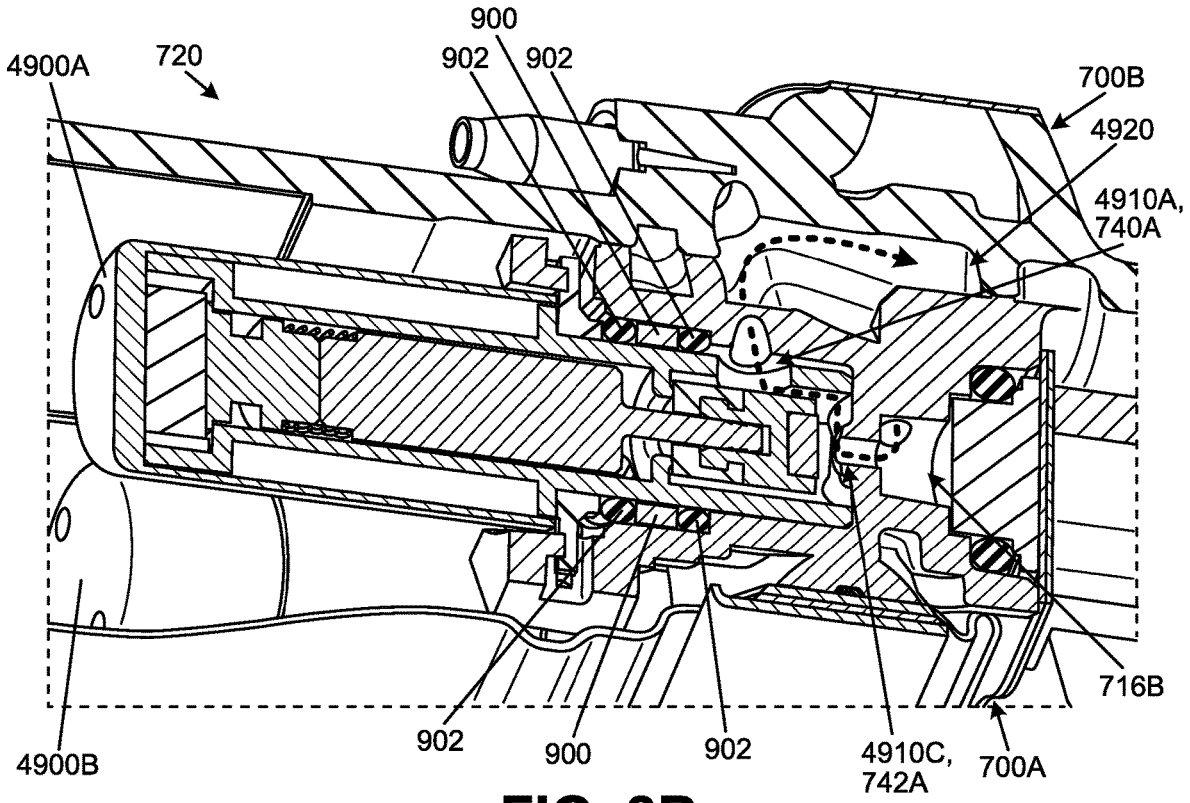
Figure 8C:
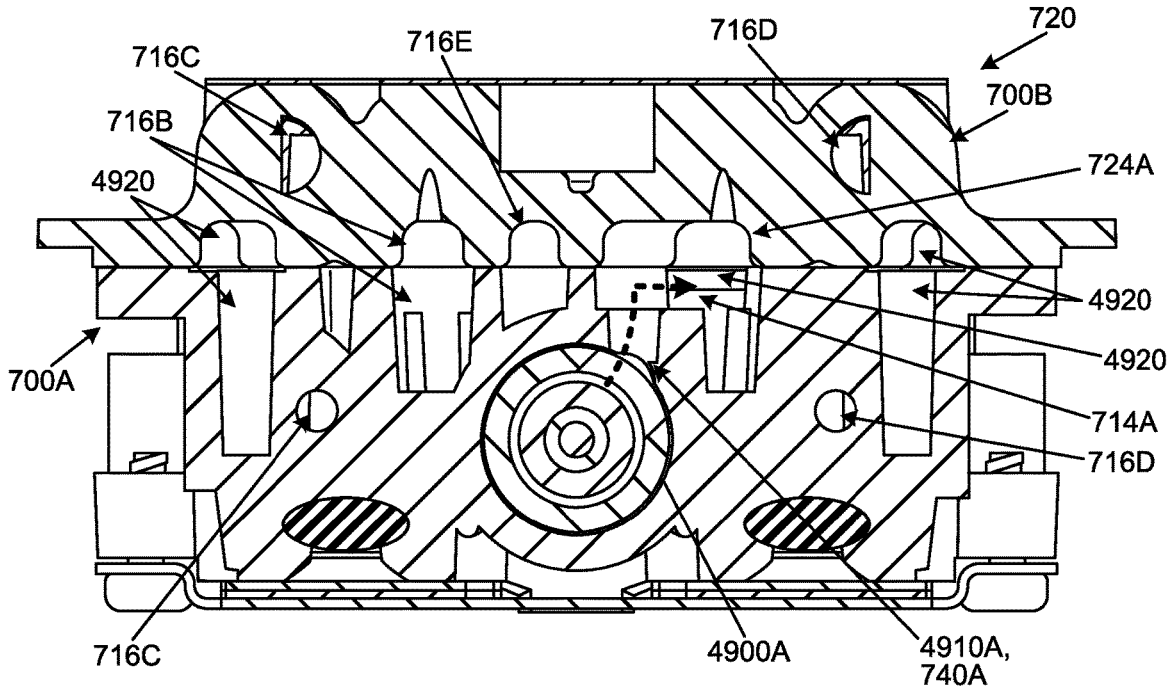
Figure 8D:
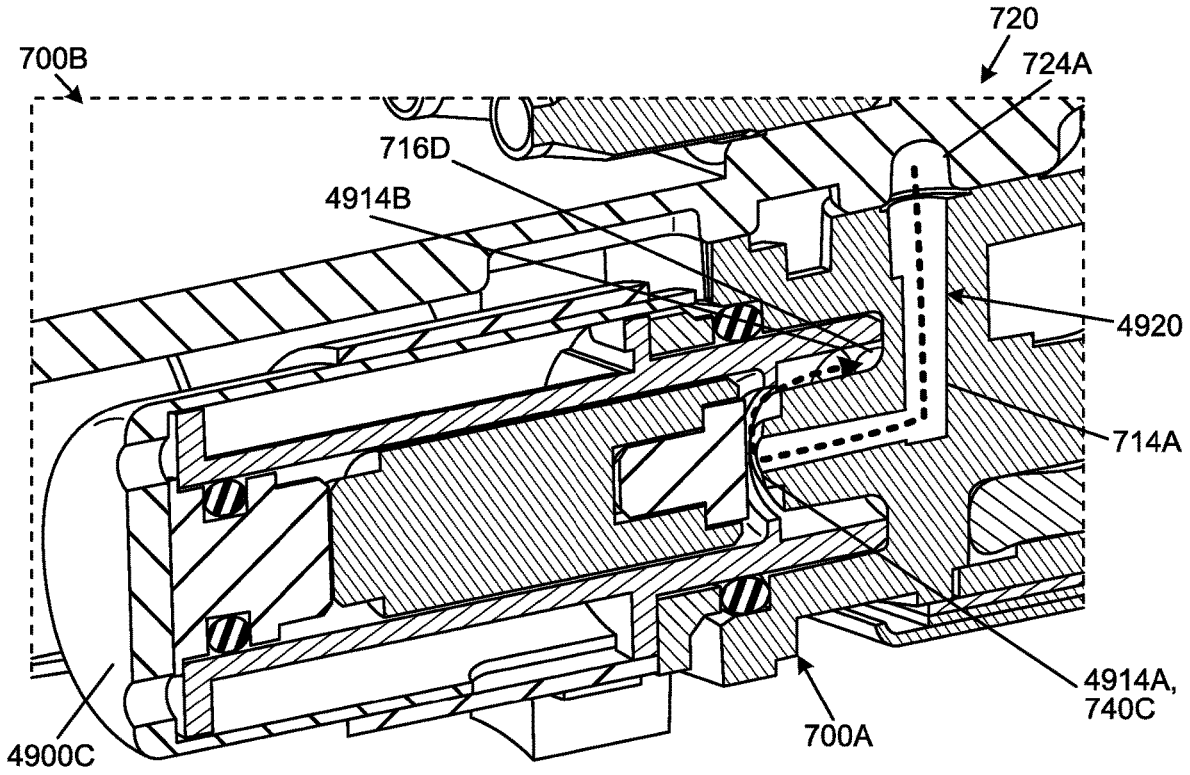
Figure 8E:
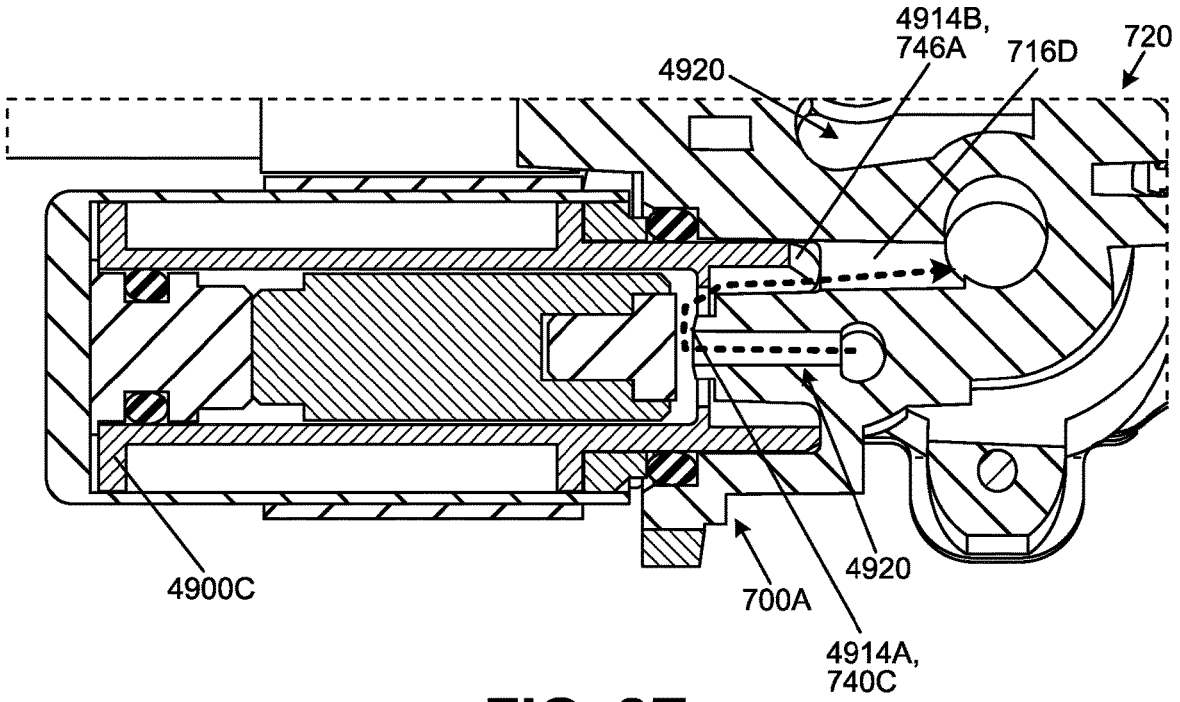
Figure 8F:
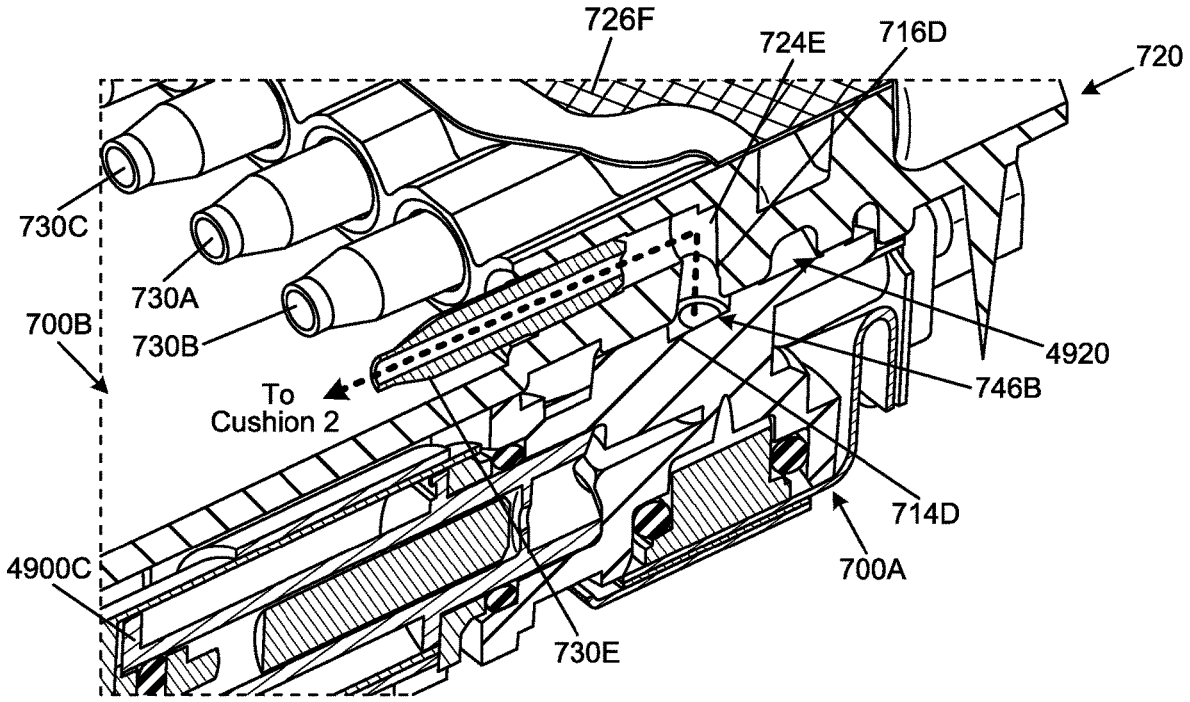

FIGS. 8A-8F illustrate fluid flow through the fluid distributor 720 for the operational state shown in FIG. 2D—from the tank 400 to the second foot support bladder 200B. The first steps, shown in FIGS. 8A and 8B, are similar to those shown for FIGS. 7A and 7B (and somewhat the opposite from the fluid flow described above in conjunction with FIGS. 6B and 6C). In this operational state, the fluid begins in the tank 400, moves via fluid line 402 to the third connector 730C and into the tank channel 716B via opening 742B. See FIG. 8A. Once in the tank channel 716B, as shown in FIG. 8B, fluid enters the first solenoid 4900A (which is in a latched configuration) through opening 742A and port 4910C, through the first solenoid 4900A to port 4910A and into the main fluid distribution channel 4920 via opening 740A. FIG. 8C further shows fluid movement through the first solenoid 4900A to the port 4910A and into the main fluid distribution channel 4920. Once in the main fluid distribution channel 4920, the fluid moves through opening 740C and solenoid port 4914A and into the third solenoid 4900C, which is in the "open configuration" in this operational state (second solenoid 4900B is in the "closed configuration"). Because it is open, fluid passes through the third solenoid 4900C and into the second foot support bladder channel 716D (which is formed by fourth open channel 714D in the first part 700A of the fluid distributor 720 and by fourth recess 724D in the second part 700B of the fluid distributor 720 in this example) via solenoid port 4914B and opening 746A. See FIGS. 8D and 8E. Once in the second foot support bladder channel 716D, the fluid passes through opening 746B to fifth connector 730E, into second foot support fluid line 202B, and from there into the second foot support bladder 200B. See also FIG. 8F.

Figure 9A:
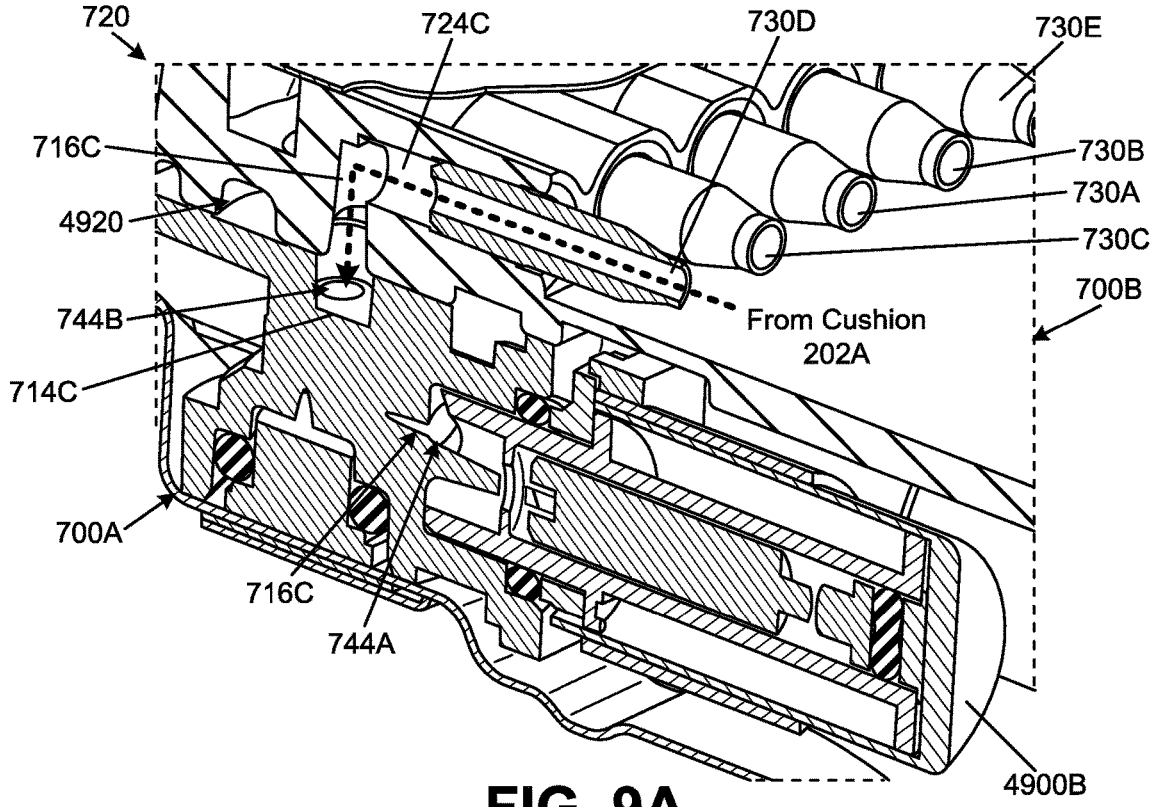
FIGS. 9A-9H illustrate movement of fluid from a first foot support bladder to the ambient environment (e.g., in a first bladder "deflate" mode as shown in FIG. 2E) for fluid distributors, fluid transfer systems, sole structures, fluid flow control systems, foot support systems, and/or articles of footwear in accordance with some aspects of this technology.
Figure 9B:
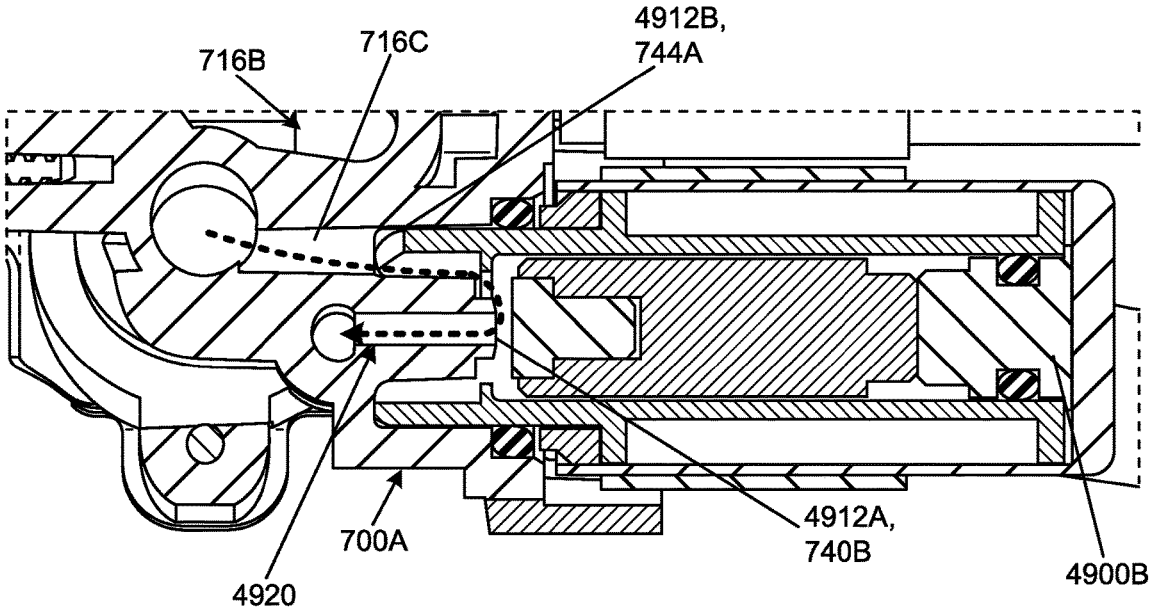
Figure 9C:
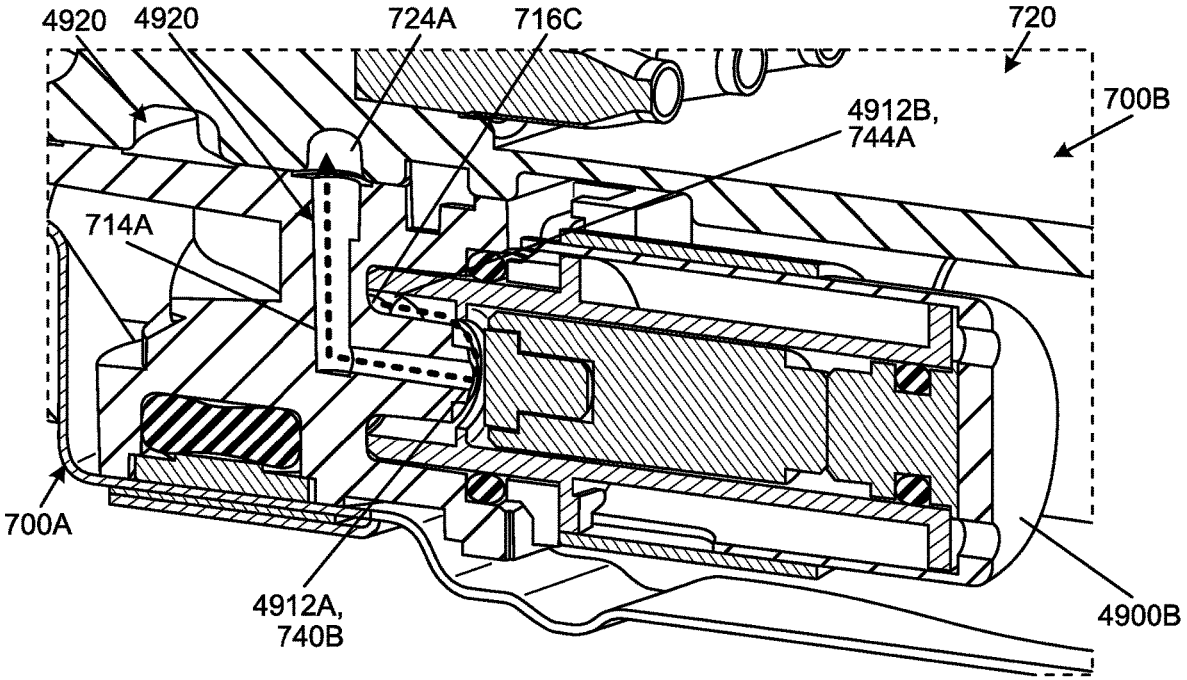
Figure 9D:
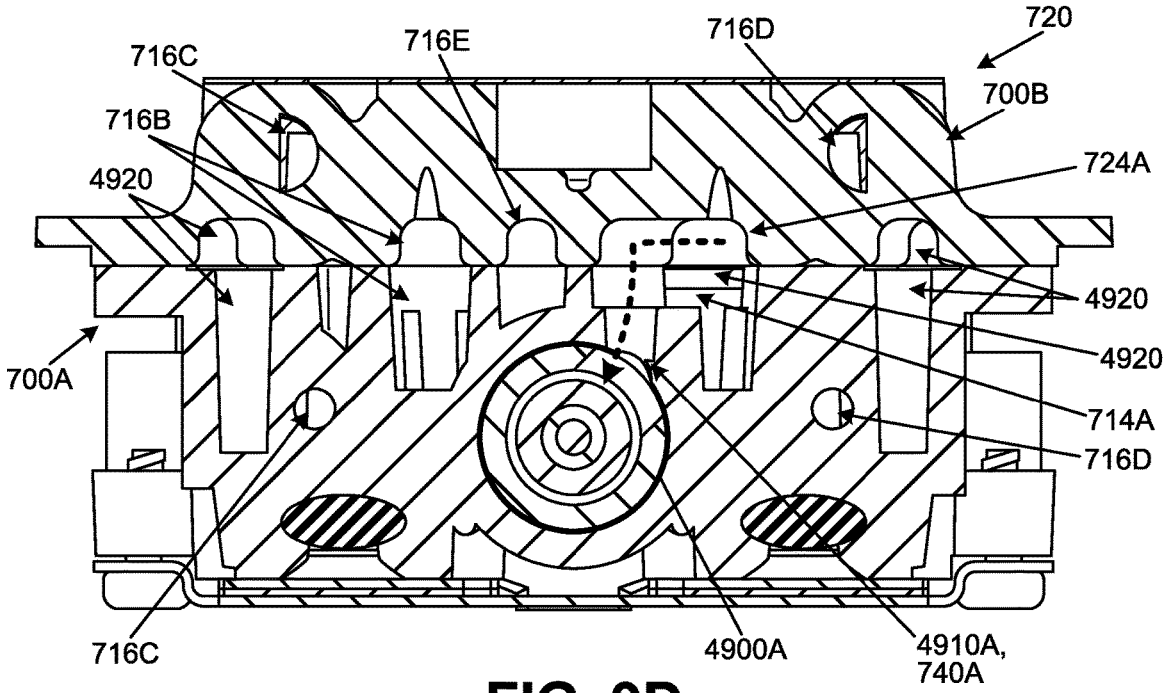
Figure 9E:
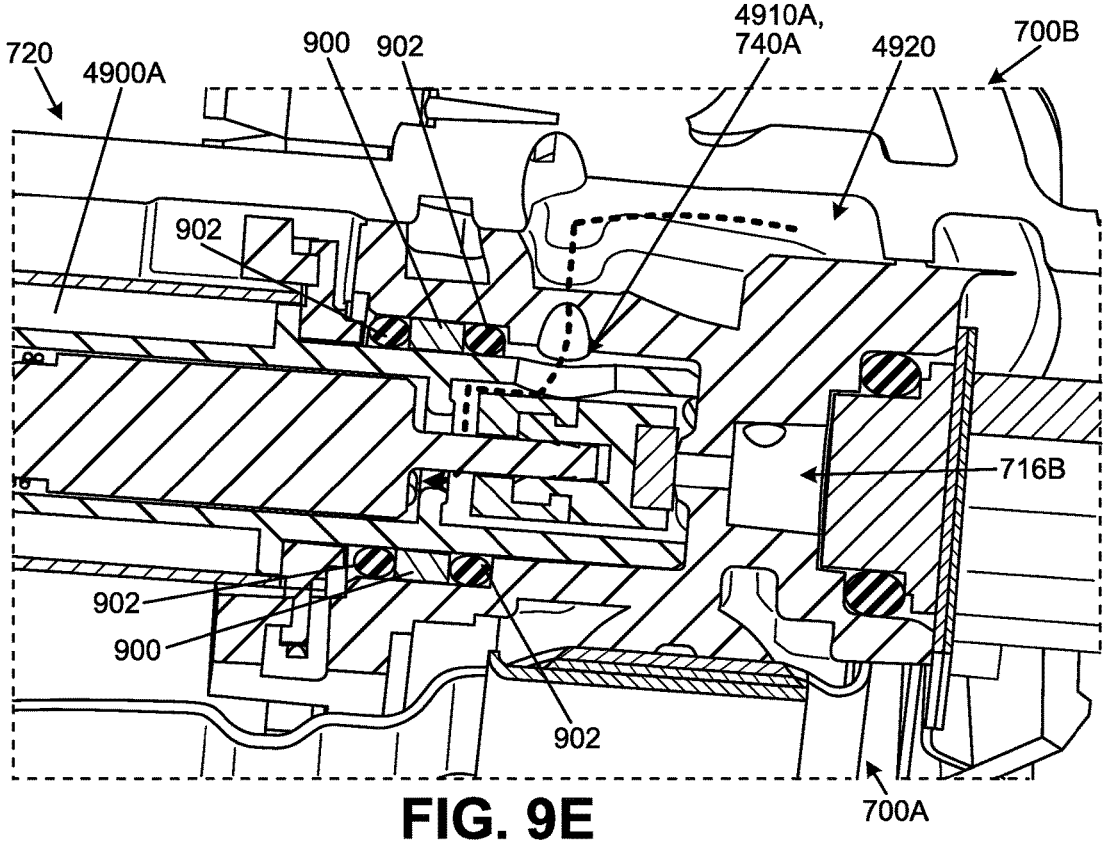
Figure 9F:
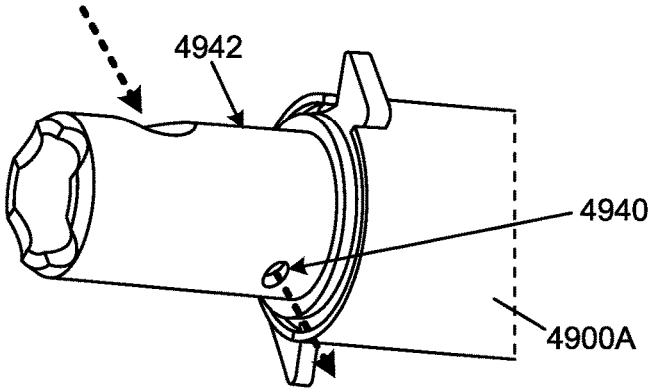
Figure 9G:
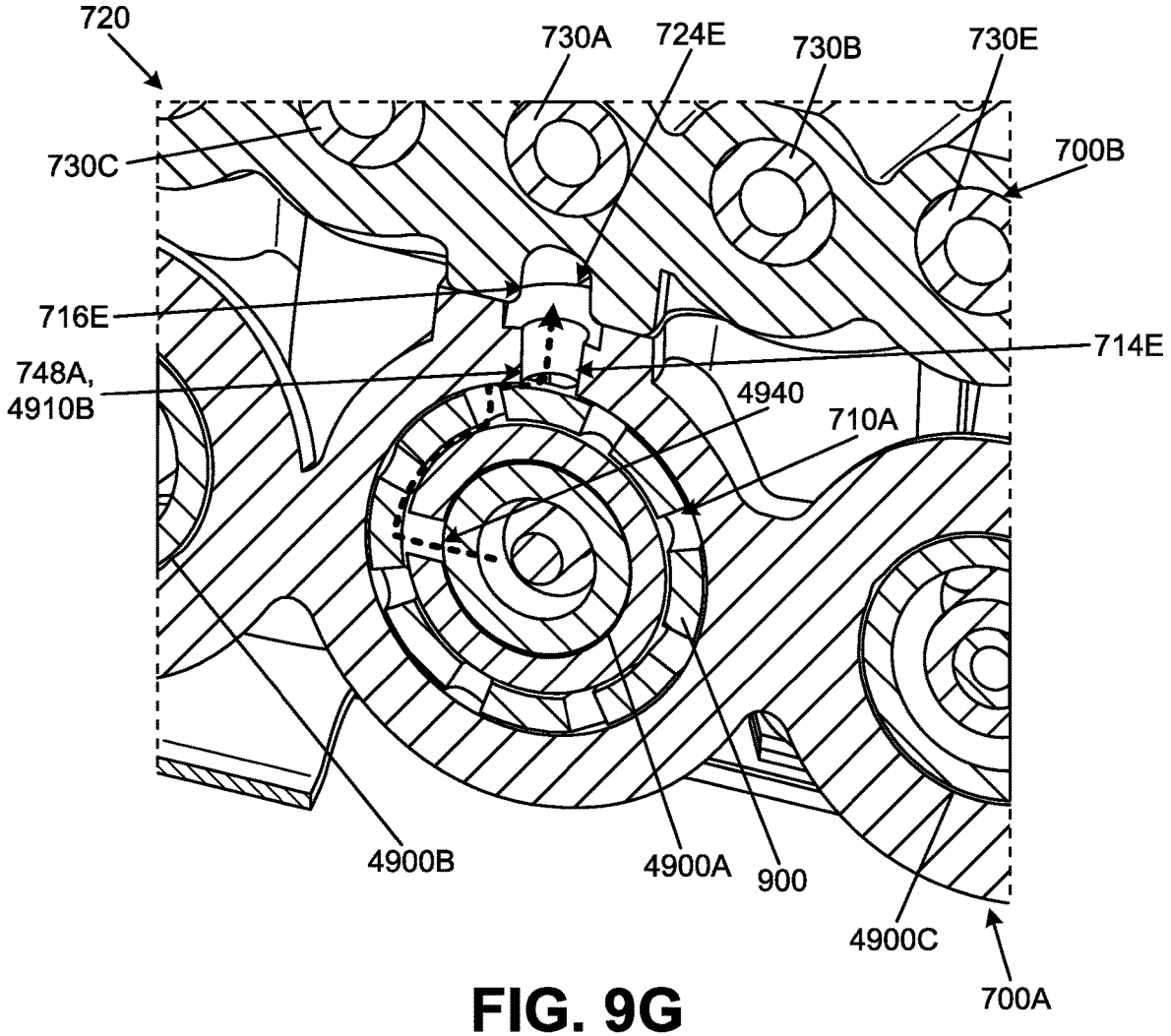
Figure 9H:
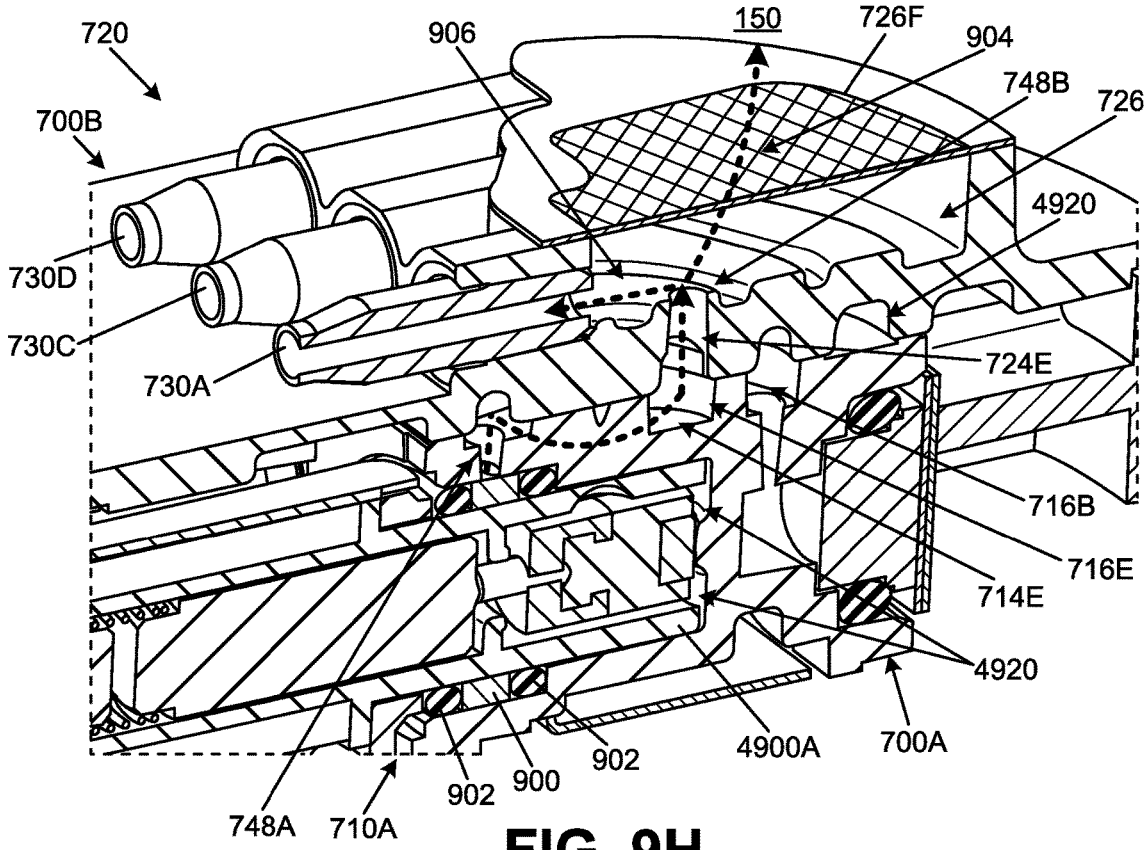

FIGS. 9A-9H illustrate fluid flow through the fluid distributor 720 for the operational state shown in FIG. 2E—from the first foot support bladder 200A to the external environment 150. The first steps are somewhat the opposite of the steps described above in conjunction with FIGS. 7C-7F. First, fluid flows from the first foot support bladder 200A, down fluid line 202A and into the fourth connector 730D of the fluid distributor 720. The fourth connector 730D opens into the first foot support bladder channel 716C via opening 744B. The fluid flows through the first foot support bladder channel 716C to opening 744A and to the port 4912B of the second solenoid 4900B. Second solenoid 4900B is in the open configuration (and third solenoid 4900C is in the closed configuration). Thus, as shown in FIGS. 9B and 9C, fluid flows through the second solenoid 4900B to its other port 4912A, and port 4912A opens at opening 740B and moves fluid into the main fluid distribution channel 4920 of the fluid distributor 720. Once in the main fluid distribution channel 4920, fluid moves through opening 740A and to the first port 4910A of the first solenoid 4900A. First solenoid 4900A is unlatched in this configuration, thus allowing fluid to flow from port 4910A to port 4910B. Thus, fluid moves through the first solenoid 4900A as shown in FIGS. 9D and 9E. Fluid exits the interior of the first solenoid 4900A through a small hole 4940 in the valve bobbin 4942. See FIG. 9F. As described above in conjunction with FIGS. 5A-5F, perforated spacer 900 is mounted between O-rings 902 that seal the first solenoid 4900 in solenoid mount 710A. Fluid exiting the bobbin 4942's hole 4940 moves through (and/or around) the perforated spacer 900 and exits the first solenoid 4900A (via port 4910B) at the first solenoid mount 710A and is released into the fluid release channel 716E through opening 748A. See also FIG. 9G. Once in the fluid release channel 716E, fluid moves within the fluid release channel 716E back into the internal chamber 726 through opening 748B. See FIG. 9H. From there, the fluid can either be released to the exterior environment 150 (e.g., through the filter 726F) (see fluid flow line 904) or it can be pulled back into the first connector 730A, where it can be sent to the pump 500 and readmitted back into the fluid distributor 720 (see fluid flow line 906).

Figure 10A:
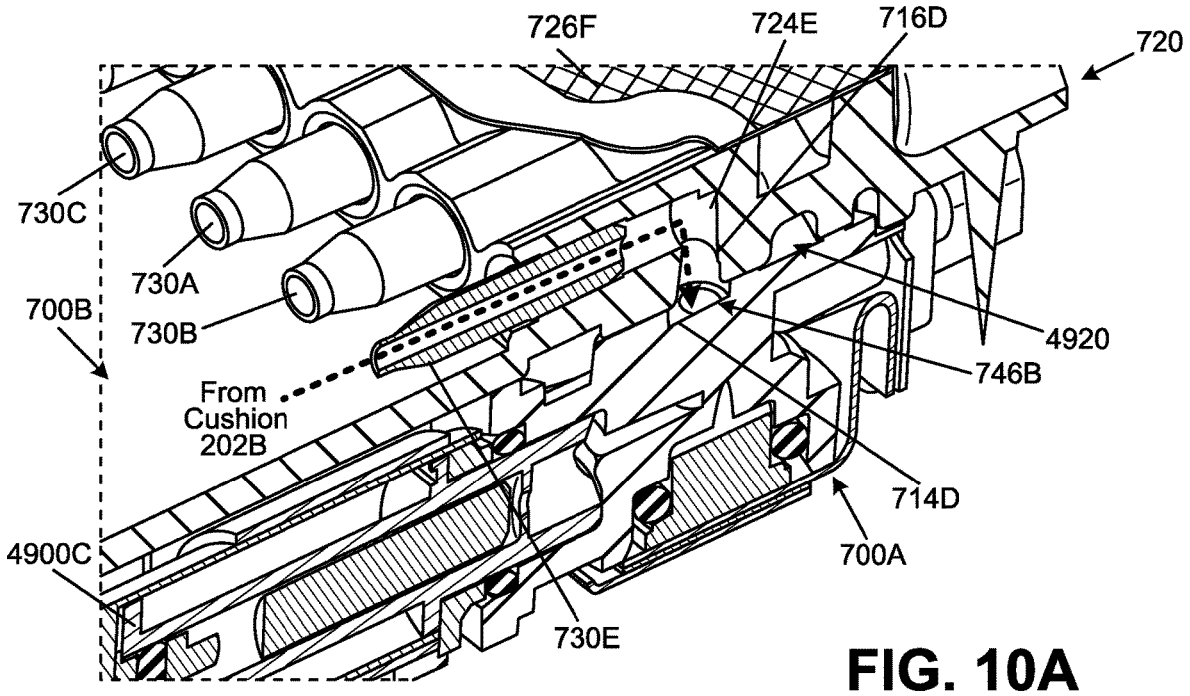
FIGS. 10A-10H illustrate movement of fluid from a second foot support bladder to the ambient environment (e.g., in a second bladder "deflate" mode as shown in FIG. 2F) for fluid distributors, fluid transfer systems, sole structures, fluid flow control systems, foot support systems, and/or articles of footwear in accordance with some aspects of this technology.
Figure 10B:
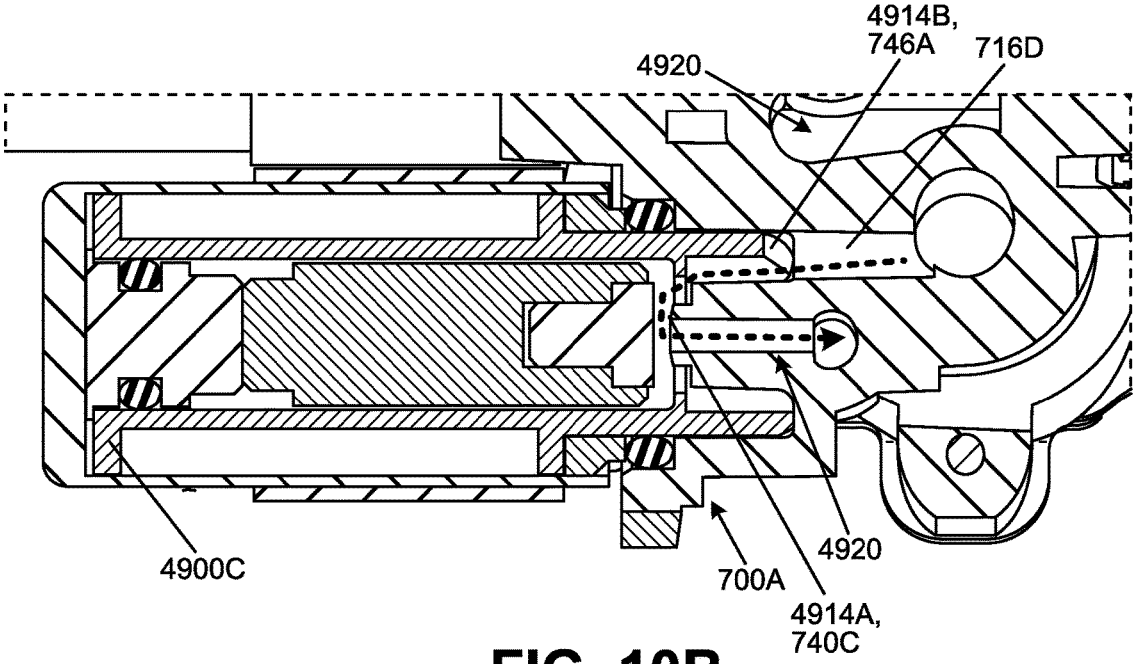
Figure 10C:
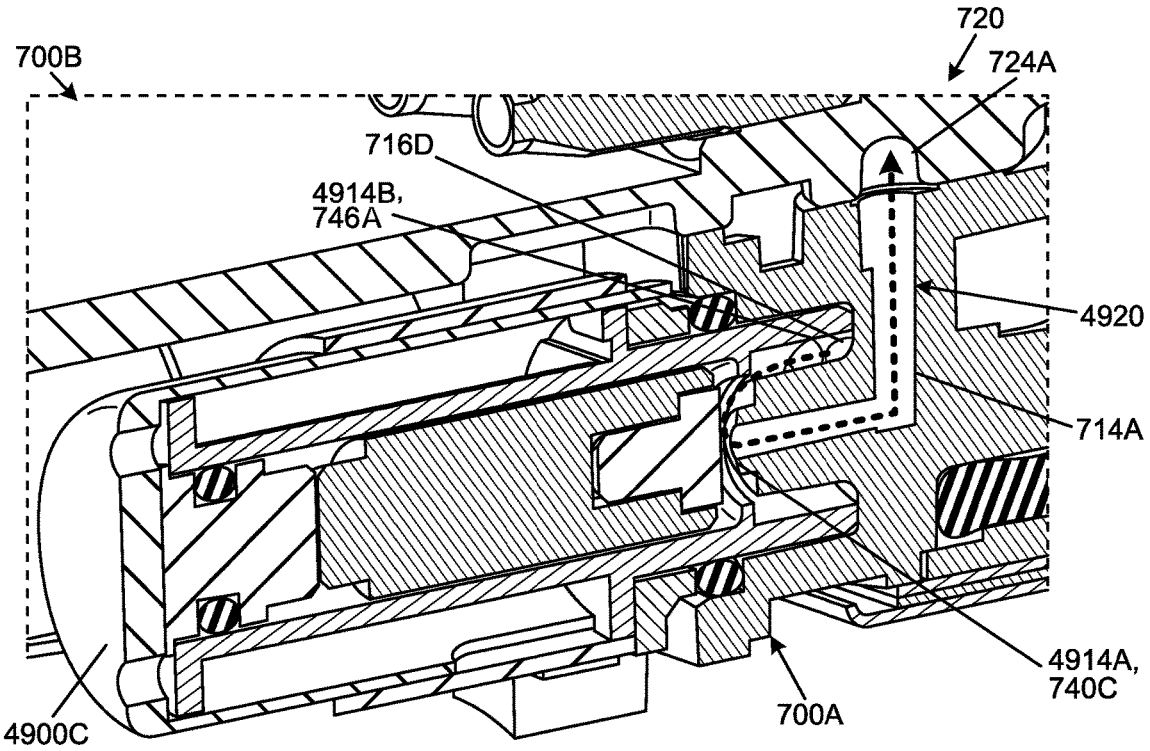
Figure 10D:
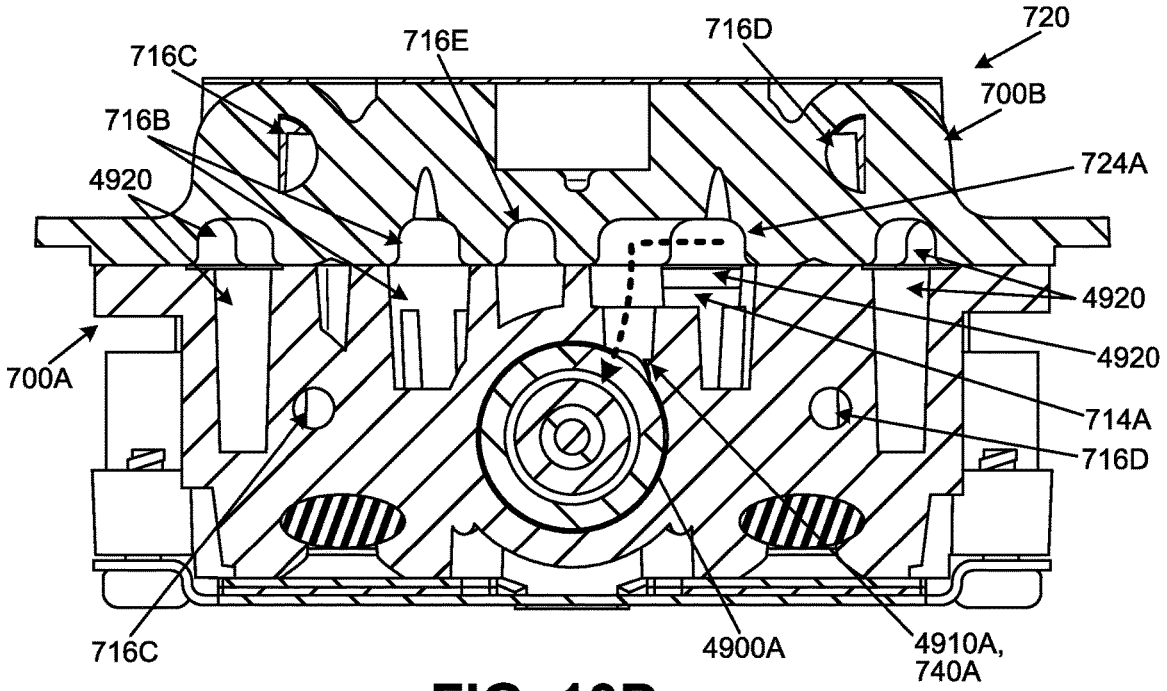
Figure 10E:
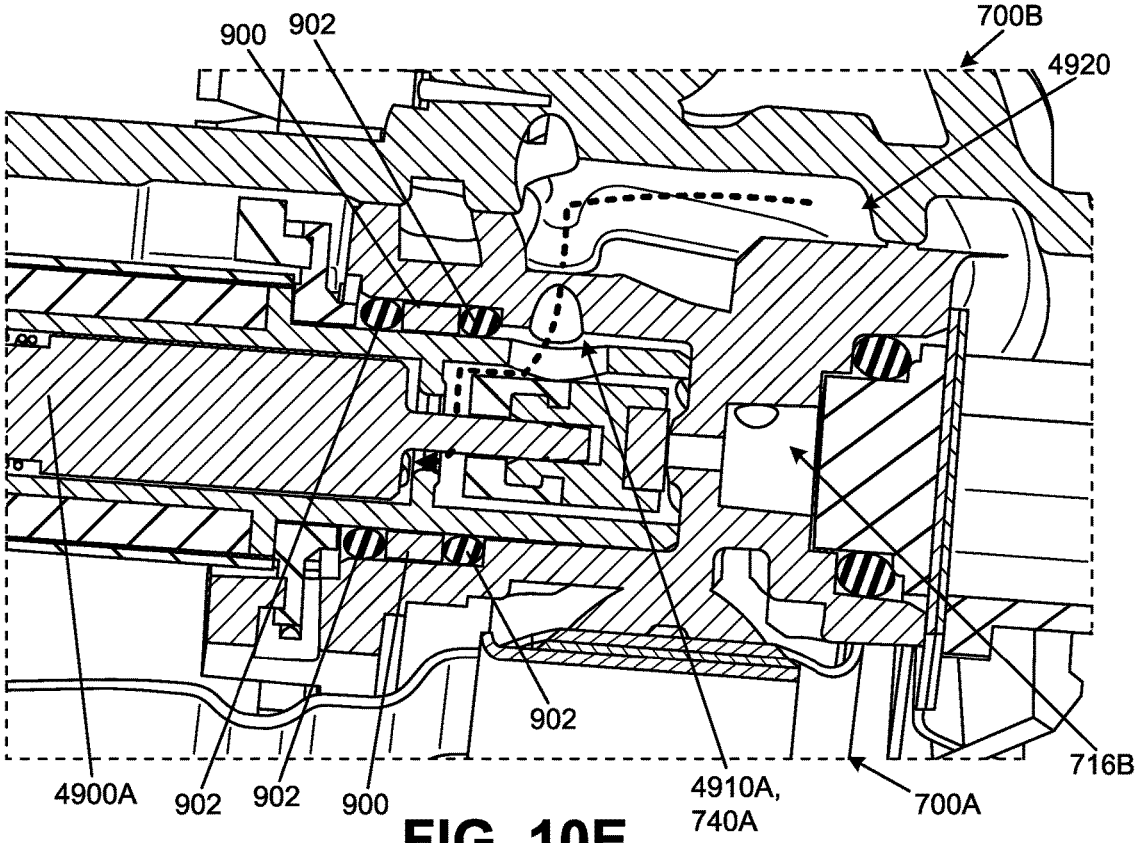
Figure 10F:
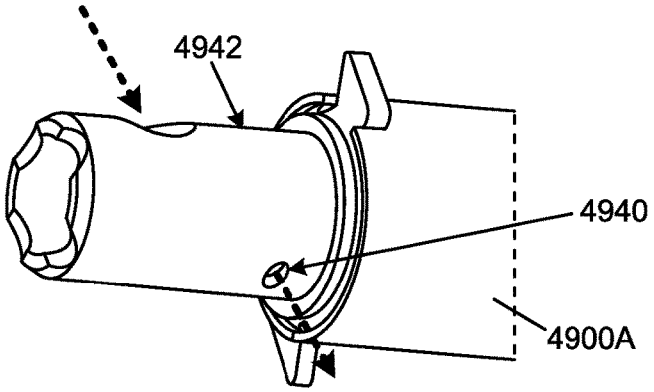
Figure 10G:
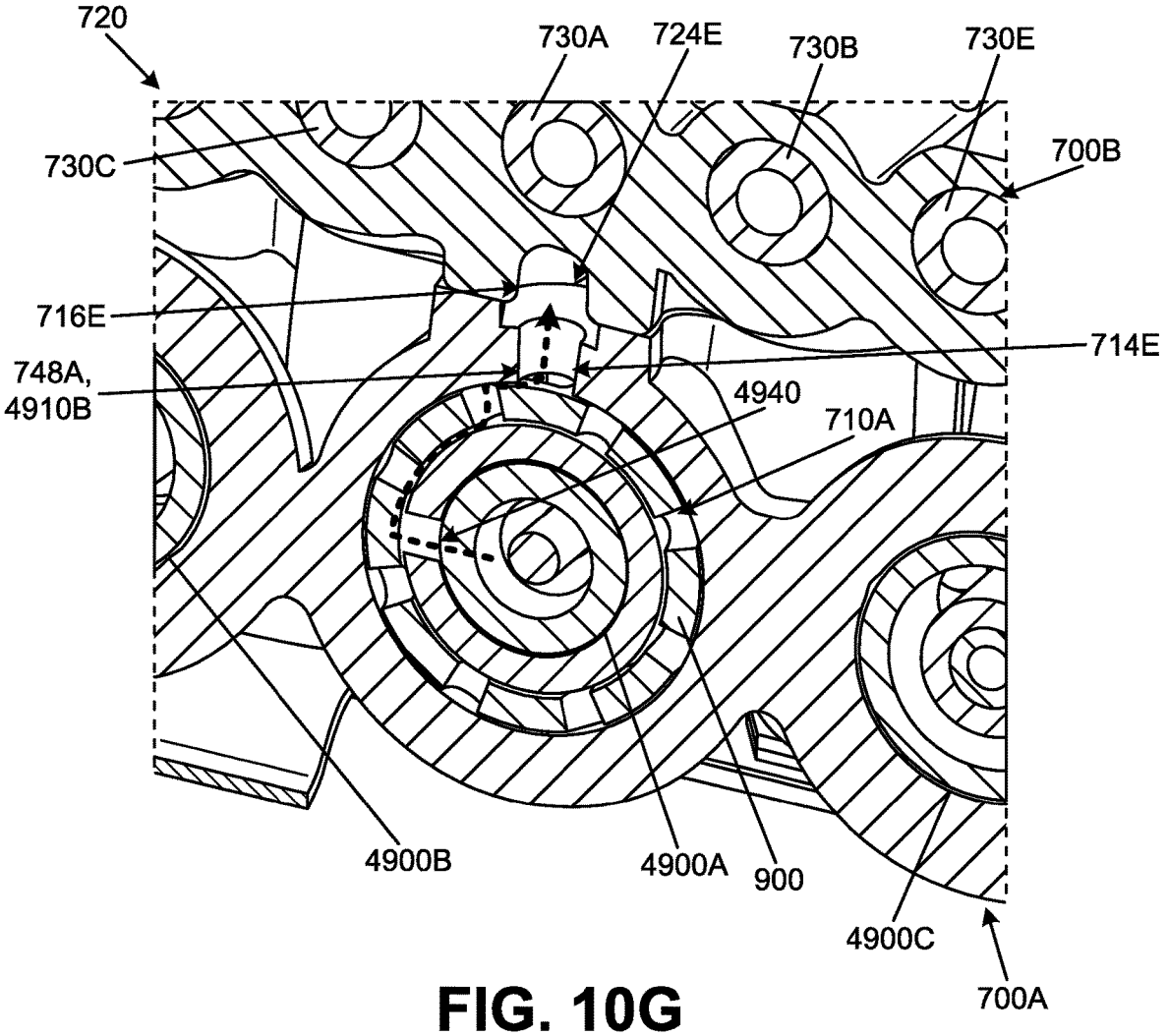
Figure 10H:
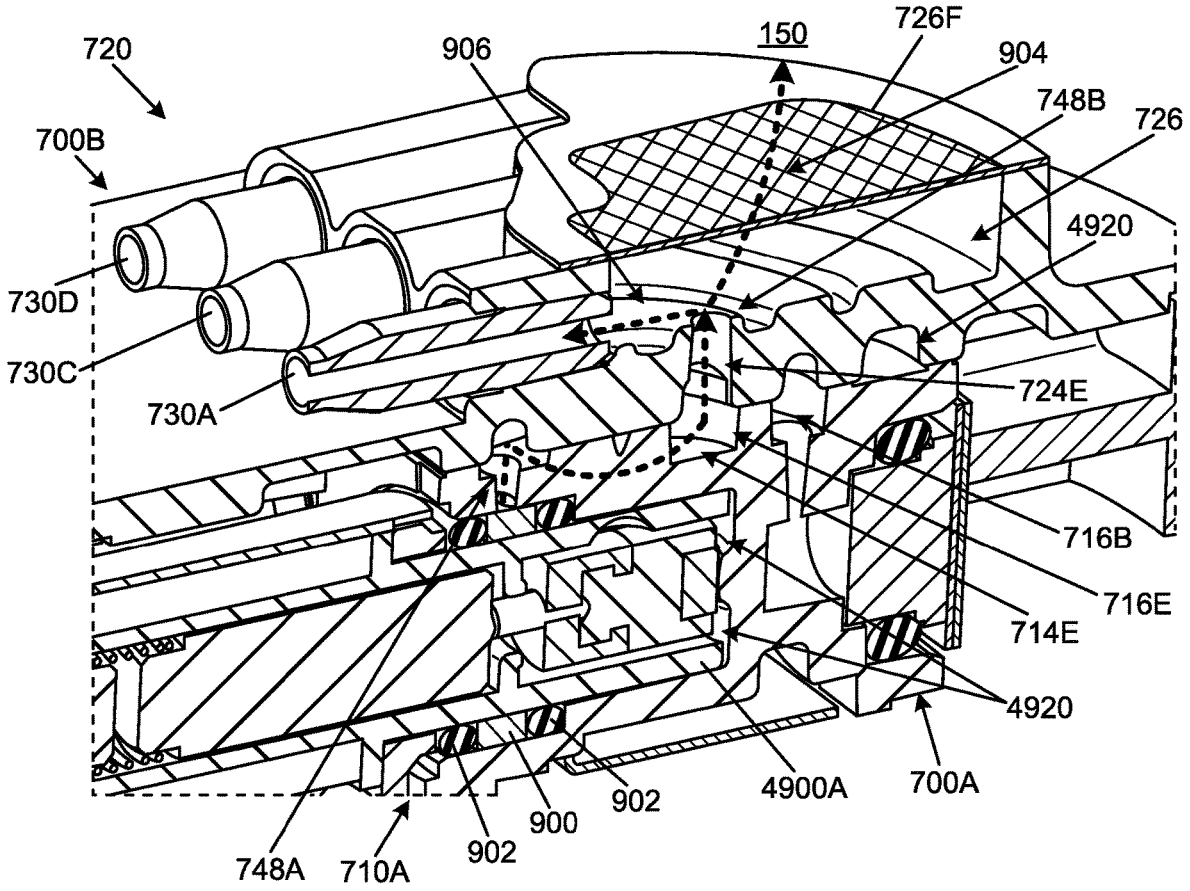

FIGS. 10A-10H illustrate fluid flow through the fluid distributor 720 for the operational state shown in FIG. 2F—from the second foot support bladder 200B to the external environment 150. As first steps, fluid flows from the second foot support bladder 200B, down fluid line 202B and into the fifth connector 730E of the fluid distributor 720. The fifth connector 730E opens into the second foot support bladder channel 716D via opening 746B. The fluid flows through the second foot support bladder channel 716D to opening 746A and to the port 4914B of the third solenoid 4900C. Third solenoid 4900C is in the open configuration (and second solenoid 4900B is in the closed configuration). Thus, as shown in FIGS. 10B and 10C, fluid flows through the third solenoid 4900C to its other port 4914A, and port 4914A opens at opening 740C and moves fluid into the main fluid distribution channel 4920 of the fluid distributor 720. Once in the main fluid distribution channel 4920, fluid moves through opening 740A and to the first port 4910A of the first solenoid 4900A. First solenoid 4900A is unlatched in this configuration, thus allowing fluid to flow from port 4910A to port 4910B. Thus, fluid moves through the first solenoid 4900A as shown in FIGS. 10D and 10E. Fluid exits the interior of the first solenoid 4900A through a small hole 4940 in the valve bobbin 4942. See FIG. 10F. As described above in conjunction with FIGS. 5A-5F, perforated spacer 900 mounted between O-rings 902 seals the first solenoid 4900 in solenoid mount 710A. Fluid exiting the bobbin 4942's hole 4940 moves through (and/or around) the perforated spacer 900 and exits the first solenoid 4900A (via port 4910B) at the first solenoid mount 710A and is released into the fluid release channel 716E through opening 748A. See also FIG. 10G. Once in the fluid release channel 716E, fluid moves within the fluid release channel 716E back into the internal chamber 726 through opening 748B. See FIG. 10H. From there, the fluid can either be released to the exterior environment 150 (e.g., through the filter 726F) (see fluid flow line 904) or it can be pulled back into the first connector 730A, where it can be sent to the pump 500 and readmitted back into the fluid distributor 720 (see fluid flow line 906).

More or fewer foot support bladders may be included in foot support systems, sole structures, and/or articles of footwear in accordance with examples of this technology, e.g., by adding or removing corresponding foot support channels (e.g., like channels 716C, 716D) in the fluid distributor 720, by adding or removing corresponding connectors (e.g., like 730D, 730E) in the fluid distributor 720, by adding or removing corresponding fluid lines (e.g., like 202A, 202B), by adding and removing corresponding solenoids 4900B, 4900C, etc. More or fewer fluid containers or tanks (e.g., like tank 400) may be included in foot support systems, sole structures, and/or articles of footwear in accordance with examples of this technology, e.g., by adding or removing corresponding tank channels (e.g., like channel 716B) in the fluid distributor 720, by adding or removing corresponding connectors (e.g., like 730C) in the fluid distributor 720, by adding or removing corresponding tank fluid lines (e.g., like 402), etc.

Other operational states also may be provided, such as a tank-to-ambient operational state (a tank "deflate" mode). Such an operational state may include movement of fluid from the tank 400 through fluid line 402 to connector 730C, through tank channel 716B in the fluid distributor (akin to FIGS. 7A-7B), through the first solenoid 4900A (from port 4910C to port 4910B), out of the first solenoid 4900A (e.g., through the bobbin 4942, perforated spacer 900, etc.), into the fluid release channel 716E of the fluid distributor 720, and to the ambient environment (e.g., as described in conjunction with FIGS. 9E-9H and 10E-10H). In this potential operational state, first solenoid 4900A must be capable of being placed in a configuration in which ports 4910B and 4910C are open (e.g., and port 4900A is closed (or other appropriate fluid lines and/or fluid routing must be provided)). As other potential operational states: (a) two or more foot support bladders (e.g., 200A, 200B) may be inflated simultaneously (e.g., by the operational states shown in FIGS. 2C and 2D and having both second solenoid 4900B and third solenoid 4900C open simultaneously as fluid moves from the tank 400 to the foot support bladders 200A, 200B); and/or (b) two or more foot support bladders (e.g., 200A, 200B) may be deflated simultaneously (e.g., by the operational states shown in FIGS. 2E and 2F and having both second solenoid 4900B and third solenoid 4900C open simultaneously as fluid moves from the foot support bladders 200A, 200B to the ambient environment 150). As still additional or alternative operational states, fluid can be moved from the pump(s) 500 to directly inflate one or more foot support bladders (e.g., 200A, 200B), e.g., by closing solenoid 4900A, and opening solenoid(s) 4900B and/or 4900C while the pump(s) 500 moves fluid from the fluid supply inlet 732 to incoming pressurized fluid line 606.

Aspects of this technology, such as the arrangement of the channels 4920, 716B, 716C, 716D, and 716E in the fluid distributor 720, the distributor 720 construction, and the like, may be useful for making easy to mount and/or compact and/or lightweight systems for altering foot support pressure in footwear and foot-receiving devices that contain one or more inflatable foot support bladders.

III. Conclusion

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A fluid distributor for a foot support system, comprising:

a first body portion that includes:

(a) a first side having a first solenoid mount and a second solenoid mount, and (b) a second side including a first surface having: (i) a first open channel that defines at least a portion of a main fluid distribution channel of the fluid distributor in the first surface, wherein the first open channel includes a first opening in fluid communication with the first solenoid mount and a second opening in fluid communication with the second solenoid mount, (ii) a second open channel that defines at least a portion of a tank channel of the fluid distributor in the first surface, wherein the second open channel includes a third opening in fluid communication with the first solenoid mount, and (iii) a third open channel that defines at least a portion of a first foot support bladder channel of the fluid distributor in the first surface, wherein the third open channel includes a fourth opening in fluid communication with the second solenoid mount; and a second body portion engaged with the first surface, the second body portion closing the first open channel, the second open channel, and the third open channel at the first surface.

Clause 2. The fluid distributor according to Clause 1, wherein the second body portion includes a second surface that directly faces the first surface of the second side of the first body portion, wherein the second surface includes: (i) a main fluid distribution channel recess that defines a portion of the main fluid distribution channel of the fluid distributor, (ii) a tank channel recess that defines a portion of the tank channel of the fluid distributor, and (iii) a first foot support bladder channel recess that defines a portion of the first foot support bladder channel of the fluid distributor.

Clause 3. The fluid distributor according to Clause 1 or 2, wherein the second body portion includes a fluid supply inlet.

Clause 4. The fluid distributor according to Clause 3, further comprising: a filter that filters fluid before the fluid completely passes through the fluid supply inlet.

Clause 5. The fluid distributor according to Clause 1 or 2, wherein the second body portion defines an internal chamber, wherein incoming fluid enters the fluid distributor through the internal chamber.

Clause 6. The fluid distributor according to any one of Clauses 1 to 5, wherein the second body portion further includes: (a) a first connector port in fluid communication with a fluid supply inlet, (b) a second connector port in fluid communication with the main fluid distribution channel, (c) a third connector port in fluid communication with the tank channel, and (d) a fourth connector port in fluid communication with the first foot support bladder channel.

Clause 7. The fluid distributor according to any one of Clauses 1 to 5, wherein the second body portion further includes: (a) a first connector port in fluid communication with the main fluid distribution channel, (b) a second connector port in fluid communication with the tank channel, and (c) a third connector port in fluid communication with the first foot support bladder channel.

Clause 8. The fluid distributor according to any one of Clauses 1 to 7, wherein at the first surface, the main fluid distribution channel includes: (a) a base line, (b) a first arm extending from the base line toward the first solenoid mount, the first arm including the first opening, and (c) a second arm extending from the base line toward the second solenoid mount, the second arm including the second opening.

Clause 9. The fluid distributor according to Clause 8, wherein at the first surface, the tank channel is located between the first arm and the second arm.

Clause 10. The fluid distributor according to Clause 8 or 9, wherein at the first surface, the first foot support bladder channel is located between the first arm and the second arm.

Clause 11. The fluid distributor according to any one of Clauses 1 to 10, wherein the second body portion engages the first body portion to sealingly separate the main fluid distribution channel, the tank channel, and the first foot support bladder channel from one another at the first surface, and/or wherein the first side of the first body portion further includes a third solenoid mount, wherein the first open channel further includes a fifth opening in fluid communication with the third solenoid mount, wherein the first surface of the second side of the first body portion further includes a fourth open channel that defines at least a portion of a second foot support bladder channel of the fluid distributor in the first surface, and wherein the fourth open channel includes a sixth opening in fluid communication with the third solenoid mount.

Clause 12. A fluid distributor for a foot support system, comprising:

a first body portion that includes:

(a) a first side having a first solenoid mount and a second solenoid mount, and (b) a second side including a first surface having: (i) a first open channel that defines at least a portion of a main fluid distribution channel of the fluid distributor in the first surface, wherein the first open channel includes a first opening in fluid communication with the first solenoid mount and a second opening in fluid communication with the second solenoid mount, (ii) a second open channel that defines at least a portion of a tank channel of the fluid distributor in the first surface, wherein the second open channel includes a third opening in fluid communication with the first solenoid mount, (iii) a third open channel that defines at least a portion of a first foot support bladder channel of the fluid distributor in the first surface, wherein the third open channel includes a fourth opening in fluid communication with the second solenoid mount, and (iv) a fourth open channel that defines at least a portion of a fluid release channel of the fluid distributor in the first surface, wherein the fourth open channel includes a fifth opening in fluid communication with the first solenoid mount; and a second body portion engaged with the first surface, the second body portion closing the first open channel, the second open channel, the third open channel, and the fourth open channel at the first surface.

Clause 13. The fluid distributor according to Clause 12, wherein the first side of the first body portion further includes a third solenoid mount, wherein the first open channel further includes a sixth opening in fluid communication with the third solenoid mount, wherein the first surface of the second side of the first body portion further includes a fifth open channel that defines at least a portion of a second foot support bladder channel of the fluid distributor in the first surface, and wherein the fifth open channel includes a seventh opening in fluid communication with the third solenoid mount.

Clause 14. The fluid distributor according to Clause 13, wherein the second body portion includes a second surface that directly faces the first surface of the second side of the first body portion, wherein the second surface includes: (i) a main fluid distribution channel recess that defines a portion of the main fluid distribution channel of the fluid distributor, (ii) a tank channel recess that defines a portion of the tank channel of the fluid distributor, (iii) a first foot support bladder channel recess that defines a portion of the first foot support bladder channel of the fluid distributor, (iv) a fluid release channel recess that defines a portion of the fluid release channel of the fluid distributor, and (v) a second foot support bladder channel recess that defines a portion of the second foot support bladder channel of the fluid distributor.

Clause 15. The fluid distributor according to Clause 13 or 14, wherein the second body portion further includes a connector port in fluid communication with the second foot support bladder channel.

Clause 16. The fluid distributor according to any one of Clauses 13 to 15, wherein at the first surface, the main fluid distribution channel includes: (a) a base line, (b) a first arm extending from the base line toward the first solenoid mount, the first arm including the first opening, (c) a second arm extending from the base line toward the second solenoid mount, the second arm including the second opening, and a third arm extending from the base line toward the second solenoid mount, the third arm including the sixth opening.

Clause 17. The fluid distributor according to Clause 16, wherein at the first surface, the tank channel is located between the first arm and the second arm.

Clause 18. The fluid distributor according to Clause 16 or 17, wherein at the first surface, the first foot support bladder channel is located between the first arm and the second arm.

Clause 19. The fluid distributor according to any one of Clauses 16 to 18, wherein at the first surface, the fluid release channel is located between the first arm and the second arm.

Clause 20. The fluid distributor according to any one of Clauses 16 to 19, wherein at the first surface, the second foot support bladder channel is located between the first arm and the third arm.

Clause 21. The fluid distributor according to Clause 12 or 13, wherein the second body portion includes a second surface that directly faces the first surface of the second side of the first body portion, wherein the second surface includes: (i) a main fluid distribution channel recess that defines a portion of the main fluid distribution channel of the fluid distributor, (ii) a tank channel recess that defines a portion of the tank channel of the fluid distributor, (iii) a first foot support bladder channel recess that defines a portion of the first foot support bladder channel of the fluid distributor, and (iv) a fluid release channel recess that defines a portion of the fluid release channel of the fluid distributor.

Clause 22. The fluid distributor according to any one of Clauses 12 to 21, wherein the second body portion includes a fluid supply inlet.

Clause 23. The fluid distributor according to Clause 22, further comprising: a filter that filters fluid before the fluid completely passes through the fluid supply inlet.

Clause 24. The fluid distributor according to any one of Clauses 12 to 21, wherein the second body portion defines an internal chamber, wherein incoming fluid enters the fluid distributor through the internal chamber and/or wherein the fluid release channel of the fluid distributor releases fluid into the internal chamber.

Clause 25. The fluid distributor according to any one of Clauses 12 to 21, wherein the second body portion further includes: (a) a first connector port in fluid communication with a fluid supply inlet, (b) a second connector port in fluid communication with the main fluid distribution channel, (c) a third connector port in fluid communication with the tank channel, and (d) a fourth connector port in fluid communication with the first foot support bladder channel.

Clause 26. The fluid distributor according to any one of Clauses 12 to 24, wherein the second body portion further includes: (a) a first connector port in fluid communication with the main fluid distribution channel, (b) a second connector port in fluid communication with the tank channel, and (c) a third connector port in fluid communication with the first foot support bladder channel.

Clause 27. The fluid distributor according to any one of Clauses 12 or 22 to 26, wherein at the first surface, the main fluid distribution channel includes: (a) a base line, (b) a first arm extending from the base line toward the first solenoid mount, the first arm including the first opening, and (c) a second arm extending from the base line toward the second solenoid mount, the second arm including the second opening.

Clause 28. The fluid distributor according to Clause 27, wherein at the first surface, the tank channel is located between the first arm and the second arm.

Clause 29. The fluid distributor according to Clause 27 or 28, wherein at the first surface, the first foot support bladder channel is located between the first arm and the second arm.

Clause 30. The fluid distributor according to any one of Clauses 27 to 29, wherein at the first surface, the fluid release channel is located between the first arm and the second arm.

Clause 31. The fluid distributor according to any one of Clauses 12 to 30, wherein the second body portion engages the first body portion to sealingly separate the main fluid distribution channel, the tank channel, the first foot support bladder channel, and the fluid release channel from one another at the first surface.

Clause 32. A foot support system, comprising:

a first foot support bladder;

a fluid tank; and a fluid distributor according to any one of Clauses 1 to 31, wherein the first foot support bladder is in fluid communication with the second solenoid mount, and wherein the fluid tank is in fluid communication with the first solenoid mount.

Clause 33. An article of footwear, comprising:

an upper;

a sole structure; and a foot support system according to Clause 32 engaged with one or both of the upper or the sole structure.

Clause 34. A fluid distributor for a foot support system, comprising:

a first body portion that includes:

(a) a first side having a first solenoid mount and a second solenoid mount, and (b) a second side including a first surface having: (i) a first open channel that defines at least a portion of a main fluid distribution channel of the fluid distributor in the first surface, wherein the first open channel includes a first opening in fluid communication with the first solenoid mount and a second opening in fluid communication with the second solenoid mount, (ii) a second open channel that defines at least a portion of a first foot support bladder channel of the fluid distributor in the first surface, wherein the second open channel includes a third opening in fluid communication with the second solenoid mount, and (iv) a third open channel that defines at least a portion of a fluid release channel of the fluid distributor in the first surface, wherein the third open channel includes a fourth opening in fluid communication with the first solenoid mount; and a second body portion engaged with the first surface, the second body portion closing the first open channel, the second open channel, and the third open channel at the first surface.

Clause 35. The fluid distributor according to Clause 34, wherein the second body portion includes a second surface that directly faces the first surface of the second side of the first body portion, wherein the second surface includes: (i) a main fluid distribution channel recess that defines a portion of the main fluid distribution channel of the fluid distributor, (ii) a first foot support bladder channel recess that defines a portion of the first foot support bladder channel of the fluid distributor, and (iii) a fluid release channel recess that defines a portion of the fluid release channel of the fluid distributor.

Clause 36. The fluid distributor according to Clause 34 or 35, wherein the second body portion includes a fluid supply inlet.

Clause 37. The fluid distributor according to Clause 36, further comprising: a filter that filters fluid before the fluid completely passes through the fluid supply inlet.

Clause 38. The fluid distributor according to Clause 34 or 35, wherein the second body portion defines an internal chamber, wherein incoming fluid enters the fluid distributor through the internal chamber and/or wherein the fluid release channel of the fluid distributor releases fluid into the internal chamber.

Clause 39. The fluid distributor according to any one of Clauses 34 to 38, wherein the second body portion engages the first body portion to sealingly separate the main fluid distribution channel, the first foot support bladder channel, and the fluid release channel from one another at the first surface.

Clause 40. A foot support system, comprising:

a first foot support bladder; and a fluid distributor according to any one of Clauses 34 to 39, wherein the first foot support bladder is in fluid communication with the second solenoid mount.

Clause 41. An article of footwear, comprising:

an upper;

a sole structure; and a foot support system according to Clause 40 engaged with one or both of the upper or the sole structure.

Clause 42. A foot support system, comprising:

a first foot support bladder;

a fluid tank;

a fluid distributor that includes:

a distributor body that includes: (a) a first solenoid mount, (b) a second solenoid mount, (c) a main fluid distribution channel in fluid communication with the first solenoid mount and in fluid communication with the second solenoid mount, (d) a tank channel in fluid communication with the first solenoid mount, (e) a first foot support bladder channel in fluid communication with the second solenoid mount, (f) a first foot support connector connecting the first foot support bladder with the first foot support bladder channel, and (g) a tank connector connecting the fluid tank with the tank channel;

a first solenoid engaged with the fluid distributor at the first solenoid mount; and a second solenoid engaged with the fluid distributor at the second solenoid mount.

Clause 43. The foot support system according to Clause 42, wherein the fluid distributor further includes a pump connector connecting with the main fluid distribution channel, and wherein the foot support system further comprises: a pump connected with the pump connector.

Clause 44. The foot support system according to Clause 43, wherein the fluid distributor further includes a fluid inlet connector connected with a fluid source, and wherein the foot support system further comprises: a fluid line connecting the fluid inlet connector with an inlet to the pump, and wherein an outlet of the pump supplies fluid to the pump connector.

Clause 45. The foot support system according to any one of Clauses 42 to 44, further comprising:

a second foot support bladder; and a third solenoid, wherein the fluid distributor further includes: (a) third solenoid mount engaged with the third solenoid, (b) a second foot support bladder channel in fluid communication with the third solenoid mount, and (c) a second foot support connector connecting the second foot support bladder with the second foot support bladder channel.

Clause 46. An article of footwear, comprising:

an upper;

a sole structure; and a foot support system according to any one of Clauses 42 to 45 engaged with one or both of the upper or the sole structure.

Clause 47. A foot support system, comprising:

a first foot support bladder;

a fluid tank;

a fluid distributor that includes:

a distributor body that includes: (a) a first solenoid mount, (b) a second solenoid mount, (c) a main fluid distribution channel in fluid communication with the first solenoid mount and in fluid communication with the second solenoid mount, (d) a tank channel in fluid communication with the first solenoid mount, (e) a first foot support bladder channel in fluid communication with the second solenoid mount, (f) a first foot support connector connecting the first foot support bladder with the first foot support bladder channel, (g) a tank connector connecting the fluid tank with the tank channel, and (h) a fluid source connector that receives fluid from a fluid source and supplies the fluid to the main fluid distribution channel;

a first solenoid engaged with the fluid distributor at the first solenoid mount; and a second solenoid engaged with the fluid distributor at the second solenoid mount.

Clause 48. The foot support system according to Clause 47, wherein the distributor body further includes a fluid release channel in fluid communication with an ambient environment.

Clause 49. The foot support system according to Clause 48, wherein the foot support system is configured to be selectively placed in a stand by fluid flow configuration in which fluid moves: (a) from the fluid source connector, (b) into the main fluid distribution channel, (c) through the first solenoid, (d) into the fluid release channel, and (e) into the ambient environment.

Clause 50. The foot support system according to any one of Clauses 47 to 49, wherein the foot support system is configured to be selectively placed in a tank inflate configuration in which fluid moves: (a) from the fluid source connector, (b) into the main fluid distribution channel, (c) through the first solenoid, (d) into the tank channel, (e) into the tank connector, and (f) to the fluid tank.

Clause 51. The foot support system according to any one of Clauses 47 to 50, wherein the foot support system is configured to be selectively placed in a first foot support bladder inflate configuration in which fluid moves: (a) from the fluid tank, (b) to the tank connector, (c) into the tank channel, (d) through the first solenoid, (e) into the main fluid distribution channel, (f) through the second solenoid, (g) into the first foot support bladder channel, (h) through the first foot support connector, and (i) to the first foot support bladder.

Clause 52. The foot support system according to any one of Clauses 48 to 51, wherein the foot support system is configured to be selectively placed in a first foot support bladder deflate configuration in which fluid moves: (a) from the first foot support bladder, (b) through the first foot support connector, (c) into the first foot support bladder channel, (d) through the second solenoid, (e) into the main fluid distribution channel, (f) through the first solenoid, (g) into the fluid release channel, and (h) into the ambient environment.

Clause 53. The foot support system according to any one of Clauses 47 to 52, further comprising:

a second foot support bladder, wherein the distributor body further includes: (a) a third solenoid mount, wherein the main fluid distribution channel in fluid communication with the third solenoid mount, (b) a second foot support bladder channel in fluid communication with the third solenoid mount, and (c) a second foot support connector connecting the second foot support bladder with the second foot support bladder channel; and a third solenoid engaged with the fluid distributor at the third solenoid mount.

Clause 54. The foot support system according to Clause 53, wherein the foot support system is configured to be selectively placed in a second foot support bladder inflate configuration in which fluid moves: (a) from the fluid tank, (b) to the tank connector, (c) into the tank channel, (d) through the first solenoid, (e) into the main fluid distribution channel, (f) through the third solenoid, (g) into the second foot support bladder channel, (h) through the second foot support connector, and (i) to the second foot support bladder.

Clause 55. The foot support system according to Clause 53 or 54, wherein the distributor body further includes a fluid release channel in fluid communication with an ambient environment, and wherein the foot support system is configured to be selectively placed in a second foot support bladder deflate configuration in which fluid moves: (a) from the second foot support bladder, (b) through the second foot support connector, (c) into the second foot support bladder channel, (d) through the third solenoid, (e) into the main fluid distribution channel, (f) through the first solenoid, (g) into the fluid release channel, and (h) into the ambient environment.

Clause 56. The foot support system according to any one of Clauses 47 to 55, wherein the distributor body further includes a fluid inlet connector that supplies fluid to the fluid source connector.

Clause 57. The foot support system according to Clause 56, further comprising: a pump having an inlet and an outlet, wherein the inlet of the pump receives fluid from the fluid inlet connector and the outlet of the pump supplies fluid to the fluid source connector.

Clause 58. The foot support system according to Clause 57, wherein the pump is a foot-activated pump.

Clause 59. An article of footwear, comprising:

an upper;

a sole structure; and a foot support system according to any one of Clauses 47 to 58 engaged with one or both of the upper or the sole structure.

What is claimed is:

1. A foot support system, comprising:

a first foot support bladder;

a fluid tank;

a fluid distributor that includes:

a distributor body that includes: (a) a first solenoid mount, (b) a second solenoid mount, (c) a main fluid distribution channel in fluid communication with the first solenoid mount and in fluid communication with the second solenoid mount, (d) a tank channel in fluid communication with the first solenoid mount, (e) a first foot support bladder channel in fluid communication with the second solenoid mount, (f) a first foot support connector connecting the first foot support bladder with the first foot support bladder channel, and (g) a tank connector connecting the fluid tank with the tank channel, and (h) a fluid source connector that receives fluid from a fluid source and supplies the fluid to the main fluid distribution channel;

a first solenoid engaged with the fluid distributor at the first solenoid mount; and a second solenoid engaged with the fluid distributor at the second solenoid mount, wherein the foot support system is configured to be selectively placed in a tank inflate configuration in which fluid moves: (i) from the fluid source connector, (ii) into the main fluid distribution channel, (iii) through the first solenoid, (iv) into the tank channel, (v) into the tank connector, and (vi) to the fluid tank.

2. The foot support system according to claim 1, wherein the fluid source connector comprises a pump connector connecting with the main fluid distribution channel, and wherein the foot support system further comprises:

a pump connected with the pump connector.

3. The foot support system according to claim 2, wherein the fluid distributor further includes a fluid inlet connector connected with the fluid source, and wherein the foot support system further comprises:

a fluid line connecting the fluid inlet connector with an inlet to the pump, and wherein an outlet of the pump supplies fluid to the pump connector.

4. The foot support system according to claim 1, further comprising:

a second foot support bladder; and a third solenoid, wherein the fluid distributor further includes: (a) third solenoid mount engaged with the third solenoid, (b) a second foot support bladder channel in fluid communication with the third solenoid mount, and (c) a second foot support connector connecting the second foot support bladder with the second foot support bladder channel.

5. The foot support system according to claim 1, wherein the distributor body further includes a fluid release channel in fluid communication with an ambient environment, and wherein the foot support system is configured to be selectively placed in a stand by fluid flow configuration in which fluid moves: (a) from the fluid source connector, (b) into the main fluid distribution channel, (c) through the first solenoid, (d) into the fluid release channel, and (e) into the ambient environment.

6. The foot support system according to claim 5, wherein the foot support system is configured to be selectively placed in a first foot support bladder deflate configuration in which fluid moves: (a) from the first foot support bladder, (b) through the first foot support connector, (c) into the first foot support bladder channel, (d) through the second solenoid, (e) into the main fluid distribution channel, (f) through the first solenoid, (g) into the fluid release channel, and (h) into the ambient environment.

7. The foot support system according to claim 1, wherein the foot support system is configured to be selectively placed in a first foot support bladder inflate configuration in which fluid moves: (a) from the fluid tank, (b) to the tank connector, (c) into the tank channel, (d) through the first solenoid, (e) into the main fluid distribution channel, (f) through the second solenoid, (g) into the first foot support bladder channel, (h) through the first foot support connector, and (i) to the first foot support bladder.

8. The foot support system according to claim 1, further comprising:

a second foot support bladder, wherein the distributor body further includes: (a) a third solenoid mount, wherein the main fluid distribution channel is in fluid communication with the third solenoid mount, (b) a second foot support bladder channel in fluid communication with the third solenoid mount, and (c) a second foot support connector connecting the second foot support bladder with the second foot support bladder channel; and a third solenoid engaged with the fluid distributor at the third solenoid mount.

9. The foot support system according to claim 8, wherein the foot support system is configured to be selectively placed in a second foot support bladder inflate configuration in which fluid moves: (a) from the fluid tank, (b) to the tank connector, (c) into the tank channel, (d) through the first solenoid, (e) into the main fluid distribution channel, (f) through the third solenoid, (g) into the second foot support bladder channel, (h) through the second foot support connector, and (i) to the second foot support bladder.

10. The foot support system according to claim 8, wherein the distributor body further includes a fluid release channel in fluid communication with an ambient environment, and wherein the foot support system is configured to be selectively placed in a second foot support bladder deflate configuration in which fluid moves: (a) from the second foot support bladder, (b) through the second foot support connector, (c) into the second foot support bladder channel, (d) through the third solenoid, (e) into the main fluid distribution channel, (f) through the first solenoid, (g) into the fluid release channel, and (h) into the ambient environment.

11. The foot support system according to claim 1, wherein the distributor body further includes a fluid inlet connector that supplies fluid to the fluid source connector.

12. An article of footwear, comprising:

an upper;

a sole structure; and the foot support system according to claim 1 engaged with one or both of the upper or the sole structure.

13. A foot support system comprising:

a first foot support bladder;

a fluid tank;

a fluid distributor that includes:

a distributor body that includes: (a) a first solenoid mount, (b) a second solenoid mount, (c) a main fluid distribution channel in fluid communication with the first solenoid mount and in fluid communication with the second solenoid mount, (d) a tank channel in fluid communication with the first solenoid mount, (e) a first foot support bladder channel in fluid communication with the second solenoid mount, (f) a first foot support connector connecting the first foot support bladder with the first foot support bladder channel, (g) a tank connector connecting the fluid tank with the tank channel, (h) a fluid source connector, and (i) a fluid inlet connector;

a first solenoid engaged with the fluid distributor at the first solenoid mount;

a second solenoid engaged with the fluid distributor at the second solenoid mount; and a pump forming a fluid source for the fluid distributor, the pump having an inlet and an outlet, wherein the inlet of the pump receives fluid from the fluid inlet connector and the outlet of the pump supplies fluid to the fluid source connector, and wherein the fluid source connector supplies the fluid to the main fluid distribution channel.

14. The foot support system according to claim 13, further comprising:

a second foot support bladder; and a third solenoid, wherein the fluid distributor further includes: (a) third solenoid mount engaged with the third solenoid, (b) a second foot support bladder channel in fluid communication with the third solenoid mount, and (c) a second foot support connector connecting the second foot support bladder with the second foot support bladder channel.

15. The foot support system according to claim 13, wherein the distributor body further includes a fluid release channel in fluid communication with an ambient environment, and wherein the foot support system is configured to be selectively placed in a stand by fluid flow configuration in which fluid moves: (a) from the fluid source connector, (b) into the main fluid distribution channel, (c) through the first solenoid, (d) into the fluid release channel, and (e) into the ambient environment.

16. The foot support system according to claim 15, wherein the foot support system is configured to be selectively placed in a first foot support bladder deflate configuration in which fluid moves: (a) from the first foot support bladder, (b) through the first foot support connector, (c) into the first foot support bladder channel, (d) through the second solenoid, (e) into the main fluid distribution channel, (f) through the first solenoid, (g) into the fluid release channel, and (h) into the ambient environment.

17. The foot support system according to claim 13, wherein the foot support system is configured to be selectively placed in a first foot support bladder inflate configuration in which fluid moves: (a) from the fluid tank, (b) to the tank connector, (c) into the tank channel, (d) through the first solenoid, (e) into the main fluid distribution channel, (f) through the second solenoid, (g) into the first foot support bladder channel, (h) through the first foot support connector, and (i) to the first foot support bladder.

18. The foot support system according to claim 13, further comprising:

a second foot support bladder, wherein the distributor body further includes: (a) a third solenoid mount, wherein the main fluid distribution channel is in fluid communication with the third solenoid mount, (b) a second foot support bladder channel in fluid communication with the third solenoid mount, and (c) a second foot support connector connecting the second foot support bladder with the second foot support bladder channel; and a third solenoid engaged with the fluid distributor at the third solenoid mount.

19. The foot support system according to claim 18, wherein the foot support system is configured to be selectively placed in a second foot support bladder inflate configuration in which fluid moves: (a) from the fluid tank, (b) to the tank connector, (c) into the tank channel, (d) through the first solenoid, (e) into the main fluid distribution channel, (f) through the third solenoid, (g) into the second foot support bladder channel, (h) through the second foot support connector, and (i) to the second foot support bladder.

20. The foot support system according to claim 18, wherein the distributor body further includes a fluid release channel in fluid communication with an ambient environment, and wherein the foot support system is configured to be selectively placed in a second foot support bladder deflate configuration in which fluid moves: (a) from the second foot support bladder, (b) through the second foot support connector, (c) into the second foot support bladder channel, (d) through the third solenoid, (e) into the main fluid distribution channel, (f) through the first solenoid, (g) into the fluid release channel, and (h) into the ambient environment.

* * * * *